US006761191B2

(12) United States Patent
Rosen et al.

(10) Patent No.: US 6,761,191 B2
(45) Date of Patent: Jul. 13, 2004

(54) LIQUID FILLING SYSTEM WITH IMPROVED FLUID DISPLACEMENT, NOZZLE AND CONTAINER HANDLING, CLEANING, AND CALIBRATION/SET-UP CAPABILITIES

(76) Inventors: Robert A. Rosen, 19 Shaded Glen Ct., Owings Mills, MD (US) 21117; Joseph Spiteri-Gonzi, 7M Breezy Hill Ct., Cockeysville, MD (US) 21030; Richard N. Bennett, 5900 Grace Lee Ave., Sykesville, MD (US) 21784; Timothy McGrath, 2009 Dumont Rd., Timonium, MD (US) 21093; Shailendra K. Parihar, 23 Pointer Pl., Kendall Park, NJ (US) 08824; George R. Dold, 3312 Tanterra Cir., Brookeville, MD (US) 20833; Richard Mozelack, 5 Pine Cone Ct., Nottingham, MD (US) 21236

( * ) Notice: Subject to any disclaimer, the term of this patent is extended or adjusted under 35 U.S.C. 154(b) by 0 days.

(21) Appl. No.: 10/011,963

(22) Filed: Nov. 5, 2001

(65) Prior Publication Data

US 2002/0139436 A1 Oct. 3, 2002

Related U.S. Application Data

(60) Provisional application No. 60/316,536, filed on Aug. 31, 2001, provisional application No. 60/316,528, filed on Aug. 31, 2001, provisional application No. 60/268,521, filed on Feb. 14, 2001, provisional application No. 60/267,927, filed on Feb. 12, 2001, and provisional application No. 60/245,300, filed on Nov. 3, 2000.

(51) Int. Cl.[7] ..... B65B 1/04

(52) U.S. Cl. ..... 141/91; 141/89; 141/144; 134/169 C; 134/168 C

(58) Field of Search ..... 141/129, 186, 141/237, 238–246, 140–162, 85–91; 134/169 C, 168 C

(56) References Cited

U.S. PATENT DOCUMENTS

| | | | | |
|---|---|---|---|---|
| 3,047,033 A | | 7/1962 | Rosen | |
| 3,237,661 A | | 3/1966 | Rosen | |
| 4,004,620 A | | 1/1977 | Rosen | |
| 4,073,322 A | | 2/1978 | Bennett | |
| 4,201,251 A | | 5/1980 | Bennett et al. | |
| 4,259,999 A | * | 4/1981 | Wada | 141/57 |
| 4,294,294 A | | 10/1981 | Bennett | |
| 4,313,476 A | | 2/1982 | Bennett et al. | |
| 4,394,876 A | | 7/1983 | Brown | |
| 4,401,141 A | | 8/1983 | Rosen et al. | |
| 4,691,748 A | * | 9/1987 | Gilmour | 141/165 |
| 5,348,058 A | | 9/1994 | Ruhl | |
| 5,505,233 A | | 4/1996 | Roberts et al. | |
| 5,823,406 A | | 10/1998 | Roberts | |
| 5,878,796 A | | 3/1999 | Phallen | |
| 5,971,041 A | | 10/1999 | Drewitz | |
| 5,996,650 A | | 12/1999 | Phallen et al. | |

* cited by examiner

*Primary Examiner*—Steven O. Douglas
(74) *Attorney, Agent, or Firm*—Law Offices of Royal W. Craig

(57) ABSTRACT

An improved method and apparatus for a liquid filling system is herein disclosed incorporating means for generating greater overall production rate efficiencies (i.e. number of filled containers per minute per filling station) for automatic systems utilizing diverter valve and/or walking beam (i.e. continuous-motion) filling technologies with, for example, non-traditional ratios between the number of filling stations and the number of filling nozzles. The methods/apparatus disclosed herein also incorporate means to more efficiently changeover and clean up, in either a clean-in-place (CIP) or clean-out-of-place (COP) configuration, the product contact parts that become "dirty" when used in a production environment. Finally, an improved method and apparatus designed to provide a means for priming and air purging the product contact path of liquid filling machinery, a fill volume calibration procedure, and a fill weight verification cycle is also herein described.

81 Claims, 39 Drawing Sheets

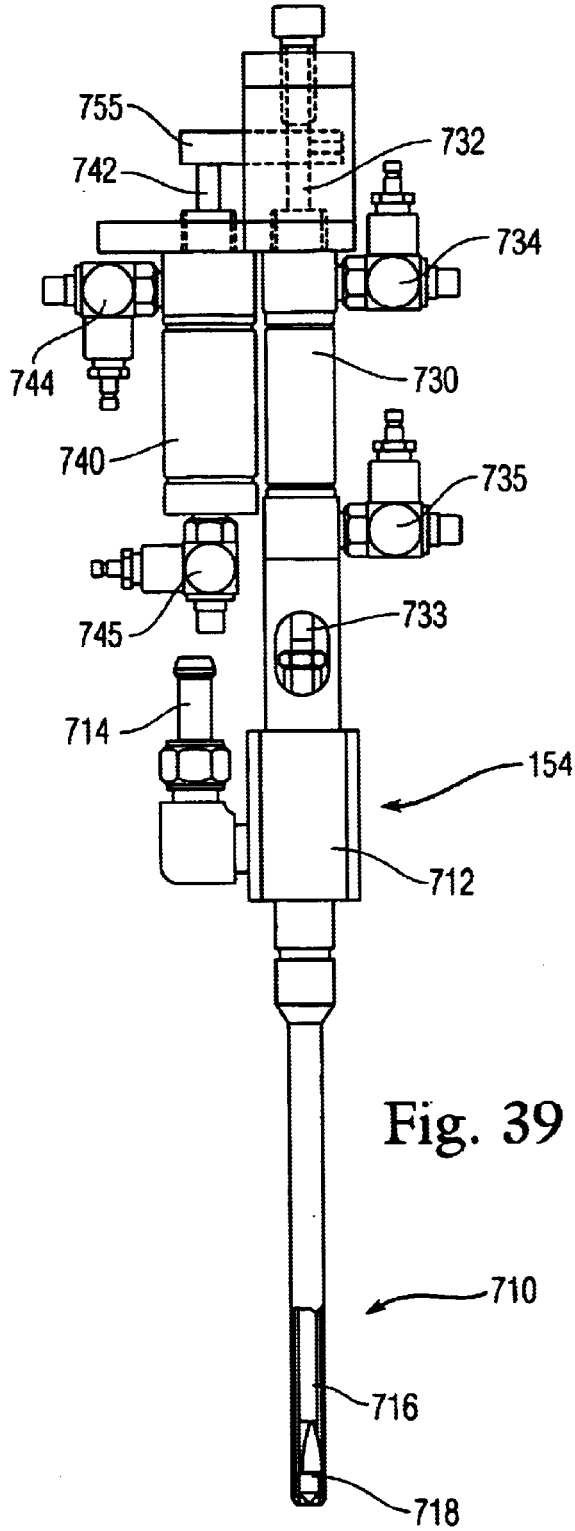
Fig. 39
Fig. 40
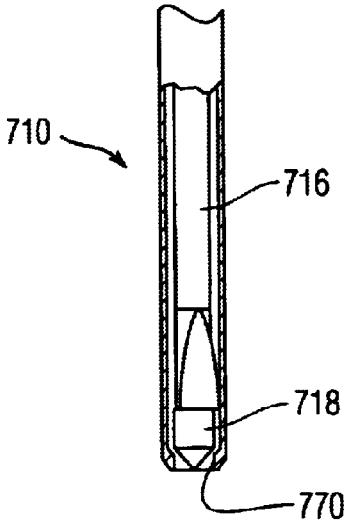

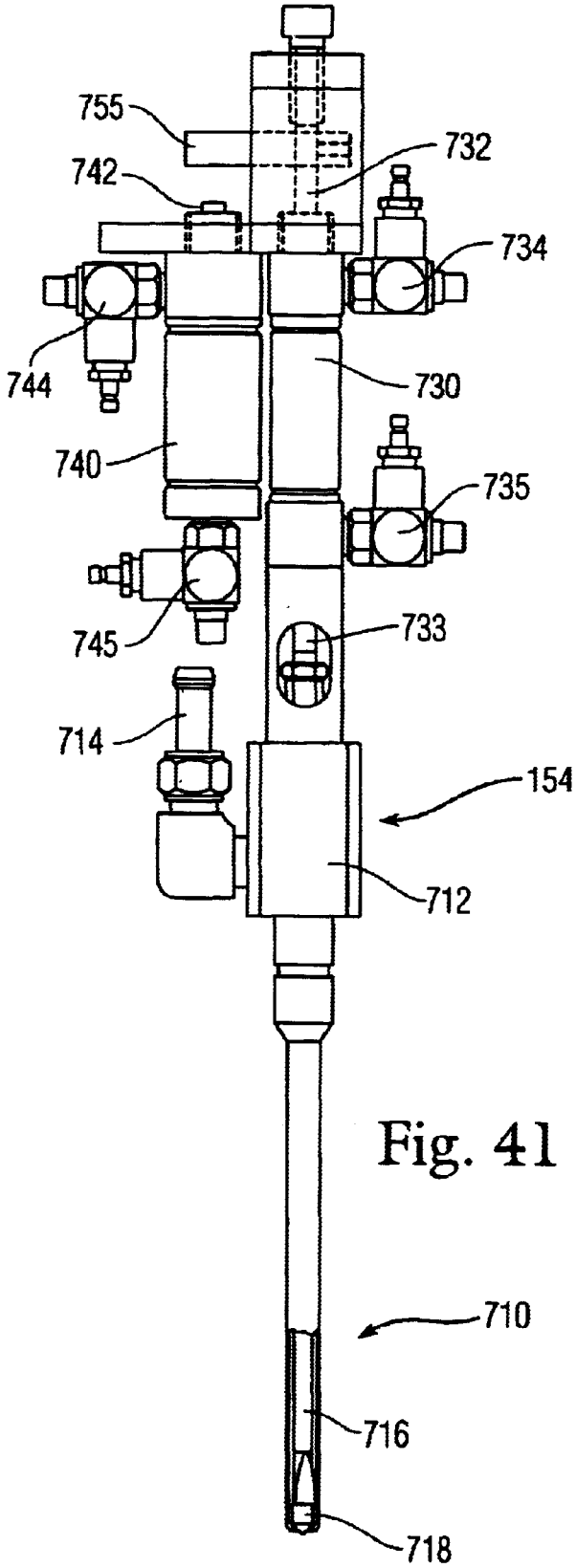
Fig. 41
Fig. 42
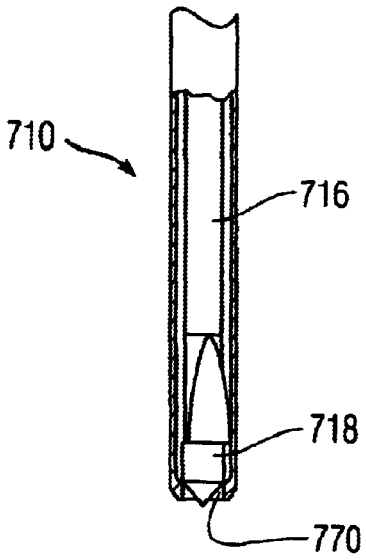

LIQUID FILLING SYSTEM WITH IMPROVED FLUID DISPLACEMENT, NOZZLE AND CONTAINER HANDLING, CLEANING, AND CALIBRATION/SET-UP CAPABILITIES

CROSS-REFERENCE TO RELATED APPLICATIONS

This application derives priority from, and is commonly assigned with, the following provisional applications:

Serial No. 60/245,300, filed Nov. 3, 2000, entitled "Clean-Out-of-Place (COP)" Liquid Filling System, Serial No. 60/267,927, filed Feb. 12, 2001, entitled Liquid Filling System with Diverter Valve, Serial No. 60/268,521, filed Feb. 14, 2001, entitled "Clean-In-Place (CIP)" Liquid Filling System, Serial No. 60/316,528, filed Aug. 31, 2001, entitled Dual-Lane Walking Beam Liquid Filling System, and Serial No. 60/316,536, filed Aug. 31, 2001, entitled System to Automate the Set-up, Calibration, and Fill Weight Verification Functions Performed on a Liquid Filling Machine.

BACKGROUND OF THE INVENTION

1. Field of the Invention

The present invention relates to liquid filling systems and, more particularly, to the overall production rates (i.e. number of filled containers per minute per filling station) achieved by liquid filling systems utilizing either diverter valve technology or continuous-motion (e.g. walking beam) filling processes, and to the clean up (e.g. clean-out-of-place, clean-in-place) and calibration and/or set-up processes associated with their usage in a production environment.

2. Description of the Background

The production capability (e.g. containers per minute, containers per hour) of an automated filling system is a function of several factors. It is directly proportional to (1) the efficiency and number of filling stations that it possesses, (2) the technique used for indexing the containers to and from the filling stations, (3) the manner in which the filling nozzles move during the filling process, and (4) all system "downtime" associated with the clean up and calibration/set-up processes required for normal usage. While the number of filling stations in a given filling system can generally be varied within a certain range, the container indexing technique and the manner of filling nozzle motion are typically fixed aspects of an automated filling system's design possessing little, if any, operational adjustment.

The production capability of a semi-automated filling system is directly proportional to the efficiency and number of filling stations that it possesses, and the skill of the operator responsible for moving the containers to and from those filling stations. The overall production capability of either type of system, automatic or semi-automatic, is compromised by the amount of "downtime" required for cleaning, calibration/set-up, and periodic maintenance.

With respect to factor (1) above, each filling station typically includes a continuous-flow liquid metering device (e.g. rotary gear pump, rotary lobe pump, peristaltic pump, diaphragm pump, double-ended piston pump, flow meter, time/pressure filling head), a flexible intake/discharge tubing, and a filling nozzle. Conventional automated filling systems, equipped with any existing continuous-flow metering devices and possessing a one-to-one relationship between metering devices and filling nozzles, utilize only 45% to 60% of the maximum output volume, or total available dispensing time, of the metering device. Exactly where a filling system rates within the 45%–60% range is dependent upon factors such as (a) the type of indexing mechanism that controls the containers during the filling process; (b) the number of filling stations present, and/or (c) whether or not the nozzles move during the filling process.

Systems employing intermittent-motion indexing mechanisms tend toward the 45% rate of the aforementioned range because they must bring the empty containers to a stop before the filling process begins. Once the filling process is complete, the filled containers are allowed to resume movement in order to clear the filling area for the next set of empty containers. The liquid metering devices sit idle during the entire container indexing process and for part of the time that the nozzles are in motion. In contrast, systems employing continuous-motion indexing mechanisms tend toward the 60% end of the range because the containers are filled as they move through the filling area by a set of nozzles that travel in unison with them. While this is a more efficient process due to the simple fact that the containers are not brought to a stop during the filling cycle, there is still a significant portion of the output volume of the metering device that remains unused (i.e. the metering devices sit idle while the nozzles return to the infeed end of the filling area for the start of the next filling cycle).

It would, therefore, be greatly advantageous to provide automated, production environment liquid filling systems designed to utilize a greater percentage (i.e. approaching, or equal to 100%) of the maximum output volume, or total available dispensing time, of the metering devices.

There are also semi-automated production environment filling systems in which the filling and container handling processes are mutually exclusive steps in the overall machine cycle. The metering device sits idle while an operator removes the containers that have just been filled and replaces them with empty containers. After restarting the filling process, the operator then waits for that step to be completed before repeating the container removal/replacement process. It would, therefore, also be advantageous to provide a semi-automatic production environment liquid filling systems that likewise possess the means to increase production rate efficiencies by allowing the filling and container handling processes to occur simultaneously.

As the number of filling stations increases in either the automated or semi-automated systems described above, additional design goals and challenges arise. For instance, the cost of spare or replacement parts should be kept to a minimum, as should the amount of time required to changeover and/or clean out the system when changing from one liquid product to another. In general, a significant amount of "downtime" is required to clean filling machinery when changing from one product to another (see the detailed discussion of cleaning processes below). Therefore, a filling system providing an increase in overall production rate efficiency (i.e. filled containers per minute per pump) while requiring little or no increase in the amount of clean up/changeover downtime would be most desirable.

With respect to factors (2) and (3) above, systems employing intermittent-motion indexing mechanisms bring the empty containers to a stop before the filling process begins. Once the filling process is complete, the filled containers are allowed to resume movement in order to clear the filling area for the next set of empty containers. In systems employing continuous-motion indexing mechanisms, the containers are filled as they move through the filling area by a set of nozzles that travel in unison with them. It is readily apparent to those with ordinary skill in the art that a continuous-motion filling/indexing process, as compared to intermittent-motion indexing, is more efficient due to the simple fact that the containers are not brought to a stop during the filling process.

With respect to continuous-motion indexing systems, there are generally two techniques employed for moving the nozzles during the filling process. As seen in the prior art, in-line "walking beam" filling system 20 of FIGS. 1A and 1B, empty containers 21 moving in a straight line along a single-lane conveyor 22 (as indicated by directional arrow 24) are filled by a bank of nozzles 23 that travel in unison with them through the filling zone 26. Once the filling process is complete, the bank of nozzles 23 returns (as indicated by directional arrow 25) to the infeed end of the filling zone 26 to align itself with the next set of empty containers 21. In this fashion, every container 21 is filled as it moves through the filling zone 26.

Techniques similar to that described above have been utilized in a variety of in-line continuous-motion filling systems. For example, U.S. Pat. No. 5,971,041 to Drewitz discloses a machine for filling fluid products into containers delivered in a row by a conveyor that has a filling station with a walking nozzle bank (i.e. walking beam mechanism). The nozzle bank includes elongated gripper plates that are moved laterally to engage the containers while the nozzles are inserted therein. Once a batch of containers has been received in the filling station and engaged by the gripper plates, the container batch is allowed to move in the conveying direction together with the nozzle bank as the containers are being filled.

Another example is U.S. Pat. No. 4,004,620 to Rosen which discloses a filling machine for simultaneously filling several containers with a predetermined amount of fluid per container. The containers are indexed by a feed screw that moves the containers into the area of the machine where the nozzles are lowered into the containers to carry out the discharge of the fluid into the containers. The nozzle support structure is actuated to reciprocate in the direction of the movement of the containers while the containers are being filled and opposite this direction after the nozzles are raised to clear the tops of the containers.

Yet another example is U.S. Pat. No. 4,394,876 to Brown which discloses a filling machine for filling containers as they advance along a conveyor. Valved dispenser assemblies are moved in an upright closed loop course above the conveyor. They move in the direction of advance of the conveyor during the lower half of the closed loop course and in the opposite direction during the upper half of the closed loop course. Fluid pressure operated valve actuators are provided for operating the valves on the dispensers between their open and closed positions. A control mechanism is provided to control application of fluid pressure to the valve actuators in timed relation to the movement of the dispenser assemblies in their closed loop course.

The second technique for moving the nozzles during the filling process is shown the "rotary" indexing system 40 of FIG. 2 where the nozzles 41 and corresponding containers (not shown in FIG. 2) travel in a circular path through the filling zone 44 (as indicated by directional arrow 46). While a system 40 of this type is generally recognized as being more complex and costly than an in-line walking beam system, it does possess the ability to achieve higher overall production rates. An empty container is transferred from the conveyor 42 to a position under a nozzle 41 by the infeed turret 43 and is filled as the container/nozzle 41 combination travels through the filling zone 44. The filling process is completed by the time the container reaches the discharge turret 45 where the filled container is removed from beneath the nozzle 41 and returned to the conveyor 42.

Unfortunately, both of the prior art continuous-motion filling processes described above possess certain shortcomings. In-line, walking beam systems utilizing single-lane conveyors possess overall production rate limitations that are practical functions of the physical size of the walking beam assembly and the length/distance of its travel during the filling process. The maximum length/distance of travel is equal to approximately two-thirds of the length of the walking beam assembly's nozzle mounting bracket, or in other words, the length of the set of containers that are to be filled during each filling cycle. This limitation is imposed by the need for the bank of nozzles to return to the infeed end of the filling zone in order to begin filling the next set of empty containers, and results in maximum overall production rate capabilities that fall far short of those possible with rotary filling systems.

On the other hand, rotary systems are generally more complex in design and construction than in-line walking beam systems. For example, the filling stations (i.e. metering devices such as lobe pumps or flow meters, any associated metering device drive mechanisms, filling nozzles, rigid or flexible intake/discharge tubing, product feed components such as a tank or manifold) must rotate in conjunction with the movement of the containers. Conversely, in a walking beam system, only the nozzles and discharge tubing travel with the containers, the other filling station components typically remain stationary. In addition, the changeover process between production runs associated with a rotary system is more time consuming and costly in terms of both actual and opportunity costs.

It would, therefore, be greatly advantageous to provide automated liquid filling systems possessing production rate capabilities approaching, or equal to, those of "rotary" filling systems while retaining the relative simplicity of design and changeover inherent in in-line "walking beam" systems equipped with single-lane conveyors.

With respect to factor (4) above, the filling of liquids in a production environment involves a significant amount of "downtime" for the cleaning of the machinery (product contact parts) when changing from one product (or batch) to another. The cleaning process, while known to be of a time consuming nature, is acknowledged as a "necessary evil" in order to avoid potentially hazardous problems with cross-contamination between products/batches. There are three methods typically employed to complete a cleaning cycle for the product contact parts.

The first is a process that subjects the product contact parts to a cleaning cycle without removing them from the production environment (known as "clean-in-place" or CIP). This process typically utilizes a separate cleaning system that is the combination of cleaning fluid reservoirs, a fluid circulating pump, and a sophisticated control scheme. The primary detriment associated with the use of a CIP process is the "opportunity cost" associated with not being able to operate the filling system in its production mode while the product contact parts are being subjected to the cleaning cycle.

The second cleaning method requires the removal of the product contact parts from the production environment. The most efficient utilization of this method requires a second complete set of "clean" product contact parts (for use in the production environment while the first set is cleaned) and one or more individuals to manually disassemble, clean, and reassemble the "dirty" set of product contact parts. The disassembly/cleaning/re-assembly process is labor intensive and subjects the individuals involved to potentially hazardous products, cleaning fluids, or the combinations thereof.

The third method utilizes two, separate and complete filling systems positioned in series in the production environment. While one system is subjected to the cleaning cycle, the second is used for a production run. However, there are very few situations where the combination of cost and floor space required by two, separate and complete filling systems makes for a profitable production environment.

In today's business environment of minimal inventories and "just in time" manufacturing, it is simply not economically feasible to dedicate an entire liquid filling system to a single product. It would, therefore, be greatly advantageous to supply a cost effective and space efficient liquid filling system possessing the ability to be rapidly changed over from one product (or batch) to another while still providing the opportunity to thoroughly clean all of the product contact parts in order to avoid cross-contamination issues. Furthermore, the system should not require a time-consuming disassembly/cleaning/re-assembly process for any of the product contact parts nor cause employees to be exposed to hazardous materials.

Again with respect to factor (4) above, the calibration and/or set-up of the metering devices (i.e. pumps) in a production environment liquid filling system can also be a time consuming, labor intensive process. However, it is acknowledged to be another "necessary evil" in order to maximize the effectiveness (i.e. fill accuracy, average production rate) of the subsequent production run. A number of steps are typically included in the calibration/set-up process for a liquid filling system.

The first step is the priming of the metering devices. The intake line leading from the product supply vessel to each metering device, the metering device itself, and the discharge line running from each metering device to each dispensing nozzle must be filled with the product. To maximize the fill accuracy of the liquid filling system, the priming process must also purge all air from the metering devices, nozzles, and intake/discharge lines. This is typically accomplished by moving the dispensing nozzles from their normal operating position over the container handling/indexing system to a position that places them above a product collection receptacle. The moving of the nozzles in this manner is a manual process. The amount of time required to reposition the nozzles is directly proportional to the number included in the liquid filling system.

Once the nozzles are in position above the collection receptacle, the metering devices are actuated by the operator in order to draw the product from the supply vessel into the intake lines and, after passing through the metering devices, out through the discharge lines. This is typically done using a cycle rate that is effective in purging any entrapped air. Metering devices that are not self-priming in this manner require either a positive pressure product supply vessel or a gravity-assisted product feed from an elevated supply tank. The product used for the priming process (i.e. present in the collection receptacle at the end of the process) may, or may not, depending on the nature of the product and/or the regulations under which it is manufactured, be reclaimed and recycled back into the main product supply tank.

After the priming process is complete, each metering device must be calibrated to dispense the proper amount of product during each filling cycle. This is generally accomplished in one of two ways. The first method requires each metering device to be completely calibrated (i.e. gross and fine adjustments) individually in a sequential manner. The second involves the process of making a global (i.e. all metering devices simultaneously) gross fill volume adjustment before fine tuning each metering device individually in a sequential manner. The choice between the two methods typically hinges on the total number of metering devices included in the liquid filling system. As the number of metering devices increases, the efficiency and effectiveness of the second method also increases.

Both methods require an operator to enter into the control system a gross adjustment set point corresponding to the desired fill volume. This is typically a number calculated to estimate the number of metering device cycles/revolutions required to displace the desired amount of liquid (e.g. desired fill volume divided by volume per metering device cycle or revolution). The first method requires that set point to be entered for each of the metering devices; the second allows a single entry to be forwarded to all of the metering devices.

Once the gross adjustment set points have been established, each metering device typically must be individually fine tuned (i.e. it is rare that the gross adjustment provides the desired fill volume within the required degree of accuracy). The fine tuning process generally involves actuating a metering device dispense cycle, collecting the product dispensed in a tare-weighed container, and weighing the filled container to obtain the net weight of the product included therein. If the net weight of the dispensed product is not within the required degree of accuracy, a minor upward or downward manual adjustment of the set point is entered into the control system before repeating the process. This process is repeated until the product dispensed by the metering device falls within the required degree of fill volume accuracy.

In order to ensure that a production run remains within specifications (e.g. fill volume accuracy), periodic fill weight verification is generally performed. This process is typically accomplished manually by (1) introducing a number of tare-weighed containers (i.e. equal to the number of metering devices/dispensing nozzles) into the stream of empty containers entering the liquid filling system, collecting the containers after they have been filled, and calculating the net weight of the product therein, or (2), in a sequential manner involving all of the metering devices, catching the product dispensed by each of them in a tare-weighed receptacle in order to determine the net weight of the filling cycle output. If any of the metering devices are found to be dispensing too much, or too little, the operation of the liquid filling system is typically suspended temporarily to allow an operator to restore a proper fill volume set point using a process similar to the fine tuning procedure discussed above.

In any of the manual processes discussed above, the possibility of operator error exists. Examples of potential operator error include (1) the failure to properly position a nozzle over the collection receptacle during the priming/air purging process, (2) the entering of an incorrect gross adjustment set point at the start of the filling cycle calibration process, (3) making an incorrect association between a net fill weight and the fill station that generated it (and subsequent fine tuning adjustment of the wrong fill station) during either the filling cycle calibration or the fill weight verification process, and (4) the misreading or miscalculation of otherwise correct fill weights leading to unnecessary fine tuning adjustments during either the filling cycle calibration or the fill weight verification process.

In addition to the actual costs, outlined above in terms of manual labor and product waste (e.g. inaccurate fills resulting from air in the intake or discharge lines, the iterative process used to establish proper fill volumes, operator error), the calibration/set-up process also carries the "opportunity cost" associated with not being able to operate the liquid filling system in its production mode while the calibration/set-up process is ongoing. Obviously, the more time required to complete a manual calibration/set-up process, the greater the associated opportunity cost. It would, therefore, be greatly advantageous to supply a cost effective, time efficient, automated means to calibrate/set-up the metering devices in a production environment liquid filling system.

SUMMARY OF THE INVENTION

It is, therefore, the primary object of the present invention to provide automated filling systems that achieve a significant increase in overall production capability without a corresponding increase in system complexity and/or changeover time/costs.

It is another object of the present invention to provide automated and semi-automated filling systems that utilize a significantly greater percentage of the dispensing time (or maximum output volume) available from continuous-flow metering devices.

It is still another object to provide filling systems that allow for the automated filling of containers, in an alternating fashion, via multiple sets of filling nozzles supplied by a single set of metering devices and appropriate container indexing systems.

It is a further object to provide filling systems that possess an improved method and apparatus for the automated filling of containers carried on a dual-lane conveyor assembly.

It is yet another object of the present invention to provide automated filling systems that fill containers utilizing an in-line, dual-lane walking beam, continuous-motion technique.

It is still another object of the present invention to provide filling systems that allow for the semi-automated filling of containers, in a sequential or alternating fashion, via multiple sets of filling nozzles supplied by a single set of metering devices.

Still another object of the present invention is to provide automated and semi-automated filling systems that possess improved overall production rate efficiencies with little or no increase in the amount of clean up/changeover downtime.

It is another object of the present invention to provide an improved method and apparatus for an automated filling system that allows rapid change-over between, or conversion for use with a variety of liquids (i.e. those having a wide range of characteristics such as viscosity, tendency to foam, and chemical compatibility).

It is still another object to provide an improved method and apparatus for handling and cleaning all of the product contact parts (e.g. elimination of time-consuming disassembly/cleaning/re-assembly cycles, avoidance of employee exposure to hazardous materials, avoidance of problems related to cross-contamination between liquids).

It is another object of the present invention to supply an improved method and apparatus for a calibration/set-up system that provides for the rapid calibration and set-up, between production runs, of an automated liquid filling system's plurality of metering devices.

It is a further object of the present invention to provide an improved metering device calibration/set-up system that minimizes the time required to prepare a liquid filling system for an automated production run.

It is yet another object of the present invention to provide an improved metering device calibration/set-up system that minimizes the amount of product lost in preparing a liquid filling system for an automated production run.

It is still another object of the present invention to provide an improved metering device calibration/set-up system that completely purges the air present in a plurality of metering devices, dispensing nozzles, and intake/discharge lines in order to minimize product losses due to air-induced fill volume inaccuracies.

It is another object of the present invention to provide an improved metering device calibration/set-up system that automatically sets the output per fill cycle of a plurality of metering devices.

It is a further object of the present invention to provide an improved metering device calibration/set-up system that checks the output per fill cycle of a plurality of metering devices at user-defined intervals.

It is yet another object of the present invention to provide an improved metering device calibration/set-up system that automatically corrects the output per fill cycle of one or more metering devices when an out-of-specification situation is detected.

It is still another object of the present invention to provide an improved metering device calibration/set-up system that improves overall system safety by allowing the calibration/set-up process to be completed without operator intervention or the need to bypass the guard assembly.

It is a further object of the present invention to provide an improved metering device calibration/set-up system that minimizes, if not eliminates, the potential for operator error during the calibration/set-up process for a liquid filling system.

It is another object of the present invention to provide an improved filling nozzle configuration for greater control and accuracy.

In accordance with the above objects, one embodiment of an improved process and apparatus is a diverter valve-based automated liquid filling system. This modular filling system consists of four primary subsystems. The container handling subsystem primarily consists of a combination single-lane/dual-lane conveyor assembly, two container/nozzle alignment devices, and multiple container indexing mechanisms. The nozzle support subsystem includes the dual-lane nozzle motion/mounting assembly (i.e. two, individual nozzle motion/mounting assemblies), typically equipped with bottom up nozzle motion capability. The product contact subsystem includes a number of liquid metering devices and, where appropriate, liquid metering device drive stations, an equal number of diverter valve assemblies, a number of filling nozzles equal to two or more times the number of liquid metering devices/diverter valves, a product tank/manifold assembly, and intake/discharge tubing. The controls/utilities subsystem contains all of the electrical and pneumatic components required for the overall operation of the filling system. The operation of this system in a production environment is discussed in the "Detailed Description of the Preferred Embodiments" section below.

The present invention may utilize any of the continuous-flow liquid metering devices mentioned above, and any valve of a design suitable for diverting the flow from a single metering device to one of two or more filling nozzles connected to it. An intermittent-motion filling system according to the present invention allows the metering device to operate at up to 100% of its maximum output volume, or total available dispensing time.

A variety of alternative embodiments for automated filling systems according to the present invention exist. One alternative embodiment utilizes two bottom up nozzle motion/mounting assemblies in the nozzle support subsystem, but requires only a single-lane conveyor assembly. A system according to this alternative embodiment can incorporate any number of metering devices and filling nozzles to obtain the production rate required by the end user. The operation of this alternative embodiment in a production environment is also discussed in the "Detailed Description of the Preferred Embodiments" section below.

Yet another alternative embodiment is a diverter valve-based semi-automated liquid filling system. This modular filling system consists of four primary subsystems. The container handling subsystem provides the operator with the means to position, quickly and consistently, the empty containers under the filling nozzles. The nozzle support subsystem includes the nozzle motion/mounting assembly, typically equipped with bottom up nozzle motion capability. The product contact subsystem includes a number of liquid metering devices and, where appropriate, metering device drive assemblies, an equal number of diverter valve assemblies, and a number of filling nozzles equal to twice the number of liquid metering devices/diverter valve assemblies. The controls/utilities subsystem contains all of the electrical and pneumatic components required for the overall operation of the semi-automatic filling system. This alternative embodiment may utilize any of the continuous-flow liquid metering devices mentioned above and any valve of a design suitable for diverting the flow from a single metering device to one of two or more filling nozzles connected to it.

It is noteworthy that the basic diverter valve configuration discussed above may be achieved in an alternative manner. To split the output flow of a single metering device into two or more, independent flows feeding an equal number of filling nozzles, one or more, Y- or T-shaped connectors could be utilized. The product flow through each nozzle (and into a waiting container) would then be controlled by a two-way valve assembly located just prior to, or as an integral part of, the nozzle assembly.

Another alternative embodiment of the present invention utilizes a dual-lane walking beam nozzle motion/mounting assembly and a dual-lane conveyor. The walking beam assembly replaces the bottom up nozzle motion/mounting assemblies in the nozzle support subsystem. When compared with an in-line walking beam/single-lane conveyor filling system (as in FIGS. 1A and 1B) possessing an equal number of filling stations, the incorporation of a dual-lane conveyor in the filling zone allows the length of the walking beam assembly's nozzle mounting bracket and the length/distance of its travel during the filling process to be reduced. The reduction in the length/distance of travel, and, therefore, the time required to complete the movement, of the bank of nozzles in returning to the infeed end of the filling zone results in a reduction in the total filling cycle time. A reduction in total filling cycle time means that, over any given time period, more filling cycles are completed and, therefore, the overall production output of the filling system is increased.

In addition to the moderate increase in production capability outlined in the preceding paragraph, continuous-motion filling in a dual-lane conveyor configuration allows the total number of containers that are filled during each filling cycle to be increased by a factor of two before the practical limitation on walking beam assembly size is reached. This novel element of the present invention represents a second, more substantial increase in the overall production capabilities of automated filling systems possessing walking beam assemblies. This alternative embodiment also consists of four primary subsystems. The container handling subsystem primarily consists of a dual-lane conveyor assembly and a continuous-motion container indexing mechanism. The nozzle support subsystem includes the dual-lane, walking beam nozzle motion/mounting assembly, typically equipped with bottom up nozzle motion capability. The product contact and controls/utilities subsystems are equipped in a manner identical to that of the first embodiment discussed above. Again, systems according to this alternative embodiment may incorporate any number of metering devices and filling nozzles to obtain the production rate required by the end user. The operation of the dual-lane walking beam alternative embodiment in a production environment is also discussed in the "Detailed Description of the Preferred Embodiments" section below.

The present invention may utilize one of three possible embodiments for the cleaning of the product contact parts. Two embodiments represent clean-out-of-place (COP) configurations while the third is a clean-in-place (CIP) configuration. The cleaning process represents a fifth subsystem, the remote or CIP cleaning subsystem, of the overall liquid filling system. The remote cleaning subsystem of COP configuration #1 includes the cleaning fluid circulating pump/reservoir and, where appropriate, a secondary multi-station metering device drive assembly to cycle the product contact parts during the cleaning process. The remote cleaning subsystem of COP configuration #1 includes the cleaning fluid circulating pump/reservoir and, where appropriate, a secondary multi-station metering device drive assembly to cycle the product contact parts during the cleaning process. The remote cleaning subsystem of COP configuration #2 includes only the cleaning fluid circulating pump/reservoir. It utilizes, where appropriate, the same multi-station metering device drive assembly to cycle the product contact parts in the production environment and during the cleaning process. Each COP filling system configuration utilizes a "dockable", multiple frame concept to achieve the goal of fast changeover from one liquid product to another. Essentially, each set of product contact parts (e.g. metering devices, nozzles, intake/discharge tubing) is attached to a separate, portable (i.e. caster-mounted) frame that may be docked to either a container handling subsystem located in the production area or to a remote cleaning subsystem located in some other area of the facility. These two filling system/cleaning configurations are discussed in greater detail below. The utilization of the CIP system requires the overall liquid filling system to be supplied with two complete sets of product contact parts (i.e. metering devices, a product tank/manifold assembly, nozzles, intake and discharge tubing). Two complete sets are required so that while one is being used to complete the current production run, the other can be cleaned and prepared for use in the next production run. This alternating use of two sets of product contact parts provides for rapid changeover from one product to another, while the cleaning method/system discussed below avoids the issues of time-consuming disassembly/cleaning/re-assembly cycles, employee exposure to hazardous materials, and cross-contamination between liquids. The CIP cleaning subsystem consists primarily of the cleaning fluid circulating pump and associated reservoir and will be discussed in greater detail below.

The present invention may utilize one of nine possible embodiments (see the Detailed Description of the Preferred Embodiments section below) for the automation of the calibration/set-up process associated with a liquid filling system. The automated calibration/set-up process provides (1) a means for priming and air purging the product contact path (i.e. metering devices, dispensing nozzles, intake/discharge lines) of a liquid filling system, (2) a fill volume calibration procedure, and (3) a fill weight verification cycle. This process requires the addition of a sixth subsystem, the product collection receptacle/load cell subsystem, to the overall liquid filling system. This sixth subsystem consists primarily of a load cell-mounted receptacle that may or may not be connected to a secondary product holding tank. The priming/air purging process entails the automated positioning of the filling nozzles over a product collection receptacle by the nozzle support subsystem and the cycling of the metering device/multi-station drive subsystem at an appropriate operating speed to draw product from the main supply tank through the intake lines before pushing it out through the discharge lines and nozzles. The fill volume calibration process involves automatically adjusting the output of each metering device on a one-by-one basis and fine tuning the output until the amount dispensed by the metering device falls within the specified tolerance range. The fill weight verification cycle checks, and adjusts if necessary, the amount of product that is being dispensed during each filling cycle.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 39 is a side perspective view of an exemplary nozzle 154, as in FIG. 37, shown in the partially open condition and including a cut-away view of the nozzle tip 710.

FIG. 40 is a close-up, cut-away view of the nozzle tip 710, shown in the partially open position, of the nozzle 154 as in FIG. 39.

FIG. 41 is a side perspective view of an exemplary nozzle 154, as in FIGS. 37 and 39, shown in the closed condition and including a cut-away view of the nozzle tip 710.

FIG. 42 is a close-up, cut-away view of the nozzle tip 710, shown in the closed position, of the nozzle 154 as in FIG. 41.

DETAILED DESCRIPTION OF THE PREFERRED EMBODIMENTS

Figure 1A:
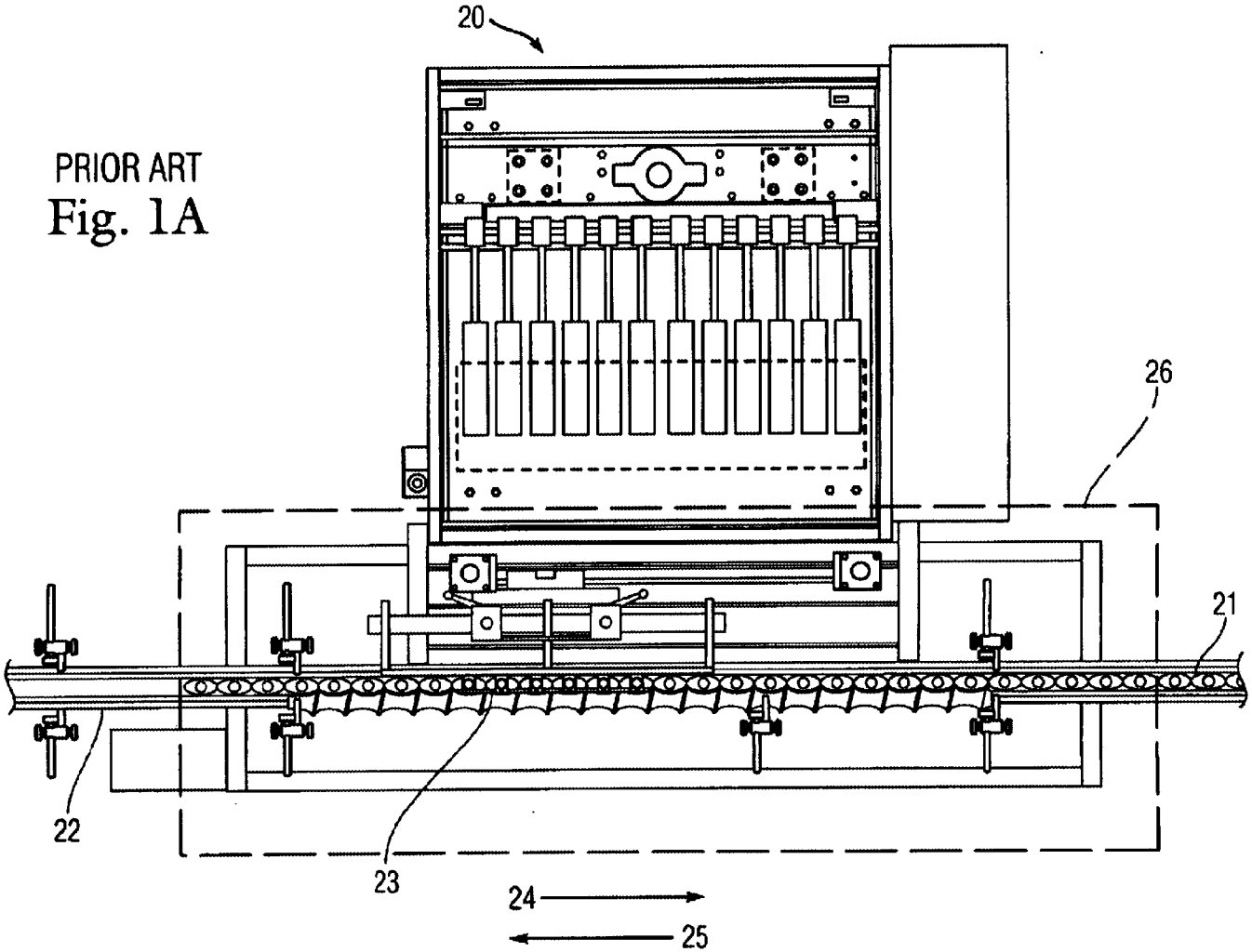
PRIOR ART Fig. 1A
FIG. 1A is a top perspective view of a prior art, in-line "walking beam" filling system 20.
Figure 1B:
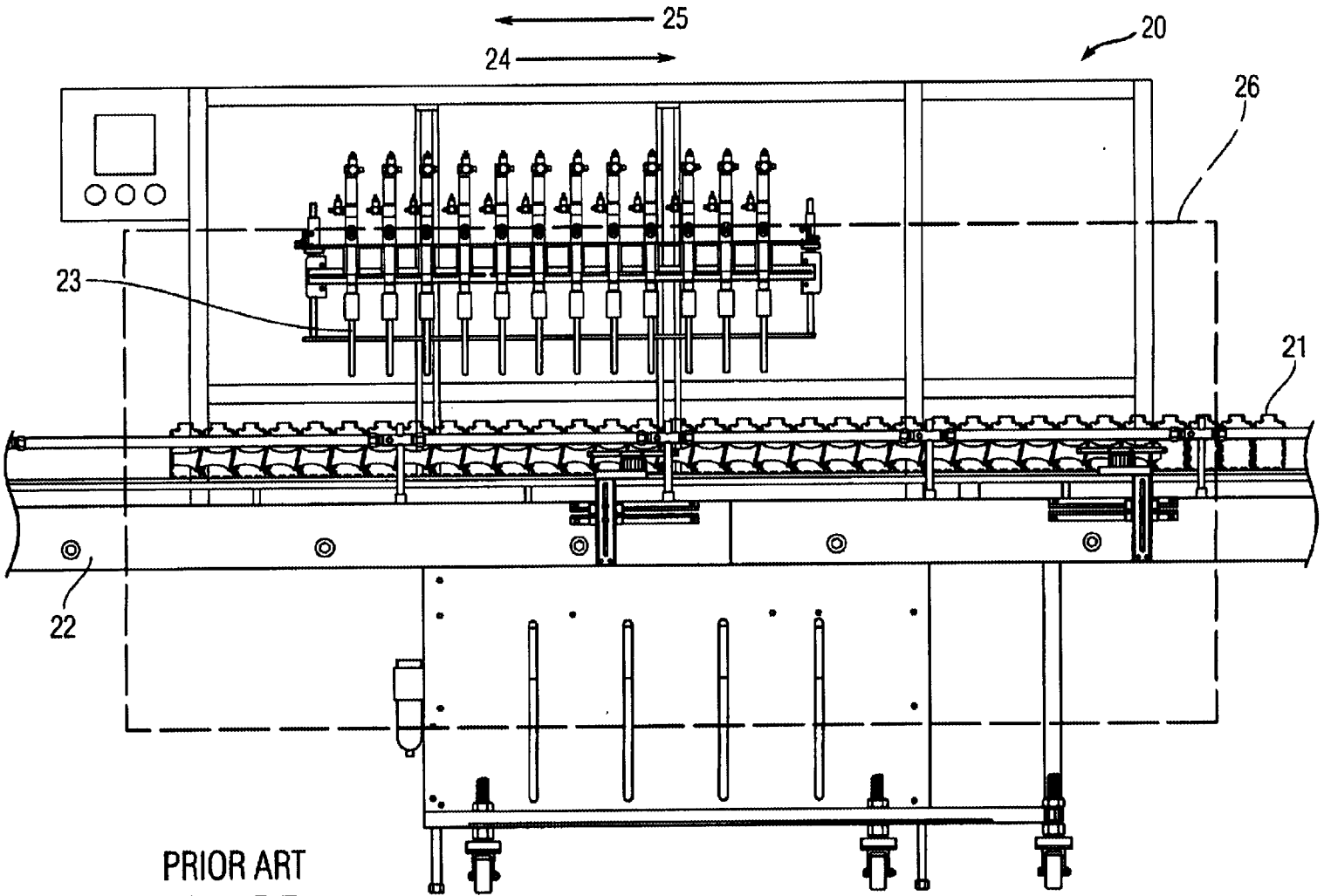
PRIOR ART Fig. 1B
FIG. 1B is a front perspective view of a prior art, in-line "walking beam" filling system 20.
Figure 2:
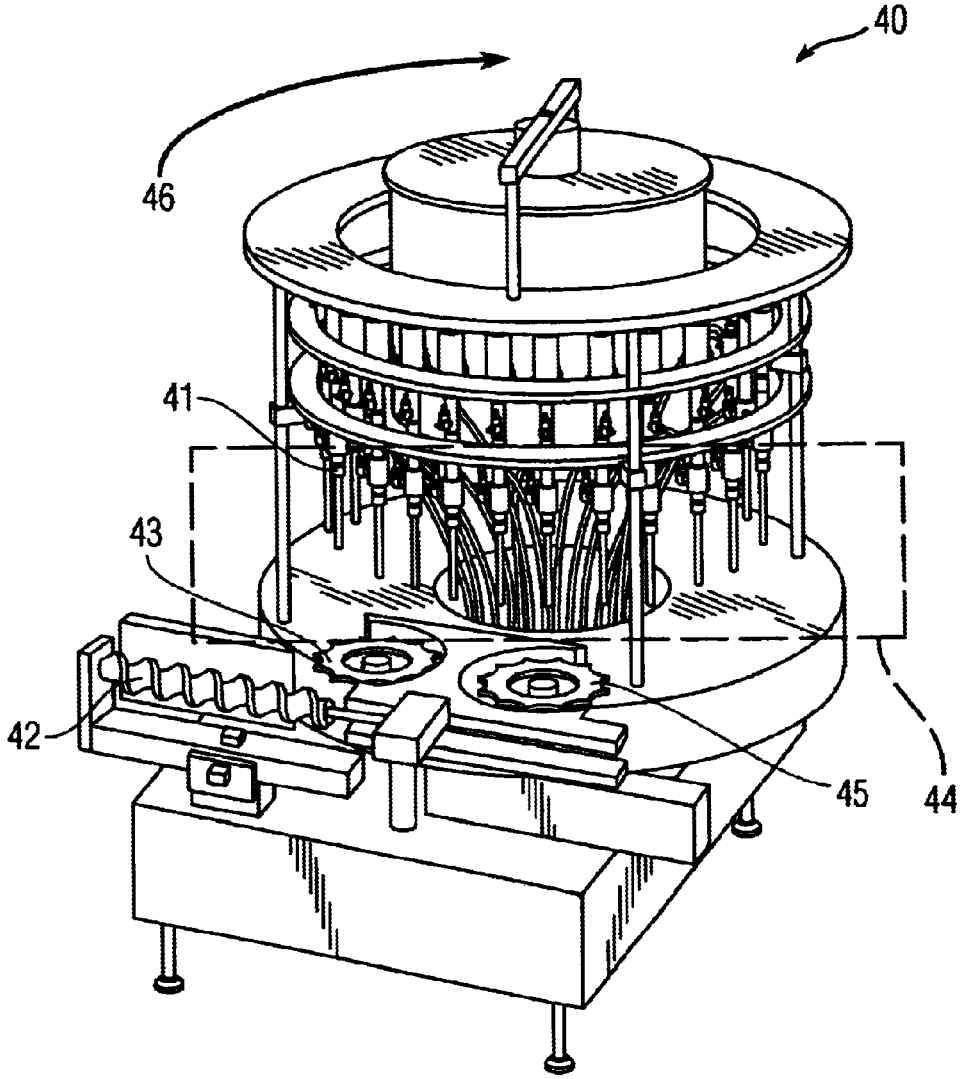
Fig. 2 PRIOR ART
FIG. 2 is a perspective view of a prior art, "rotary" filling system 40.
Figure 3:
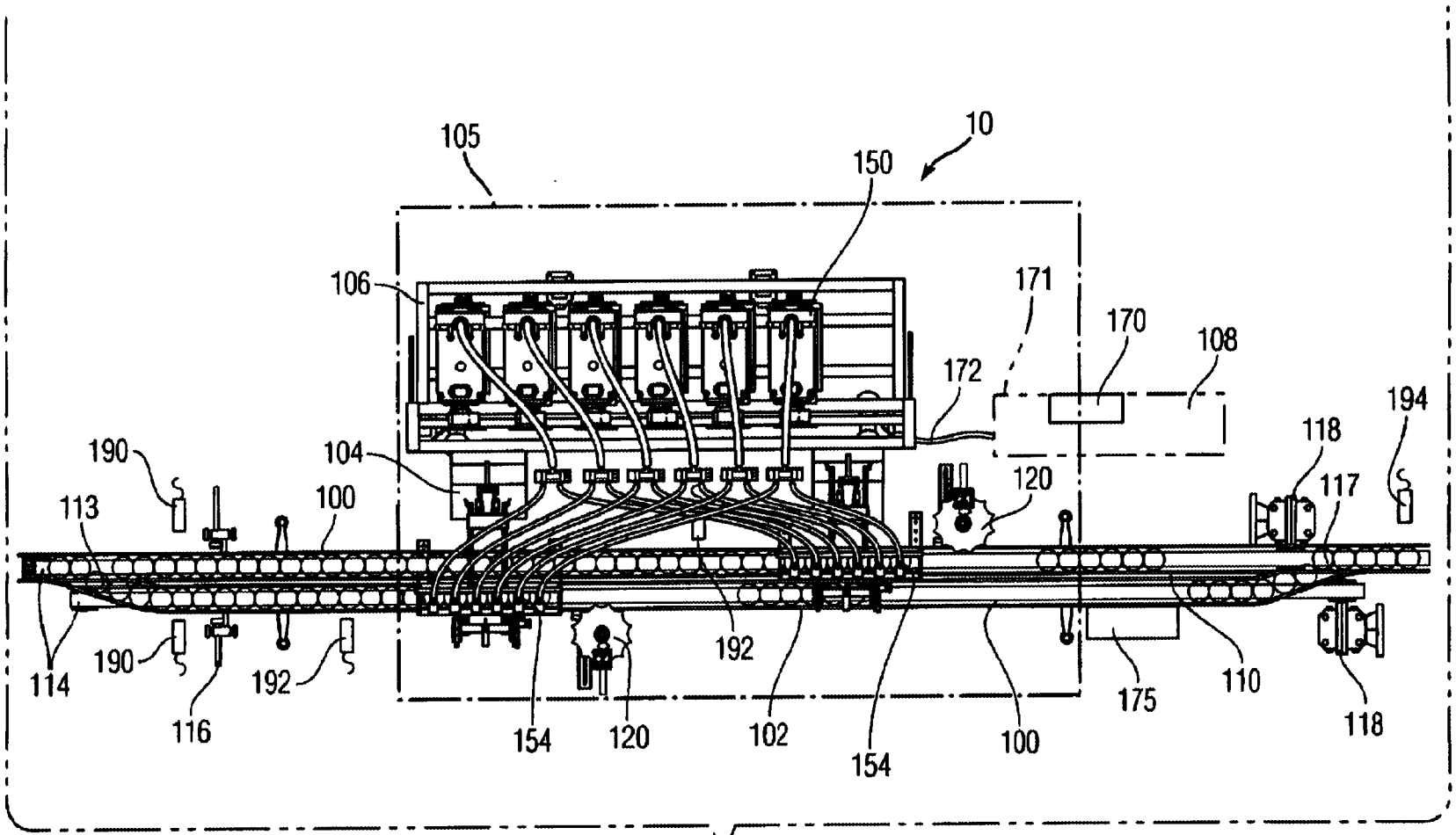
FIG. 3 shows a top perspective view of the overall diverter valve-based automated liquid filling system 10, including a container handling subsystem 102, a nozzle support subsystem 104, a product contact subsystem 106, and a controls/utilities subsystem 108, according to a first embodiment of the present invention.

FIG. 3 shows a top perspective view of a liquid filling system 10 according to a first embodiment of the present invention, including a container handling subsystem 102, a nozzle support subsystem 104, a product contact subsystem 106, and a controls/utilities subsystem 108.

The container handling subsystem 102 carries the containers 100 to and from the filling area and, while they are in the filling area, positions them for the entry of the filling nozzles 154.

The nozzle support subsystem 104 articulates the nozzles 154, moving them up and down (or, into and out of the containers 100) during the filling process. In addition, as will be described, nozzle support subsystem 104 may employ an intermittent-motion filling process by which the nozzles 154 are moved back and forth from container-to-container, or a continuous motion process by which nozzles 154 track the moving containers along the filling area.

The product contact subsystem 106 contains the elements of the filling system 10 required to supply (holding tank 152), measure (metering devices 150), and dispense (nozzles 154) the liquid product.

The controls/utilities subsystem 108 includes the electrical and pneumatic components (e.g. programmable logic control device 170, solenoid valves, motor starters) required to control the overall operation of the filling system 10.

Figure 4:
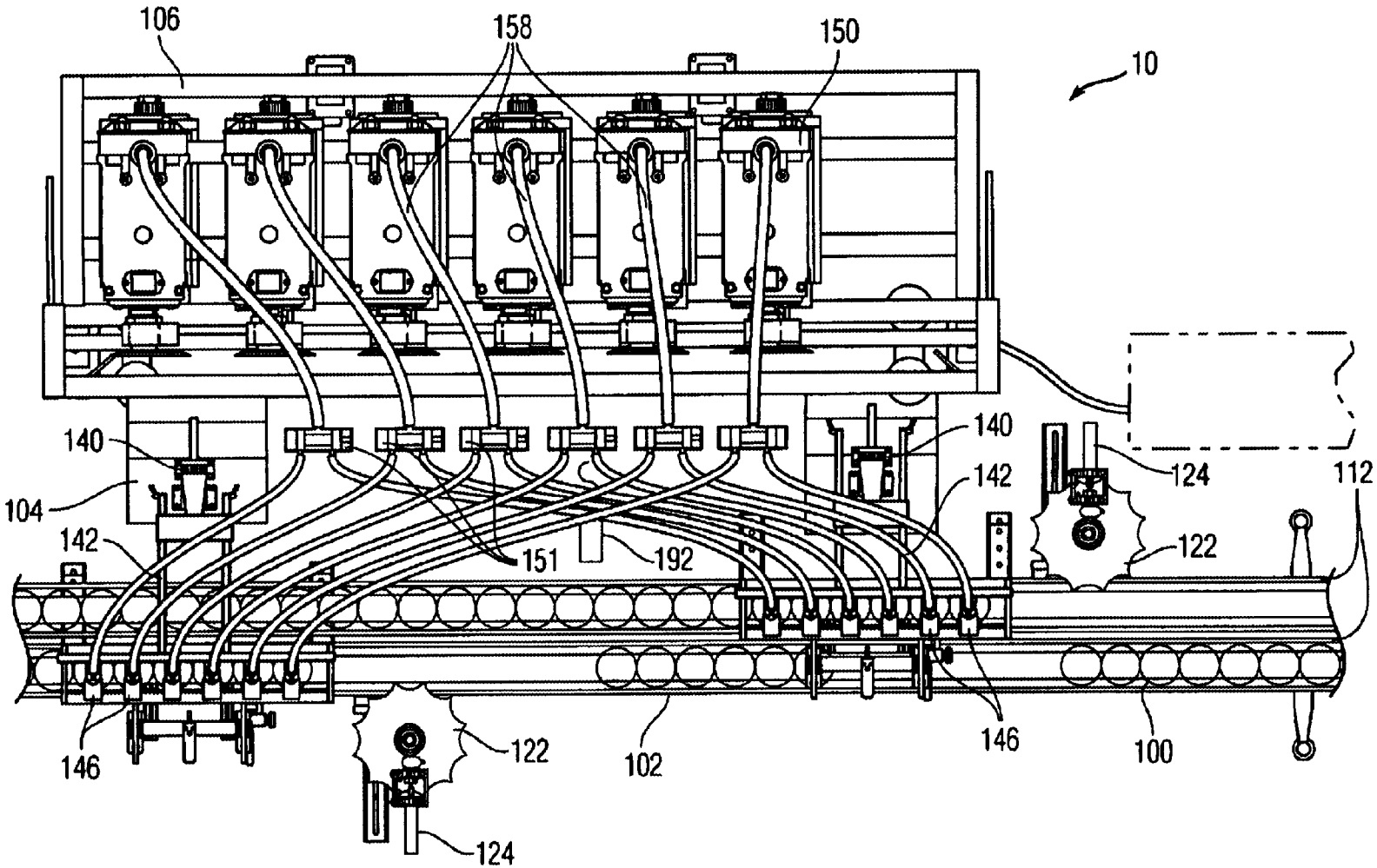
FIG. 4 shows a top, close up view of the filling area of the diverter valve-based automated liquid filling system 10 as in FIG. 3.
Figure 5:
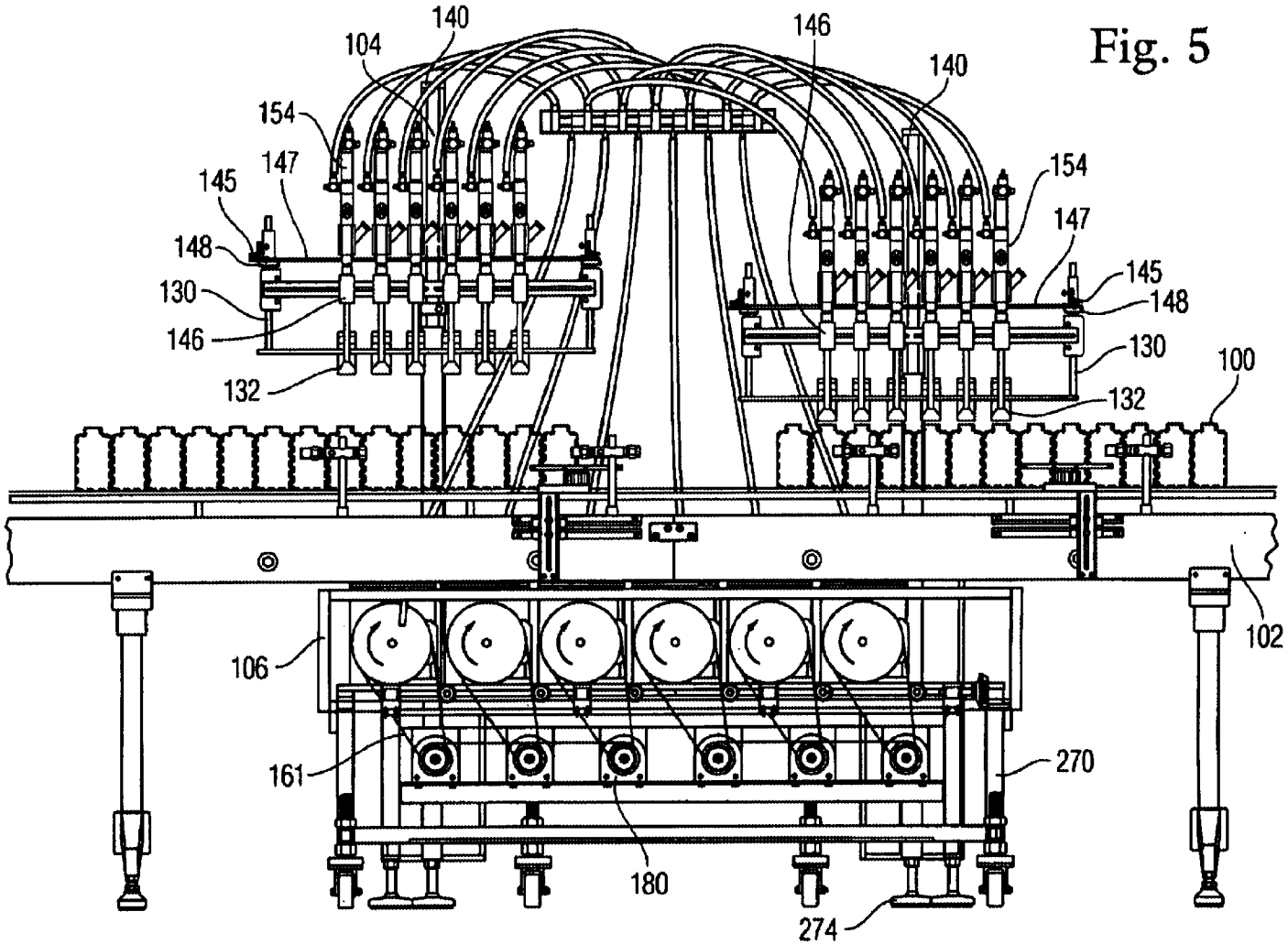
FIG. 5 shows a front elevation view of the diverter valve-based automated liquid filling system 10 as in FIGS. 3 and 4.
Figure 6:
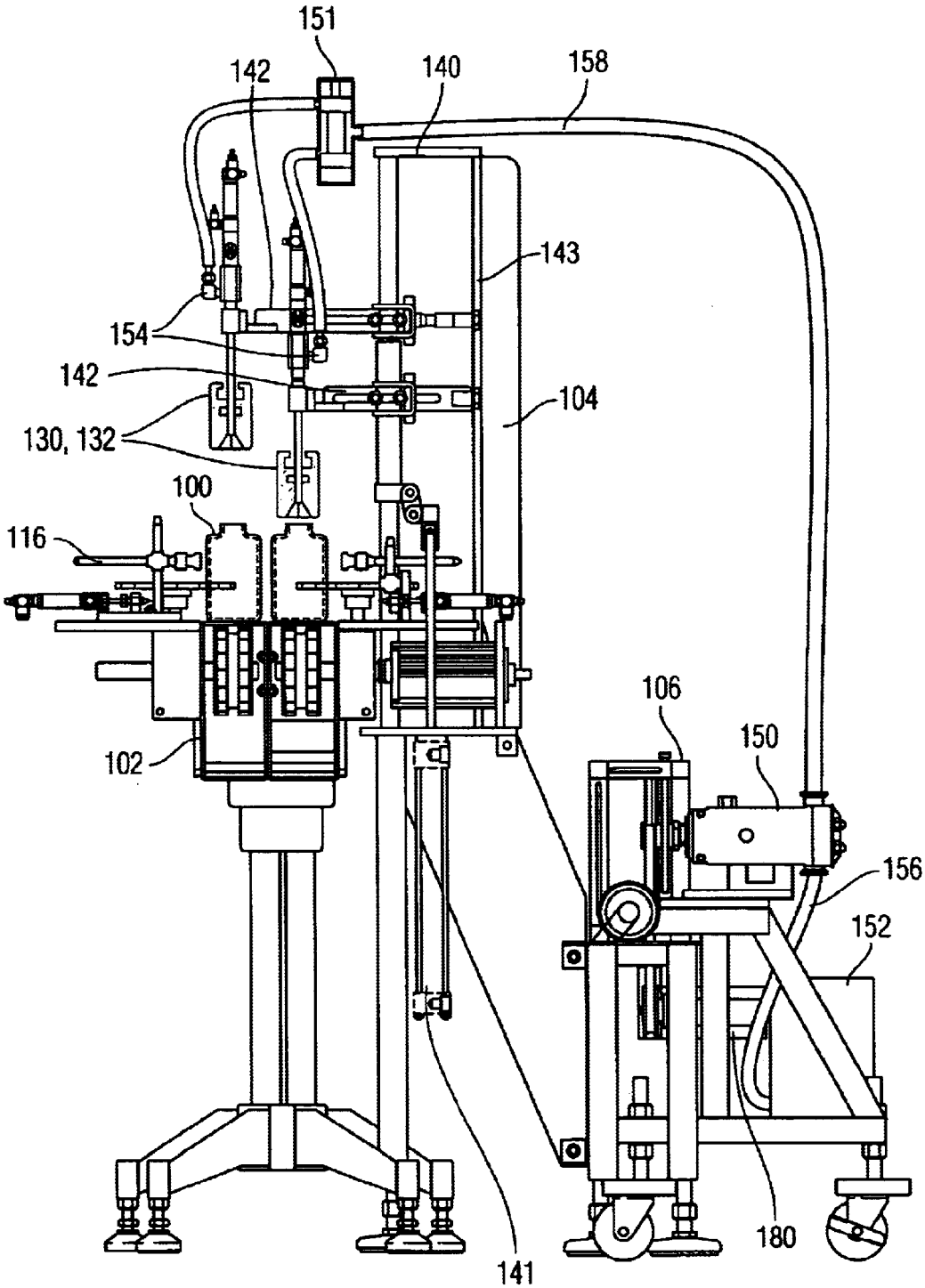
FIG. 6 shows a side elevation view of the diverter valve-based automated liquid filling system 10 as in FIGS. 3–5.

FIGS. 4–6 show, respectively, close up top, front, and side perspective views of the filling area 105 (see FIG. 3) of the liquid filling system 10, including part of the container handling subsystem 102, the entire nozzle support subsystem 104, and the entire product contact subsystem 106.

With collective reference to all of FIGS. 3–6, the illustrated embodiment employs a dual-lane conveyor assembly 110 to transport the containers 100 through an intermittent filling process. The conveyor assembly's length and width are variable to suit the needs of the application. The conveyor assembly 110 preferably includes dual stainless steel conveyor beds 112 that extend the length of the system, a lane dividing mechanism 113 at the start of the conveyor beds 112 that alternately diverts containers 100 onto one of the two conveyor beds 112, a low friction conveyor chain 114, laterally-adjustable container guide rails 116, a lane combining assembly 117, and variable speed, DC motor drives 118, all of which are readily available commercial conveyor parts. The lane dividing mechanism 113, typically a pneumatically-operated, pivoting gate assembly, directs a single lane of incoming containers 100 into one of two lanes for passage through the filling area's nozzle mounting bracket assemblies 142. The lane combining assembly 117 at the termination of the conveyor beds 112 may be a set of commercially available, angled guide rails that takes the containers 100 leaving the filling area in two lanes and combines them into one lane before they exit the filling system.

Container indexing through the filling process is preferably accomplished using starwheel indexing mechanisms 120. Each indexing mechanism 120 incorporates a freely rotating starwheel 122, located at the discharge end of the filling area, and a starwheel stop mechanism 124. The stop mechanism 124 may be implemented with a small air cylinder that acts to control the rotation of the star wheel 122 in order to allow a predetermined number of containers 100 to exit the filling area after each filling cycle. In the extended position (while the containers 100 are being filled), the stop mechanism 124 prevents the rotation of the starwheel 122. When retracted, the starwheel 122 is free to rotate.

Alternative and equally suitable intermittent-motion container indexing methods include feed screw indexing mechanisms and finger indexing mechanisms. An intermittent-motion feed screw indexing mechanism spans the entire filling area and utilizes the rotation of a multi-pocketed feed screw, with one container 100 positioned in each pocket, to release a predetermined number of containers 100 at the end of each filling cycle. A finger indexing mechanism uses a pair of air cylinders, one at the infeed end and one at the discharge end of the filling area, to release a predetermined number of containers 100 at the end of each filling cycle. The overall shape and cross-section of the containers 100 to be indexed is a determining factor in selecting the most appropriate of the three above-described variations.

As best seen in FIGS. 5 and 6, nozzle/container alignment mechanisms 130 locate the containers 100. The nozzle/container alignment mechanisms 130 include container locators 132 (one for each nozzle 154) which center the nozzles 154 in the container neck openings before the nozzles 154 attempt to enter the containers 100. This alignment process is accomplished by container locators 132 having an inverted cone-shaped orifice, with each locator 132 being attached to the nozzle mounting bracket 142 at a point just below the tips of the nozzles 154. As the nozzles 154 descend into the containers 100 (see the discussion of nozzle motion/mounting devices below), the locator 132 contacts and aligns the neck of the container 100 a fraction of a second before the nozzle tip reaches the neck opening.

Alternative and equally suitable nozzle/container alignment mechanisms incorporate V-shaped container locators that approach the necks of the containers from the side rather than from above. These alternative nozzle/container alignment mechanisms are discussed in greater detail below with respect to FIGS. 16 and 17.

The illustrated embodiment employs bottom up fill mechanisms 140 to position the nozzles 154 at the bottoms of the containers at the start of the fill cycle before slowly withdrawing them as the liquid fills the container. These mechanisms eliminate splashing and minimize foaming of the product during the filling process. The bottom up fill mechanisms 140 are equipped with pneumatic/hydraulic drive cylinders 141 to provide the up/down motion, guided by vertical motion guide assemblies 143, and nozzle mounting brackets 142. The nozzles 154 are held in blocks 146 that are bolted to the mounting brackets 142. The mounting brackets 142 are attached to the guide assemblies 143 which are, in turn, connected to the rods of the drive cylinders 141. The reciprocating, or up/down, motion of the drive cylinders 141 are translated to the nozzles 154 through this series of connections. The guide assemblies 143 maintain the proper alignment of the nozzles 154 and mounting brackets 142 with the containers located on the dual-lane conveyor assembly 110 via the motion of cam followers riding in guide slots (not shown in the Figures).

As an alternative to bottom up fill mechanisms 140, conventional locate fill mechanisms, static nozzle mounting bracket assemblies, walking beam mechanisms (discussed in detail below with respect to FIGS. 13–15), and reciprocating nozzle mechanisms can be substituted as would be appreciated to one skilled in the art. The production rate that the overall filling system is designed to achieve and certain characteristics, or properties, of the liquids that are to be filled, are the primary factors that are considered in choosing among these five alternative nozzle motion/mounting devices.

More specifically, locate fill mechanisms are designed to lower the nozzles 154 only into the necks of the containers during the fill cycle. Once the filling process is complete, the locate fill mechanisms lift the nozzles 154 out of the containers. Static nozzle mounting bracket assemblies hold the nozzles 154 in stationary positions at an elevation just above the top rim of the containers' necks. In conjunction with static nozzle mounting bracket assemblies, the containers, where appropriate, can be tilted to an angle of 15° to 30° from the vertical axis in order to assist with the filling process. Walking beam mechanisms provide a continuous-motion filling process by tracking the containers with the nozzles 154 as the containers move during the fill cycle, and by filling them with either locate fill or bottom up fill nozzle movement. Continuous-motion filling increases the filling system's overall production rate and eliminates product splashing created when containers are stopped/started as in intermittent indexing machinery. Yet another alternative is a reciprocating nozzle mechanism (see the detailed discussion of a second type below with respect to FIGS. 30–34), and this is especially suited for the dual lane conveyor assembly in the filling area as shown. A reciprocating nozzle mechanism moves the nozzle mounting bracket back and forth between the two lanes of containers in the filling area. This increases the system's overall production rate by indexing containers in one lane while the containers in the other lane are being filled.

Nozzle safety devices 145 are used to prevent damage to the nozzles 154 by detecting any obstacles (e.g. a disfigured or undersized container neck opening, a cap that has been placed on the container) that might prevent the nozzles 154 from entering the containers in the normal fashion. The nozzle safety devices 145 include nozzle holding blocks 146, nozzle movement detection bars 147, and proximity sensors 148. If a nozzle 154 encounters an obstacle as it is descending toward or into a container 100, the holding block 146 allows the nozzle 154 to move such that it disturbs the normal rest position of a movement detection bar 147. This bar 147 normally rests on a proximity sensor 148. When a nozzle movement detection bar 147 is disturbed and rises off of a proximity sensor 148, the filling system 10 pauses before the fill cycle begins to allow an operator to remove the defective container 100 or obstacle.

As best seen in FIGS. 4–6, the product contact subsystem 106 comprises a number of liquid metering devices 150 (e.g. lobe pumps, gear pumps, piston pumps, peristaltic pumps, flow meters, time/pressure filling heads), a product tank/manifold assembly 152 with a similar number of discharge ports, and, where appropriate, an equal number of metering device drive stations 180. The metering devices 150 may be positioned in any pattern (e.g. in-line, staggered) deemed appropriate for the needs of an application. Where appropriate, each metering device 150 is preferably connected to a metering device drive station 180 via a belt drive arrangement 161. As an alternative to the belt drive arrangements 161, other known methods of translating the fluid displacement motion of the drive stations 180 to the metering devices 150 can be utilized, inclusive of gears, sprockets and chains, direct couplings, etc. Each metering device 150 is equipped with a diverter valve assembly 151, two or more filling nozzles 154, intake tubing 156, and discharge tubing 158. The diverter valve assembly 151 is preferably a commercially available, general purpose, pilot-operated, three-way solenoid valve that splits the output flow of a single metering device 150 into two or more independent flows feeding an equal number of filling nozzles 154. The nozzles 154 are selected from one of a number of available configurations as necessary to best match the requirements of the metering device 150. For example, a two-stage, positive shut-off nozzle 154 may be supplied with a filling system 10 utilizing flow meters as the metering devices 150. The product tank/manifold assembly 152 is also selected from one of a number of available configurations as necessary to best match the requirements of the metering device 150. For example, a constant pressure/flow rate product tank/manifold assembly 152 may be supplied with a filling system 10 utilizing flow meters as the metering devices 150. All metal product contact parts are preferably fabricated of type 316 stainless steel, type 316L stainless steel, or other suitable materials.

Those skilled in the art will appreciate that the functionality of the diverter valve assembly 151 can be achieved in an alternative manner. To split the output flow of a single metering device 150 into two or more, independent flows feeding an equal number of filling nozzles 154, one or more, commercially available, Y- or T-shaped connectors can be utilized. The product flow through each filling nozzle 154 can then be controlled by a commercially available, general purpose, two-way solenoid valve, or a commercially-available pinch clamp system, located just prior to, or as an integral part of, the nozzle assembly 154.

Product contact subsystem 106 comprises a number of conventional variable speed, DC or servo motor-operated liquid metering device drive stations 180. When DC motors are utilized, one horsepower (1 hp.) units are generally provided. When servomotors are utilized, they generally possess a continuous power rating of 1.2 horsepower, 0.9 kilowatts (kW). Either type of drive station 180 allows an operator to adjust the fill volume via a touchscreen located on the operator interface 175. This dramatically reduces the overall amount of time required to change from one fill volume to another across the multiple metering device drive stations 180. Either drive assembly also provides the automatic calibration and set-up system (discussed below with respect to FIGS. 30–34) with the means to adjust the fill volume.

The electrical control system is designed for operation on 220 volt, 60 hz., three-phase service. The pneumatic system requires clean, dry compressed air at 80 psi. The controls/utilities subsystem 108 (including the programmable logic control device 170, see FIG. 3) is typically housed in a remote, NEMA 12 stainless steel enclosure 171 connected to the balance of the overall filling system via flexible conduit 172, or attached directly to the frame of the overall filling system 10 (see FIG. 10). The controls/utilities subsystem 108 includes the following components/features:

A programmable logic control device 170 and an operator interface 175 are provided to control the operation of the overall filling system. The preferred programmable logic control device 170 possesses 16K of user memory, serial communication capability, and a typical scan time of 1.0 ms/K. A typical operator interface 175 provides improved system control through its active matrix, TFT (thin film transistor) color touchscreen display. The programmable logic control device 170 is connected to both of the variable speed drives 118 in order to control the linear velocity of the dual-lane conveyor assembly 10. The programmable logic control device 170 is also connected to both of the stop mechanisms 124 in order to control the operation of the container indexing mechanisms 120. The programmable logic control device 170 is also connected to both of the drive cylinders 141 in order to control the operation of the nozzle motion/mounting devices (e.g. the bottom up fill mechanisms 140). The programmable logic control device 170 is also connected to each of the drive stations 180 (or, when drive stations 180 are not required/included, directly to each of the metering devices 150) in order to control the operating speed and displacement of the metering devices 150. The programmable logic control device 170 is also connected directly to the diverter valves 151 in order to control their operation. The interface 175 is programmed to step the operator through the filling system's set-up/changeover process and to assist with system fault condition diagnosis.

Referring back to FIG. 3, no bottle/no fill sensors 190 are preferably located at points upstream from the filling area (or, alternatively, upstream from the feed/timing screw indexing mechanism 380—see discussion below with respect to FIGS. 10–12) and are connected to the programmable logic control device 170. The commercially available photoelectric sensors 190, each complete with emitter, reflector plate, and receiver, check for the presence of continuous streams of incoming containers 100. If an incoming stream is interrupted and, thereby, fails to block the sensor 190, the filling system 10 pauses until the flow of containers 100 is restored. The filling system 10 automatically restarts after a no bottle/no fill condition has been detected and corrected.

Fallen container sensors 192 are connected to the programmable logic control device 170 and monitor the incoming streams of containers 100. If a container 100 has fallen over and, thereby, fails to block a sensor 192, the commercially available photoelectric sensor 192, complete with emitter, reflector plate, and receiver, stops the filling system 10 allowing the operator to correct the problem. The filling system 10 requires an operator-assisted restart after a fallen container condition has been detected and corrected.

An anti-back-up sensor 194 is connected to the programmable logic control device 170 and typically monitors the stream of containers 100 that are leaving the filling area (or, alternatively, leaving the feed/timing screw indexing mechanism 380—see discussion below with respect to FIGS. 10–12). If containers 100 begin to back up in front of the sensor 194 from the next downstream function, this commercially available photoelectric sensor 194, complete with emitter, reflector plate, and receiver, causes the filling system 10 to pause until the backlog is cleared. The filling system 10 automatically restarts after an anti-back-up condition has been detected and corrected.

The nozzle support subsystem 104 and the product contact subsystem 106 share a common frame assembly 270. The frame assembly 270 is a free standing unit with stainless steel panels where appropriate, and built-in leveling pads/jack screws 274 for leveling the multiple subsystems. Preferably, an OSHA-compliant safety guard assembly (not shown in FIGS. 3–6) encloses the subsystems' moving components.

A description of the operation of the embodiment of FIGS. 3–6 is as follows. Empty containers 100 are received, single file, at the infeed end of the conveyor assembly 110 (e.g. from the discharge of a container unscrambling system) and are divided into two lanes by the lane dividing mechanism 113 before entering the filling area. They are held in position in the filling area by the container indexing mechanisms 120. Alignment mechanisms 130 center the filling nozzles 154 in the container neck openings. The nozzle motion/mounting assemblies 140 generally position the nozzles 154 in the containers 100 at a point just above their bottoms before rising in unison with the level of the liquid during the filling cycle. Once the filling cycle is complete and the nozzles 154 have been completely withdrawn, the indexing mechanisms 120 release the filled containers 100 to travel to a point where the two conveyor lanes are merged by the lane combining assembly 117 before exiting the filling system. Once the containers 100 in lane #1 of the dual-lane conveyor assembly 110 have been filled, the metering devices 150 reset their control programs and the diverter valves 151 shuttle in order to immediately begin filling the containers 100 located in lane #2 of the dual-lane conveyor assembly 10. While the filling of the containers 100 in lane #2 proceeds, the filled containers 100 exit as empty containers 100 are indexed into position in the filling area of lane #1 and the nozzles 154 are moved into the appropriate position, relative to those containers 100, for the start of the next lane #1 filling cycle. This alternating process of filling the containers 100 in one lane while indexing those in the other continues until the production run has been completed.

In the above-described embodiment, the intermittent-motion filling system 10 according to the present invention allows the metering device 150 to operate at up to 100% of its maximum output volume, or total available dispensing time. In contrast, existing automated filling systems using identical metering devices utilize only 45% to 60% of the maximum output volume, or total available dispensing time. The percentage achieved is primarily dependent upon the amount of time required to index the filled containers out of the filling area and replace them with empty containers (see the example outlined in Table 1 below).

The operation of the liquid metering devices 150 at, or approaching, 100% of their maximum output volume means operation in, or very close to, a steady state condition. Operation in a steady state condition, or one where the pressure differential observed in the metering device 150 throughout its operating cycle approaches zero, provides two additional benefits. One, there is an inverse relationship between the observed pressure differential and the accuracy of the resulting fill cycle (i.e. as the observed pressure differential approaches zero, the accuracy of the filling process increases). Two, the operation of a metering device 150 in a steady state condition minimizes the wear and tear on its moving components and reduces the power consumption of its drive assembly (i.e. inefficient, power consuming start up and slow down cycles are eliminated).

Table 1 below compares the operation of a "typical" six-nozzle, intermittent-motion filling system to that of the above-described embodiment of the present invention when filling 16 oz., 3" diameter containers using a bottom up nozzle movement.

TABLE 1

| | A "Typical" Intermittent Motion Filling System | A Filling System According to a First Embodiment |
|---|---|---|
| Filling time | 4 seconds | 4 seconds |
| Container handling time | 3 seconds | Not applicable (*) |
| Nozzle movement time | 0.5 seconds | Not applicable (*) |
| Reset time (**) | Not applicable | 0.5 seconds |
| Total cycle time | 7.5 seconds | 4.5 seconds |
| No. of cycles/minute | 8.0 | 13.33 |
| Overall production rate | 48 containers/minute | 80 containers/minute |

(*) Container indexing and nozzle movement times are not applicable due to the dual-lane configuration (i.e. container indexing and nozzle movement for lane #2 occur while the filling process in lane #1 is completed and vice versa; and filling time is greater than the sum of the container indexing and nozzle movement times).
(**) Reset time (worst case scenario) between filling cycles for the liquid metering device and diverter valve. In a best case scenario (reset time = 0 seconds), the resulting overall production rate is 90 containers/minute.

Figure 7:
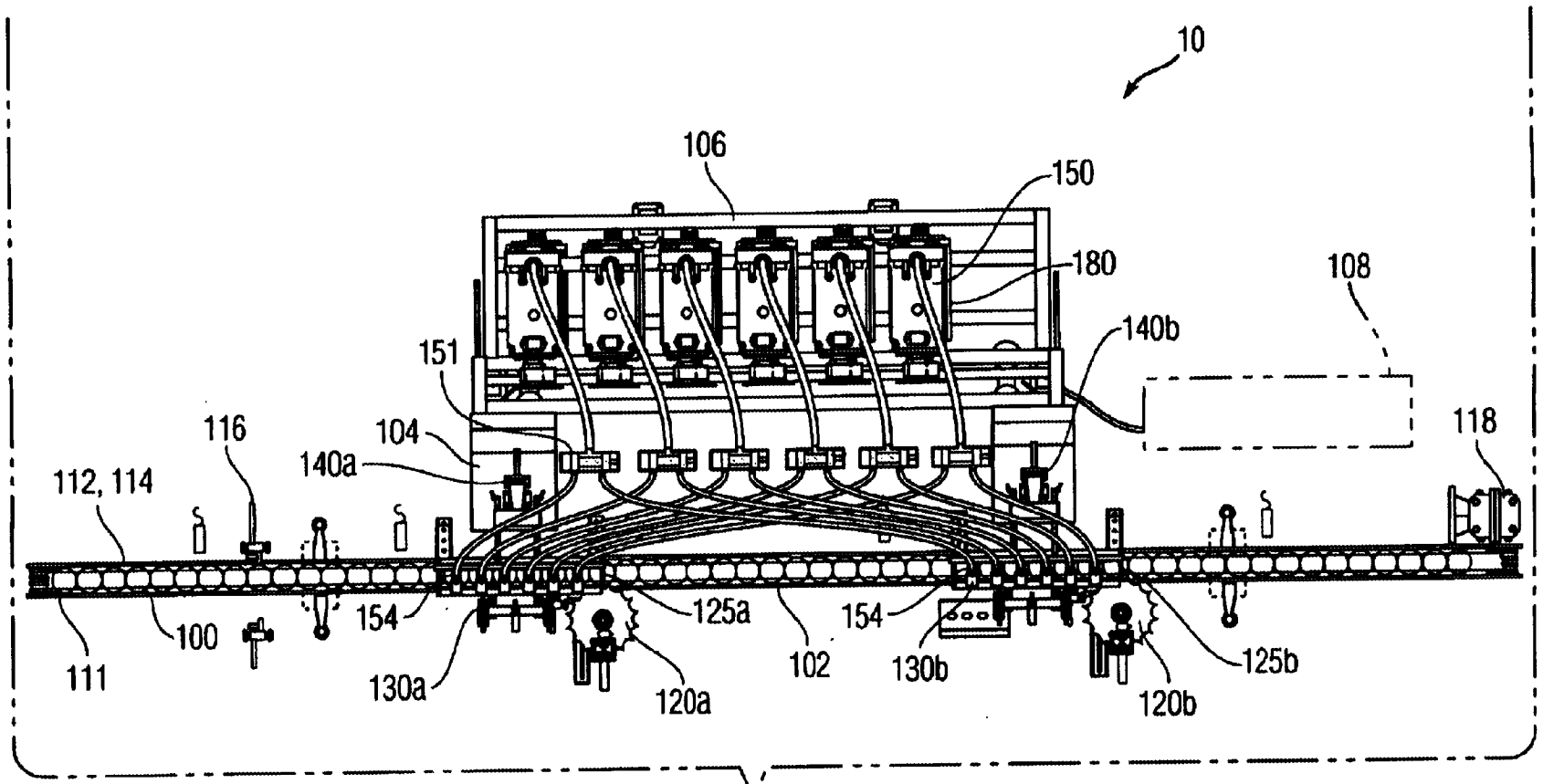
FIG. 7 shows a top perspective view of a diverter valve-based automated liquid filling system 10 incorporating a single-lane conveyor assembly 111 and two bottom up nozzle motion/mounting assemblies 140 according to an alternative embodiment of the present invention.

FIG. 7 shows a top perspective view of an alternative diverter valve-based automated liquid filling system 10 incorporating a single-lane conveyor assembly 111 (with two linearly-spaced filling areas rather than dual lane), and two bottom up nozzle motion/mounting assemblies 140*a*, 140*b*. This alternative embodiment is a modular, dual bottom up/single-lane conveyor filling system 10 consisting of four primary subsystems. The container handling subsystem 102 primarily consists of a single-lane conveyor assembly 111, two container/nozzle alignment devices 130*a*, 130*b*, and two container indexing mechanisms 120*a*, 120*b*. The nozzle support subsystem 104 includes two nozzle motion/mounting assemblies, typically equipped with bottom up mechanisms 140*a*, 140*b*. The product contact subsystem 106 and the controls/utilities subsystem 108 are equipped in a manner that is essentially identical to that of the primary embodiment discussed above.

As with the dual-lane conveyor assembly discussed above, the single-lane conveyor assembly's length and width may be varied to suit the needs of the application. The single-lane conveyor assembly 111 preferably includes a stainless steel conveyor bed 112, low friction conveyor chain 114, adjustable container guide rails 116, and a variable speed, DC motor drive 118, all of which are readily available commercial parts.

A description of the operation of the alternative embodiment shown in FIG. 7 is as follows. Each filling zone 125*a*, 125*b* includes a container indexing mechanism 120*a*, 120*b*, a bottom up nozzle motion/mounting assembly 140*a*, 140*b*, and a nozzle/container alignment mechanism 130*a*, 130*b*. Empty containers 100 are received, single file, at the infeed end of the single-lane conveyor assembly 111 (e.g. from the discharge of a container unscrambling system) and accumulate in the first of the two filling zones 125*a*. The container indexing mechanism 120*a* positions a slug of containers 100 under the bottom up nozzle motion/mounting assembly 140*a*. The number of containers 100 in the slug is equal to twice the number of nozzles 154 present on the nozzle motion/mounting assembly 140*a*. At the start of the first zone's filling cycle, the nozzle/container alignment mechanism 130*a* centers the filling nozzles 154 in the neck openings of the containers 100 that make up the leading half of the slug. The nozzle motion/mounting assembly 140*a* generally positions the nozzles 154 in those containers 100 at a point just above their bottoms before rising in unison with the level of the liquid during the first zone's filling cycle. As soon as the first zone's filling cycle is complete and the nozzles 154 have been completely withdrawn, the indexing mechanism 120*a* releases the slug of containers 100 (i.e. where half are now filled and half are still empty) to transfer into the second filling zone 125*b*.

In the second filling zone 125*b*, the container indexing mechanism 120*b* positions a slug of containers 100 under the bottom up nozzle motion/mounting assembly 140*b*. At the start of the second zone's filling cycle, the nozzle/container alignment mechanism 130*b* centers the filling nozzles 154 in the neck openings of the containers 100 that make up the trailing half of the slug. The nozzle motion/mounting assembly 140*b* generally positions the nozzles 154 in those containers 100 at a point just above their bottoms before rising in unison with the level of the liquid during the second zone's filling cycle. As soon as the second zone's filling cycle is complete and the nozzles 154 have been completely withdrawn, the indexing mechanism 120*b* releases the slug of containers 100 (with all containers 100 now filled) to travel to the exit end of the conveyor 111. Essentially, as soon as the appropriate half (i.e. leading or trailing) of the slug of containers 100 positioned in one filling zone has been filled, the metering devices 150 reset their control programs and the diverter valves 151 shuttle (in a worst case scenario, there is a delay of 0.3 to 0.5 seconds to complete this reset/shuttle process) in order to immediately begin filling the appropriate half (i.e. leading or trailing) of the slug located in the other filling zone. This alternating process of filling the containers 100 in one zone while indexing those in the other continues until the production run has been completed.

Figure 8:
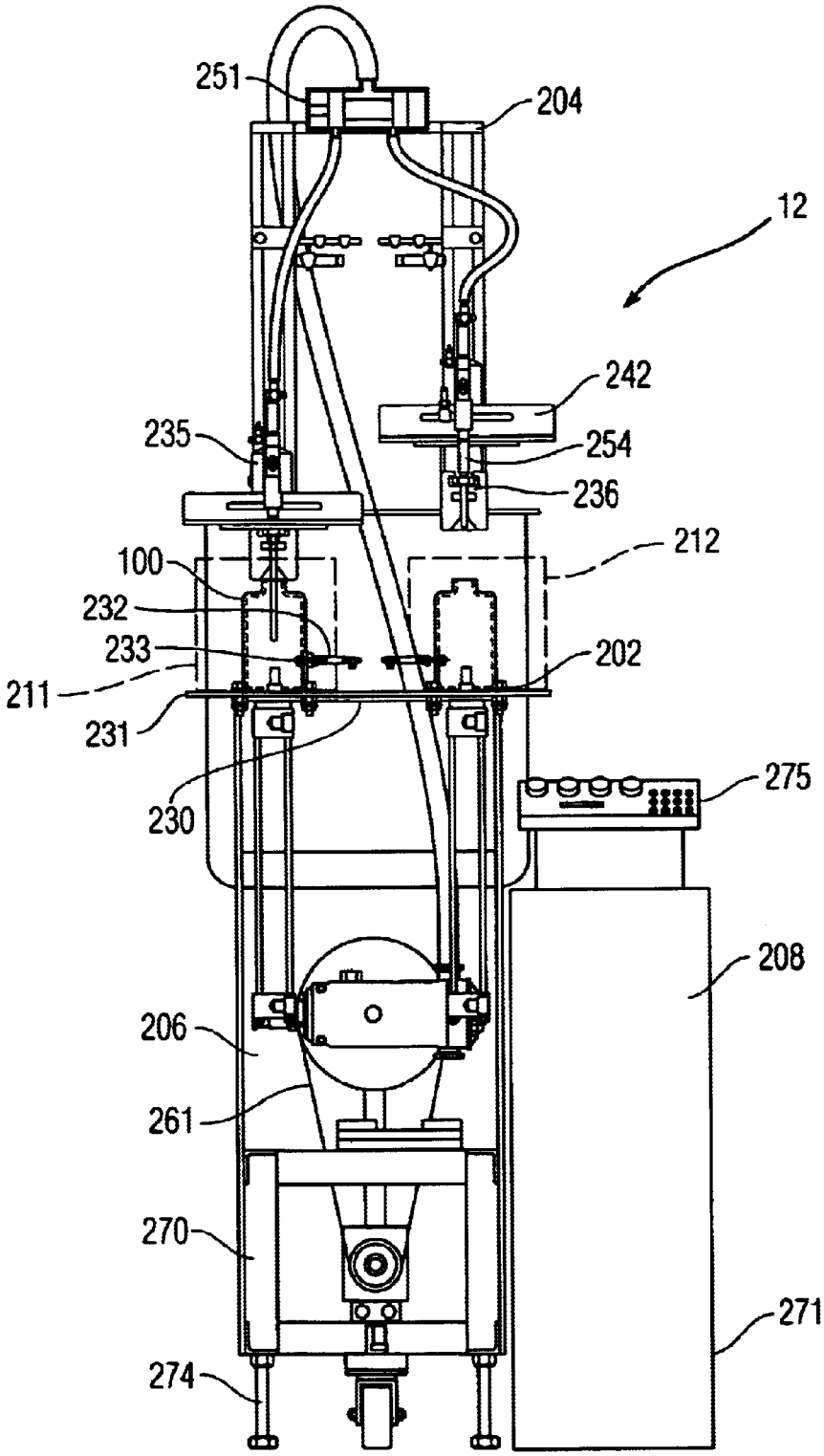
FIG. 8 shows a front elevation view of the overall diverter valve-based semi-automated liquid filling system 12, including a container handling subsystem 202, a nozzle support subsystem 204, a product contact subsystem 206, and a controls/utilities subsystem 208, according to an alternative embodiment of the present invention.
Figure 9:
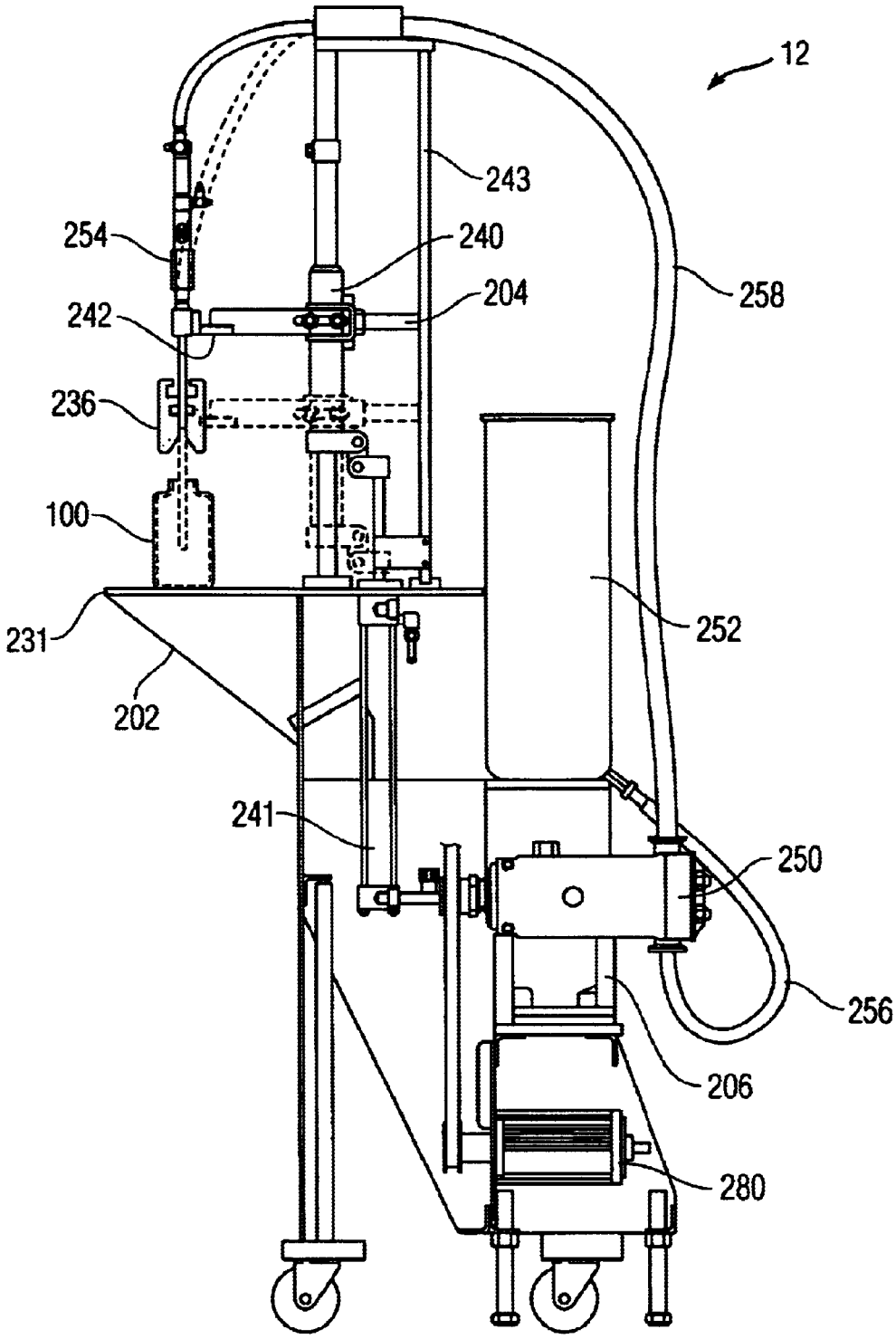
FIG. 9 shows a side elevation view of the overall diverter valve-based semi-automated liquid filling system 12 as in FIG. 8.

FIGS. 8 and 9 show, respectively, front and side elevation views of a semi-automated liquid filling system 12 according to yet another embodiment of the present invention. The container handling subsystem 202 provides a dual-area container body/nozzle alignment assembly 230 in which an operator places the containers 100 for the filling process. The nozzle support subsystem 204 moves the nozzles 254 up and down (or, into and out of the containers 100) during the filling process. The product contact subsystem 206 contains the elements of the filling system 12 required to supply (holding tank 252), measure (metering devices 250), and dispense (nozzles 254) the liquid product. The controls/utilities subsystem 208 includes the electrical and pneumatic components (e.g. solenoid valves, motor starters) required to control the overall operation of the filling system 12.

Container handling subsystem 202 comprises a dual-area container body/nozzle alignment assembly 230, complete with a base plate 231 and number of container body locator assemblies 232, equal to the number of filling nozzles 254. These body locator assemblies 232 allow the operator to quickly and accurately position the container neck openings below the nozzles 254 before the nozzles 254 attempt to enter the containers 100. Each body locator assembly 232 includes a container sensor 233. If the sensor 233 indicates that there is no container 100 in the body locator assembly 232, the filling system will temporarily suspend its operation until a container 100 is placed in the appropriate position.

Nozzle/container neck alignment mechanisms 235, each complete with a number of container neck locators 236 equal to the number of metering devices 250, are included. These mechanisms locate the containers 100 and center the nozzles 254 in their neck openings before the nozzles 254 attempt to enter the containers 100. This alignment process is accomplished by container neck locators 236 in the shape of inverted cones attached to the nozzle mounting bracket 242 at a point just below the tips of the nozzles 254. As the nozzles 254 descend into the containers 100 (see the discussion of nozzle motion/mounting devices below), the locator 236 contacts and aligns the neck of the container 100 a fraction of a second before the nozzle tip reaches the neck opening.

The nozzle support subsystem 204 includes one or more nozzle motion/mounting assemblies. Bottom up fill mechanisms 240 are generally used to position the nozzles 254 at the bottom of the containers 100 at the start of the fill cycle before slowly withdrawing them as the liquid fills the container 100. These mechanisms 240 eliminate the splashing and minimize the foaming of the product during the filling process. Each bottom up fill mechanism 240 is equipped with an air/hydraulic drive cylinder 241 to provide the up/down motion, a vertical motion guide assembly 243, and a nozzle mounting bracket 242. As an alternative to bottom up fill mechanisms 240, locate fill mechanisms or static nozzle mounting bracket assemblies, as described above, can be supplied.

A number of liquid metering devices 250 (e.g. lobe pumps, gear pumps, piston pumps, peristaltic pumps, flow meters, time/pressure filling heads), a product tank/manifold assembly 252 with a similar number of discharge ports, and, where appropriate, an equal number of metering device drive stations 280 are part of the product contact/metering device drive subsystem 206. Where appropriate, each metering device 250 is preferably connected to a metering device drive station 280 via a belt drive arrangement 261. As an alternative to the belt drive arrangements 261, any method (e.g. gears, sprockets and chains, direct couplings) of translating the fluid displacement motion of the drive stations 280 to the metering devices 250 may be utilized. Each metering device 250 is equipped with a diverter valve assembly 251, two or more filling nozzles 254, intake tubing 256, and discharge tubing 258. The diverter valve assembly 251 is preferably a commercially available, general purpose, pilot-operated, three-way solenoid valve (once again, the functionality of the diverter valve assembly 251 could be achieved in the alternative manner discussed above). All metal product contact parts are fabricated of type 316 stainless steel, type 316L stainless steel, or other suitable materials.

In this alternative embodiment, a number of variable speed, DC or servo motor-operated liquid metering device drive stations 280 are part of the product contact/metering device drive subsystem 206. When DC motors are utilized, 1-hp. units are preferably provided. When servomotors are utilized, they generally possess a continuous power rating of 1.2 hp., 0.9 kW. Either type of drive station 280 allows an operator to adjust the fill volume via the touchscreen located on the operator interface 275. This dramatically reduces the overall amount of time required to change from one fill volume to another across the multiple metering device drive stations 280.

The electrical control system is designed for operation on 220 volt, 60 hz., three-phase service. The pneumatic system requires clean, dry compressed air at 80 psi. These electrical and pneumatic components constitute the controls/utilities subsystem 208. This subsystem 208 is housed in a NEMA 12, stainless steel enclosure 271 and includes, among others, the following component/feature:

An operator interface 275 is provided to assist in controlling the operation of the semi-automatic filling system. The operator interface 275 provides improved system control, preferably via an alphanumeric keypad and multi-line display. The controls/utilities subsystem 208 controls (1) the operation of the nozzle motion/mounting devices (e.g. the bottom up fill mechanisms 240), (2) the operating speed and displacement of the metering devices 250, and (3) the operation of the diverter valves 251.

The container handling subsystem 202, the nozzle support subsystem 204, the product contact/metering device drive subsystem 206, and the controls/utilities subsystem 208 share a common frame assembly 270. The frame assembly 270 is a free-standing unit with stainless steel panels where appropriate, and built-in leveling pads/jack screws 274 for leveling the overall filling system. Preferably, an OSHA-compliant guard assembly (not shown in the Figures) encloses the filling system's moving components.

A description of the operation of the embodiment of FIGS. 8 and 9 is as follows. Empty containers 100 are placed by an operator in position in the dual-area container/nozzle alignment assembly 230. The operator then actuates the filling cycle. The nozzle motion/mounting assembly 240 generally positions the nozzles 254 in the containers 100 at a point just above their bottoms before rising in unison with the level of the liquid during the filling cycle. With this particular embodiment, once the container 100 in area 211 has been filled, the metering device 250 resets its control program and the diverter valve 251 shuttles in order to immediately begin filling the container 100 located in 212. While the filling of the container 100 in area 212 proceeds, an empty container 100 is placed in position under the filling nozzle 254 in area 211 by the operator. This alternating process of filling the container 100 in one area while removing/replacing that in the other continues until the production run has been completed.

A semi-automated filling system 12 according to the embodiment of FIGS. 8 and 9 likewise allows the metering device 250 to operate at up to 100% of its maximum output volume. A "typical" semi-automated filling system using identical metering devices utilizes only 45% to 60% of the maximum output volume, or total available dispensing time. The percentage achieved is primarily dependent upon the amount of time required for the operator to replace the filled containers with empty ones (see the example outlined in Table 2 below). A filling system 12 according to this alternative embodiment can incorporate any number of metering devices 250 and filling nozzles 254 to obtain the production rate required by the end user.

Table 2 below compares the operation of a "typical" two-nozzle, semi-automated filling system to that of this alternative embodiment when filling 16 oz. containers using a static nozzle bracket assembly.

TABLE 2

| | A "Typical" Semi-Automated Filling System | A Filling System According to this Alternative Embodiment |
|---|---|---|
| Filling time | 6 seconds | 6 seconds |
| Container handling time | 5 seconds | Not applicable (*) |
| Reset time (**) | Not applicable | 0.5 seconds |
| Total cycle time | 11.0 seconds | 6.5 seconds |
| No. of cycles/minute | 5.45 | 9.23 |
| Overall production rate | 10+ containers/minute | 18+ containers/minute |

(*) Container handling time is not applicable due to the two filling area configuration (i.e. container removal/replacement by the operator for area 212 occurs while the filling process in area 212 is completed and vice versa; and filling time is greater than the container handling time).
(**) Reset time (worst case scenario) between filling cycles for the liquid metering device and diverter valve. In a best case scenario (reset time = 0 seconds), the resulting overall production rate is 20 containers/minute.

Figure 10:
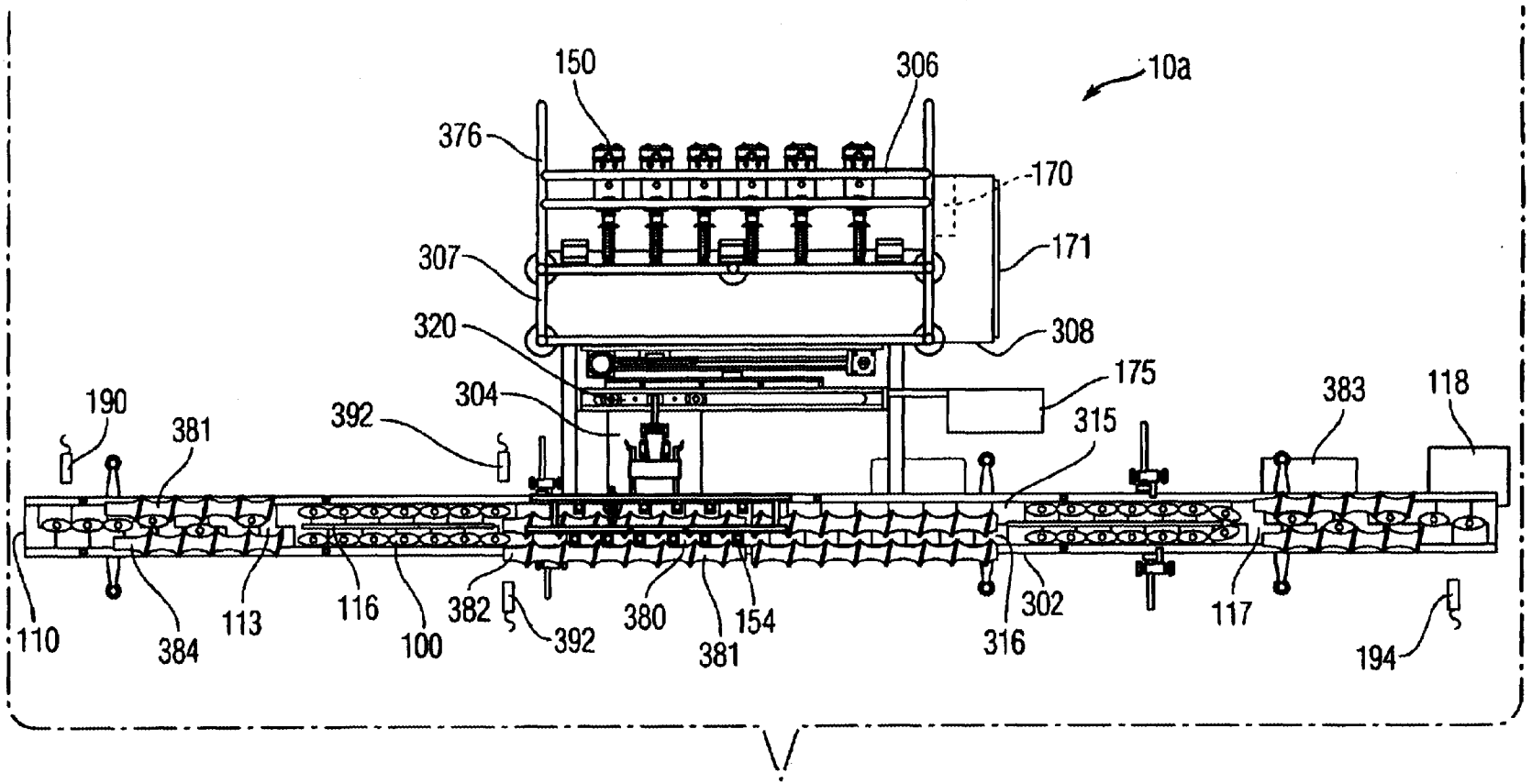
FIG. 10 is a top perspective view of an in-line walking beam/dual-lane conveyor filling system 10*a*, including a container handling subsystem 302, a nozzle support subsystem 304, a product contact subsystem 306, and a controls/utilities subsystem 308, according to an alternative embodiment of the present invention.
Figure 11:
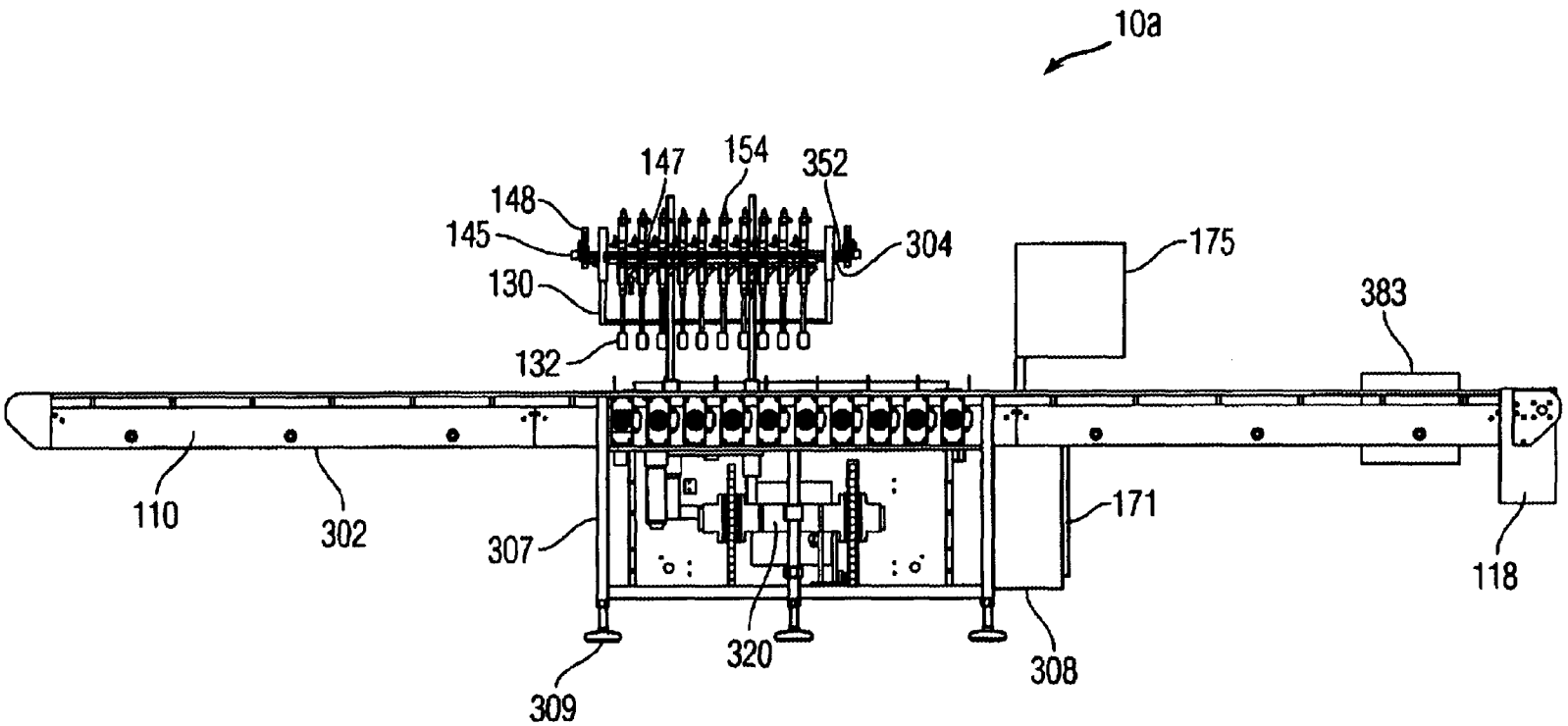
FIG. 11 is a front perspective view of the in-line walking beam/dual-lane conveyor filling system 10*a* as in FIG. 10.
Figure 12:
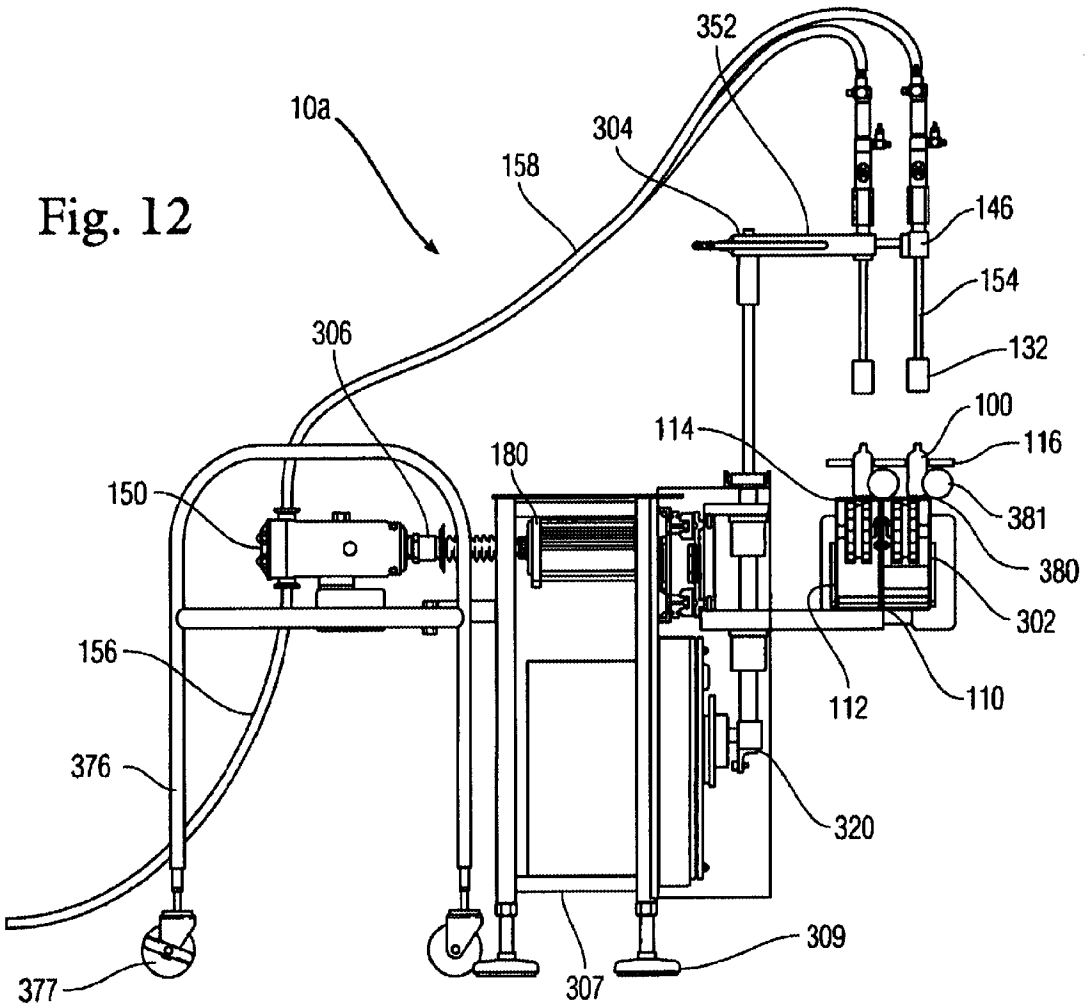
FIG. 12 is an end perspective view of the in-line walking beam/dual-lane conveyor filling system 10*a* as in FIGS. 10 and 11.

FIGS. 10–12 are, respectively, top, front, and end perspective views of the overall liquid filling system 10*a* according to another embodiment of the present invention, including a container handling subsystem 302, a nozzle support subsystem 304, a product contact subsystem 306, and a controls/utilities subsystem 308. As opposed to the intermittent-motion embodiments discussed with respect to FIGS. 3–7, this alternative embodiment utilizes a continuous-motion container handling/filling process. The container handling subsystem 302 carries the containers 100 through the filling zone and positions them for the entry of the filling nozzles 154. The nozzle support subsystem 304 moves the nozzles 154 up and down (or, into and out of the containers 100), and in unison with the horizontal travel of the containers 100 during the continuous-motion filling process. The product contact subsystem 306 contains the elements of the filling system 10*a* required to supply (e.g. holding tank), measure (e.g. metering devices), and dispense (e.g. nozzles 154) the liquid product. The controls/utilities subsystem 308 includes the electrical and pneumatic components (e.g. programmable logic control device 170, solenoid valves, motor starters) required to control the overall operation of the filling system 10*a*.

A dual-lane conveyor assembly 110 is included to transport the containers 100 through the continuous-motion filling process. The conveyor assembly's length and width are variable to suit the needs of the application. The conveyor assembly 110 preferably includes stainless steel conveyor beds 112, a lane divider 113 for alternately routing containers 100 into the respective lanes of the dual-lane conveyor assembly 110, a low friction conveyor chain 114, adjustable container guide rails 116, a lane combiner 117 for combining containers 100 from the two lanes of the dual-lane conveyor assembly 110 into a single lane, and variable speed, DC motor drives 118, all of which are readily available commercial parts. The functions of the lane divider 113 and lane combiner 117 may be accomplished by the feed/timing screw indexing mechanism 380 (discussed in detail below). For lane division, the feed/timing screw indexing mechanism 380 directs the single lane of incoming containers 100 into one of two lanes 315, 316 for passage through the filling zone's nozzle mounting bracket assemblies 352. For lane combining at the termination of the conveyor beds 112, the feed/timing screw indexing mechanism 380 takes the containers 100 leaving the filling zone in the two lanes 315, 316 and combines them into one lane before they exit the filling system 10*a*.

Container indexing through the filling zone is typically accomplished with one or more servo motor-driven, multi-stage, feed/timing screw indexing assemblies 380. Multi-stage feed/timing screw indexing assemblies 380 are positioned upstream of the infeed end of the filling zone, throughout the filling zone, and downstream from the discharge end of the filling zone. The feed/timing screws 381 that contact the external surfaces of the containers 100 are preferably fabricated of UHMW polyethylene and held in conveyor-mounted support brackets 382. As the name implies, a feed/timing screw 381 is a length of material that is fabricated with screw-like threads along its outside surface. The shape of the "thread" is cut to match the cross-section of the container(s) 100 that the feed/timing screw 381 is designed to index. Each feed/timing screw 381 possesses an infeed, or lead-in, section 384 that allows only a single container 100 to be captured by the screw 381 during each of its revolutions. The servo motor drives 383 for these assemblies 380 are electronically linked to the walking beam assembly's horizontal motion servo drive assembly 330 in order to properly space and align the containers 100 with the nozzles 154 during the filling process.

The first stage 113 of the feed/timing screw indexing assembly 380, located upstream of the filling zone, utilizes the rotation of a "dividing" feed/timing screw configuration to split a single-file stream of incoming, empty containers 100 into two lanes 315, 316. The second stage of the indexing assembly 380 utilizes the rotation of a pair of multi-pocketed feed screws 381 (each located in a lane 315, 316 of the dual-lane conveyor assembly 110), with one container 100 positioned in each pocket (formed between the feed/timing screw 381 and the corresponding container guide rail 116), to carry a predetermined number of containers 100 through the filling zone during each filling cycle. The final stage 117 of the indexing assembly 380 utilizes the rotation of a "combining" feed/timing screw configuration to merge the two lanes 315, 316 of filled containers 100 back into a single-file stream exiting the filling system 10*a*. Multi-stage feed/timing screw assemblies of this type are commercially available from, for example, the Morrison Timing Screw Company of Glenwood, Ill.

An alternative and equally suitable continuous-motion container indexing method is a lug chain device. As its name suggests, a commercially available lug chain device utilizes a series of lugs attached to a chain at appropriate intervals to space the containers 100 to the pitch distance required to match that of the nozzles 154 on the walking beam assembly 320. The overall shape and cross-section of the containers 100 that are to be indexed assists in determining which of the two variations is most appropriate.

As described above with respect to FIGS. 3–6, a nozzle/container alignment mechanism 130, complete with a number of container locators 132 equal to the number of nozzles 154 is included. The operation of the nozzle/container alignment mechanism 130 as a sub-component of this alternative embodiment is identical to that discussed above.

Also as described with respect to FIGS. 3–6, a nozzle safety device 145 is used to prevent damage to the nozzles 154 by detecting any obstacles (e.g. a disfigured or undersized container neck opening, a cap that has been placed on the container) that might prevent the nozzles 154 from entering the containers in the normal fashion. The device 145 includes nozzle holding blocks 146, a nozzle movement detection bar 147, and a proximity sensor 148. Its functionality is identical to that discussed above.

As is evident in FIG. 10, a dual-lane walking beam nozzle motion/mounting assembly 320 is utilized with the dual-lane conveyor assembly 110. An independently operated feed/timing screw indexing mechanism 380 is utilized to carry the containers 101 through the dual-lane walking beam filling process. The walking beam nozzle motion/mounting assembly 320 is designed to provide both a continuous-motion filling process and, typically, bottom up fill nozzle movement. The continuous-motion process fills the containers 100 as they are indexed through the filling zone with sets of nozzles 154 that move horizontally in unison with them. Continuous-motion filling eliminates the product splashing that can occur when containers 100 are stopped/started as in intermittent indexing machinery. Bottom up fill nozzle movement is generally used to position the nozzles 154 at the bottom of the containers 100 at the start of the fill cycle before slowly withdrawing them as the liquid fills the container 100. This process eliminates the splashing and minimizes the foaming of the product during the filling process.

Figure 13:
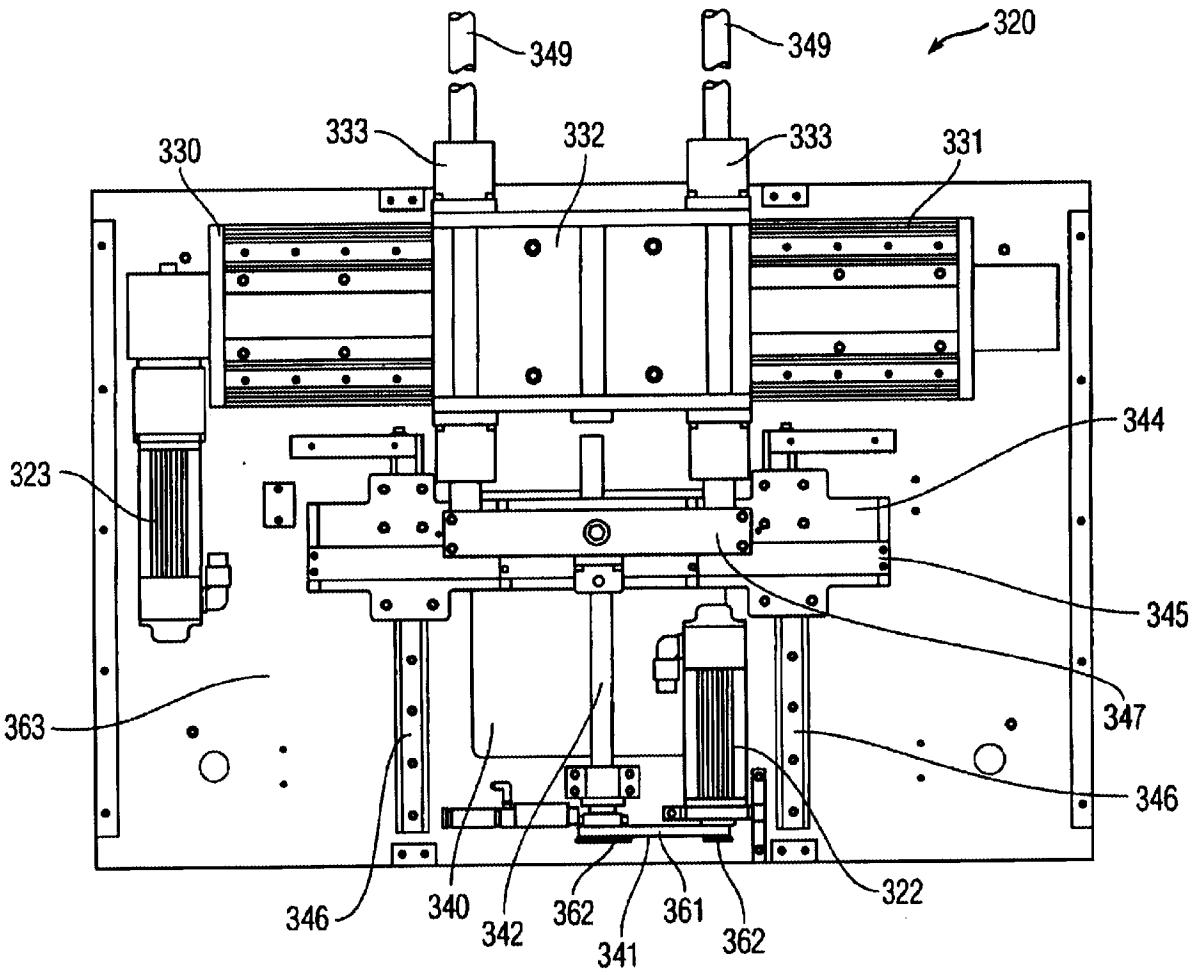
FIG. 13 is a front perspective view of the interconnected horizontal and vertical motion drive mechanisms 330, 340, respectively, of the walking beam assembly 320.
Figure 14:
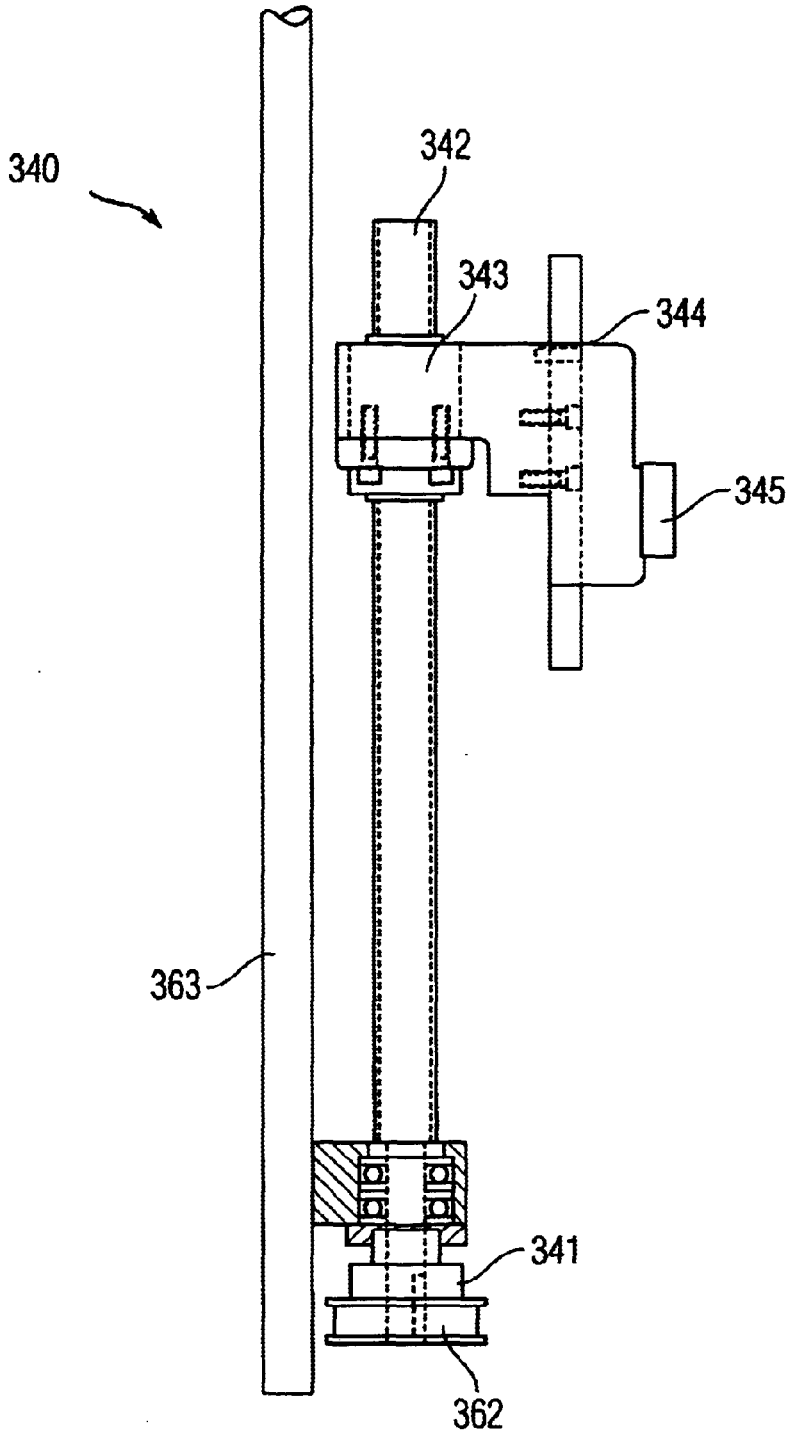
FIG. 14 is an end perspective view of the vertical motion drive mechanism 340 of the walking beam assembly 320 as in FIG. 13.

FIG. 13 shows a front perspective view of the interconnected horizontal and vertical motion drive mechanisms 330, 340 of the walking beam assembly 320. FIG. 14 is an end perspective view of the vertical motion drive mechanism 340 of the walking beam assembly 320 of FIG. 13. FIG. 8 is an end perspective view of the horizontal motion drive mechanism 330 of the walking beam assembly 320 of FIG. 13.

The motion of the walking beam assembly 320 is controlled by two servo motors 322, 323, which may be commercially available 1.2 horsepower, 0.9 kilowatt servomotors. One servomotor 322 is used to drive the up/down (i.e. vertical) motion of the assembly 320, while the second servo motor 323 controls its horizontal travel. The coupling of a commercially-available, 1,024 line quadrature encoder and a commercially-available resolver with a twelve-bit A-D (i.e. analog-digital) interface is used to monitor the motion of the associated feed/timing screw indexing mechanism 380. The encoder/resolver data is utilized by the second servomotor 323 to match the horizontal velocity and position of the walking beam assembly 320 to that of the containers 100 carried by the feed/timing screw indexing mechanism 380.

The servo motor-driven, vertical motion of the walking beam assembly 320 results from the interaction of a servo motor 322, a belt drive assembly 341, a ball screw 342, a ball nut 343, a vertical motion drive plate 344, a bearing bar 345, two vertically-mounted linear runner/guide rail assemblies 346, a lift bar 347, two cam follower bearings 348, two vertical posts 349, a dual-lane nozzle mounting bracket assembly 352 (see FIGS. 10–12), and a plurality of nozzle holding blocks 146 and nozzles 154 (see FIGS. 10–12) aligned over both lanes 315, 316 of the conveyor assembly 110. The rotation of the servomotor 322 is translated to the commercially available ball screw 342 (25 mm. diameter, 25 mm. pitch) via drive assembly 341. The drive assembly 341 includes commercially available timing belts 361 and timing pulleys 362 as necessary to effect a 2:1 reduction ratio. Rotation of the ball screw 342 causes the commercially-available, matching ball nut 343 (see FIG. 14, nut 343 is not visible in FIG. 13 due to its position behind plate 344) to move upward or downward along the ball screw 342. A fixed connection between the ball nut 343 and the vertical motion drive plate 344 causes the plate 344 to also move upward and downward in reaction to any rotation of the ball screw 342. The vertical motion of the drive plate 344 is kept in proper alignment by two commercially-available, vertically-mounted linear runner/guide rail assemblies 346 (i.e. the runners are fixedly mounted to the drive plate 344, the guide rails are attached to the frame 307 of the filling system 10*a* via a base plate 363). The bearing bar 345, above and below which the two cam follower bearings 348 ride horizontally (in reaction to the operation of the horizontal motion drive mechanism 330 discussed below), is fixedly connected to the drive plate 344. The cam followers 348, which move upward/downward in reaction to any motion of the bearing bar 345, are fixedly attached to the lift bar 347 that fixedly supports, at its two ends, the lower ends of two vertical posts 349. Thus, the two vertical posts also move upward/downward in reaction to any motion of the bearing bar 345. The dual-lane nozzle mounting bracket assembly 352 (not shown in FIGS. 13–15, see FIGS. 10–12), with its plurality of nozzle holding blocks 146 and nozzles 154, is fixedly attached to the upper ends of the vertical posts 349. This series of connections converts the rotational motion of the servomotor 322 into the vertical motion of the nozzles 154 with respect to the containers 100.

Figure 15:
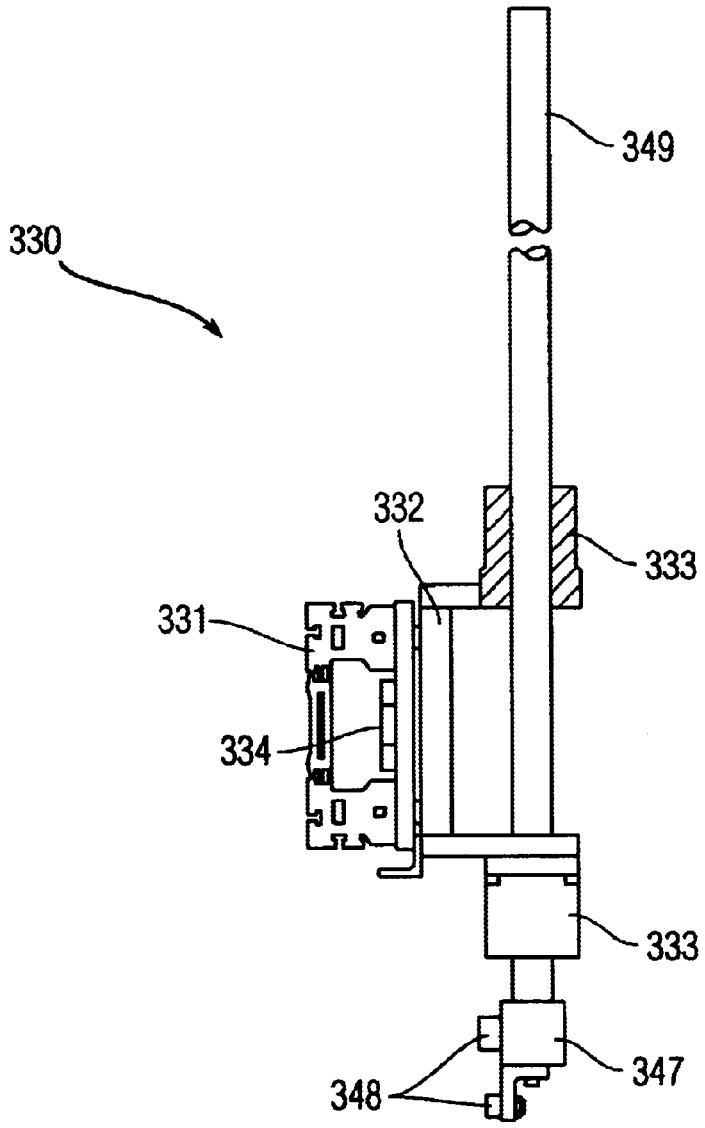
FIG. 15 is an end perspective view of the horizontal motion drive mechanism 330 of the walking beam assembly 320 as in FIG. 13.

As shown in FIGS. 13 and 15, the servo motor-driven, horizontal motion of the walking beam assembly 320 results from the interaction of a servo motor 323, a rail assembly 331, a mounting plate assembly 332, and four linear bearings 333. The servomotor 323 is directly coupled to the commercially available rail assembly 331 (such as that available from Thomson Industries, Inc. of Port Washington, N.Y.). The rail assembly 331 converts the rotational motion of the servomotor 323 into linear motion, along a horizontal axis, via a continuously supported, precision steel reinforced timing belt (not shown) fixedly attached to a carriage 334. The assembly 331 is designed to provide up to 24 inches of linear travel at a maximum velocity of 118 inches/second with a positioning accuracy of better than 0.07%. The mounting plate assembly 332 is fixedly attached to and moves in unison (horizontally) with the rail assembly's carriage 334. The four linear bearings 333 are fixedly attached to the plate assembly 332 and are aligned such that the vertical posts 349 pass through them. The vertical posts 349 are slidably engaged with the linear bearings 333.

The horizontal motion generated by the servo motor 323/rail system 331 combination is translated to the nozzle mounting bracket assembly 352 and nozzles 154 at the point where the vertical posts 349 pass through the four linear bearings 333. Proper alignment of the nozzles 154 and mounting bracket assembly 352 with the containers 100 located on the conveyor assembly 110 is maintained through constant communication between the walking beam's horizontal motion servo drive assembly 330 and the feed/timing screw servo drive assembly 380.

As an alternative to the bottom up fill nozzle movement discussed above, locate fill or static fill processes can be utilized. A locate fill system is designed to lower the nozzles 154 only into the necks of the containers 100 during the fill cycle. Once the filling process is complete, the locate fill mechanism lifts the nozzles 154 out of the containers 100. In a static fill configuration, the nozzles 154 remain above, or outside of, the containers 100 throughout the filling process.

In this alternative embodiment, the programmable logic control device 170 is connected to both of the variable speed drives 118 in order to control the linear velocity of the dual-lane conveyor assembly 110. The programmable logic control device 170 is also connected to the servo motor drive assembly 383 in order to control the operation of the feed/timing screw container indexing mechanism 380). The programmable logic control device 170 is also connected to the servo motor-operated horizontal motion drive mechanism 330 and the servo motor-operated vertical motion drive mechanism 340, in order to control the operation of the nozzle motion/mounting devices (e.g. the walking beam assembly 320). The programmable logic control device 170 is also connected to each of the drive stations 180 (or, when drive stations 180 are not required/included, directly to each of the metering devices 150) in order to control the operating speed and displacement of the metering devices 150. The interface 175 is programmed to step the operator through the filling system's set-up/changeover process and to assist with system fault condition diagnosis.

In addition to no bottle/no fill and anti-back-up sensors 190, 194, respectively, no-container-in-feed/timing-screw-pocket sensors 392 are connected to the programmable logic control device 170 and typically monitor each lane 315, 316 of containers 100. If a feed/timing screw 381 pocket is empty and, thereby, fails to block a sensor 392, the commercially available photoelectric sensor 392, complete with emitter, reflector plate, and receiver, stops the filling system 10*a* allowing the operator to correct the problem. The filling system 10*a* requires an operator-assisted restart after a no-container-in-feed/timing-screw-pocket condition has been detected and corrected.

Returning to FIGS. 10–12, the nozzle support subsystem 304 and the metering device drive stations 180 share a common frame assembly 307. The frame assembly 307 is a free-standing unit preferably fabricated of tubular stainless steel with stainless steel panels where appropriate, and built-in leveling pads/jack screws 309 for leveling the multiple subsystems. Preferably, an OSHA-compliant guard assembly (not shown in the Figures) encloses the subsystems' moving components. The metering devices 150 are fixedly attached to a second, portable frame assembly 376. The portable frame assembly 376 is a free-standing unit preferably fabricated of tubular stainless steel with built-in casters 377 to facilitate product contact part changeover.

With reference to FIGS. 10–15, a description of this alternative embodiment's operation is as follows. Empty containers 100 are received, single file, at the infeed end of the conveyor assembly 110 (e.g. from the discharge of a container unscrambling system). The containers 100 enter the first stage 113 of the continuous-motion feed/timing screw indexing assembly 380 where they are divided into two lanes 315, 316 and spaced to the proper center distance for passage through the filling zone.

Once in the filling zone, the containers 100 move into position under the nozzles 154 mounted on the walking beam assembly 320. As they descend toward the containers 100, alignment mechanisms 130 center the filling nozzles 154 in the container neck openings. The walking beam assembly 320 travels horizontally in unison with the containers 100 carried by the second stage of the feed/timing screw assembly 380 and generally positions the nozzles 154 in the containers 100 at a point just above their bottoms before rising along with the level of the liquid during the filling cycle. The horizontal motion of the walking beam assembly 320 results from, as discussed above, cooperation between the servo motor 323, the rail assembly 331, the mounting plate assembly 332, the four linear bearings 333, and the two vertical posts 349. The vertical motion of the walking beam assembly 320 results from, also as discussed above, cooperation between the servo motor 322, the belt drive assembly 341, the ball screw 342, the ball nut 343, the vertical motion drive plate 344, the bearing bar 345, the two vertically-mounted linear runner/guide rail assemblies 346, the lift bar 347, the two cam follower bearings 348, the two vertical posts 349, the dual-lane nozzle mounting bracket assembly 352, and the plurality of nozzle holding blocks 146 aligned over both lanes 315, 316 of the conveyor assembly 110.

Once the filling cycle is complete and the nozzles 154 have been completely withdrawn, the final stage 117 of the feed/timing screw indexing assembly 380 merges the filled containers 100 back into a single lane prior to their being released and allowed to exit the filling system 10*a*. The walking beam assembly 320 moves horizontally (again due to the operation of the servo motor-operated drive mechanism 330) to return to the infeed end of the filling zone to enter and begin filling the next set of empty containers 100.

To illustrate the improvement afforded by the present embodiment, Table 3 below compares the operation of a twelve-nozzle, continuous-motion walking beam/single-lane conveyor filling system to that of a first embodiment of the present invention (walking beam/dual-lane conveyor) when filling 4 oz., 2" diameter containers using a bottom up nozzle movement.

TABLE 3

| | A "Typical" Walking Beam/ Single-Lane Conveyor Filling System | A Filling System According to the First Embodiment (Walking Beam/Dual-Lane Conveyor) |
|---|---|---|
| Filling time | 1.5 seconds | 1.5 seconds |
| Nozzle movement time (*) | 0.5 seconds | 0.5 seconds |
| Walking beam return time (**) | 1.0 seconds | 0.5 seconds |
| Total cycle time | 3.0 seconds | 2.5 seconds |
| No. of filling cycles/ minute | 20 | 24 |
| Overall production rate | 240 containers/minute | 288 containers/minute |

(*) Along the vertical axis of motion only - horizontal axis motion occurs coincident with the vertical axis motion and the filling time.
(**) The walking beam return time for a system according to a first embodiment is equal to one-half of that for the "typical" system.

Table 4 below compares the operation of a twelve-nozzle, continuous-motion walking beam/single-lane conveyor filling system to that of an alternative embodiment of the present invention (a 24-nozzle walking beam/dual-lane conveyor embodiment) when filling 4 oz., 2" diameter containers using a bottom up nozzle movement.

TABLE 4

| | A "Typical" Walking Beam/Single-Lane Conveyor Filling System (with 12 nozzles) | A Filling System According to an Alternative Embodiment (Walking Beam/Dual-Lane Conveyor w/24 nozzles) |
|---|---|---|
| Filling time | 1.5 seconds | 1.5 seconds |
| Nozzle movement time (*) | 0.5 seconds | 0.5 seconds |
| Walking beam return time (**) | 1.0 seconds | 1.0 seconds |
| Total cycle time | 3.0 seconds | 3.0 seconds |
| No. of filling cycles/minute | 20 | 20 |
| Overall production rate | 240 containers/minute | 480 containers/minute |

(*) Along the vertical axis of motion only-horizontal axis motion occurs coincident with the vertical axis motion and the filling time.
(**) The walking beam return time for a system according to the alternative embodiment is equal to that for the "typical" system.

Figure 16:
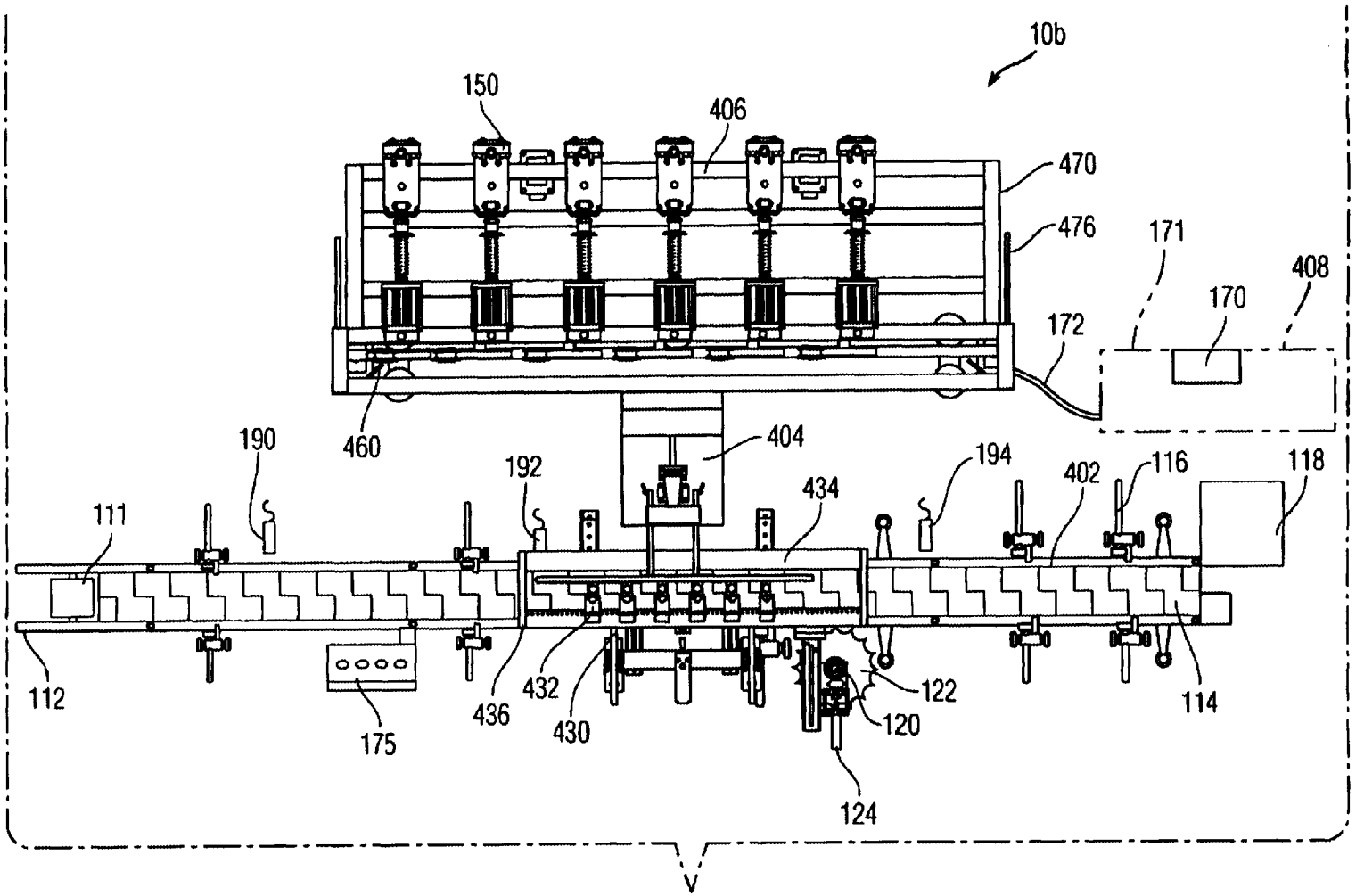
FIG. 16 is a top perspective view of the filling system 10*b* for either Configuration #1 or #2, including the container handling subsystem 402, the nozzle support/metering device drive or nozzle support subsystem 404, the COP trolley or COP trolley/metering device drive subsystem 406, and the controls/utilities subsystem 408 according to an alternative embodiment of the present invention.
Figure 17:
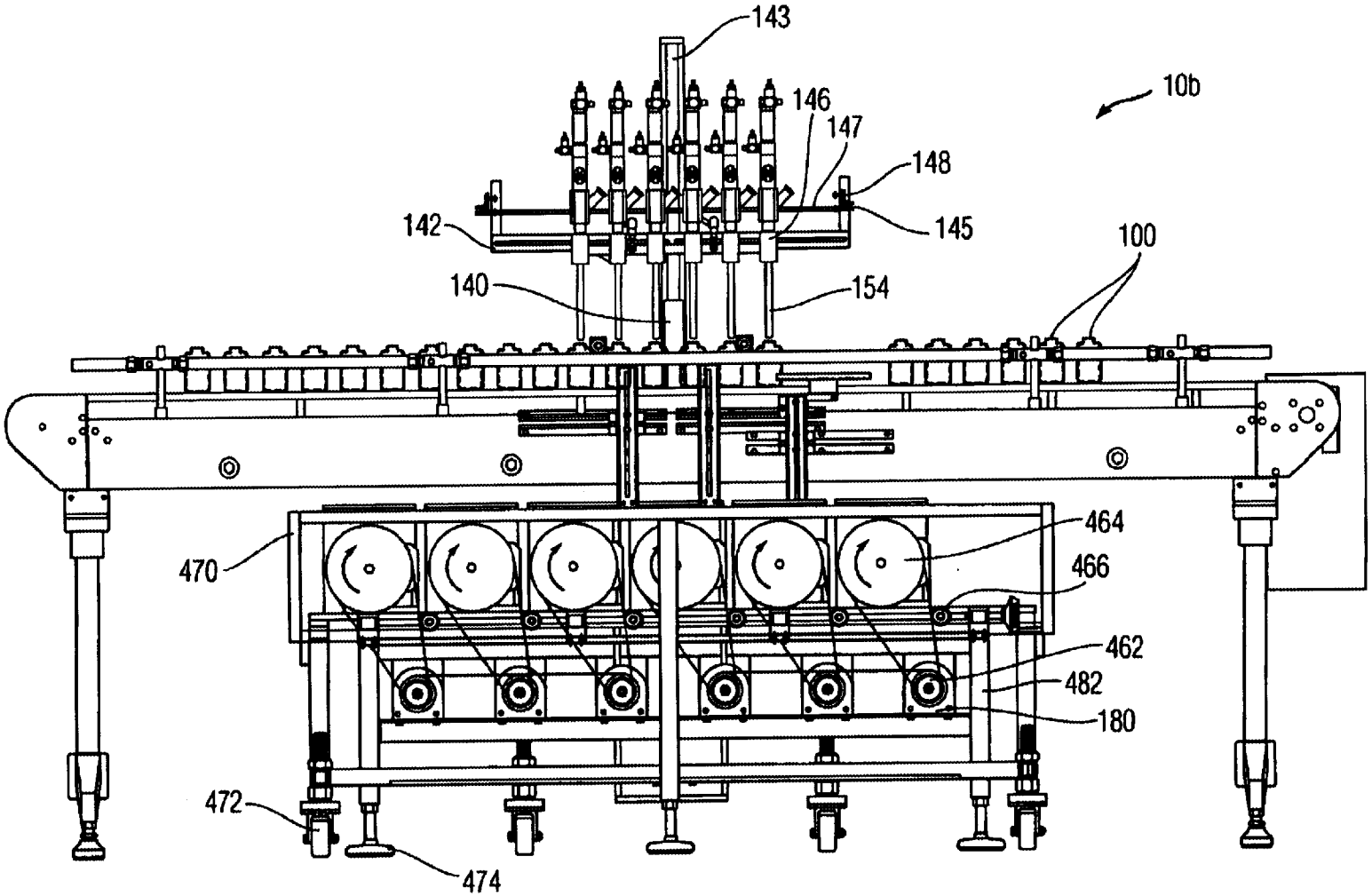
FIG. 17 is a front elevation view of the filling system 10*b* for either Configuration #1 or #2 as in FIG. 16.

FIGS. 16 and 17 are, respectively, top and front perspective views of an overall liquid filling system 10*b* according to yet another embodiment of the present invention. This alternative embodiment adds certain clean-out-of-place (COP) features to the embodiment discussed with respect to FIGS. 3–6 to facilitate the cleaning of the product contact parts. This embodiment is a modular system that includes a container handling subsystem 402, the nozzle support/metering device drive (or nozzle support) subsystem 404, a COP trolley (or COP trolley/metering device drive) subsystem 406, and the controls/utilities subsystem 408. The container handling subsystem 402 carries the containers 100 through the filling zone and positions them for the entry of the filling nozzles 154. The nozzle support/metering device drive (or nozzle support) subsystem 404 moves the nozzles 154 up and down (or, into and out of the containers 100). The COP trolley (or COP trolley/metering device drive) subsystem 406 contains the elements of the filling system 10*b* required to supply (e.g. holding tank), measure (e.g. metering devices), and dispense (e.g. nozzles 154) the liquid product. The controls/utilities subsystem 408 includes the electrical and pneumatic components (e.g. programmable logic control device 170, solenoid valves, motor starters) required to control the overall operation of the filling system 10*b*.

The single-lane conveyor assembly 111, the length and width of which may be varied to suit the needs of the application, preferably includes a stainless steel conveyor bed 112, low friction conveyor chain 114, adjustable container guide rails 116, and a variable speed, DC motor drive 118, all of which are readily available commercial parts.

Container indexing through the filling process is preferably accomplished using a star wheel indexing mechanism 120 that includes a freely rotating starwheel 122 and a starwheel stop mechanism 124 (see the detailed discussion of its operation above with respect to FIGS. 3–6).

A bottom up fill mechanism 140 is generally utilized to position the nozzles 154 at the bottoms of the containers at the start of the fill cycle before slowly withdrawing them as the liquid fills the container. The bottom up fill mechanism 140 is equipped with a pneumatic/hydraulic drive cylinder (not shown in FIGS. 16 and 17), a vertical motion guide assembly 143, and a nozzle mounting bracket 142 (see the detailed discussion of its operation above with respect to FIGS. 3–6).

Also as described with respect to FIGS. 3–6, a nozzle safety device 145 is used to prevent damage to the nozzles 154 by detecting any obstacles (e.g. a disfigured or undersized container neck opening, a cap that has been placed on the container) that might prevent the nozzles 154 from entering the containers in the normal fashion. The device 145 includes nozzle holding blocks 146, a nozzle movement detection bar 147, and a proximity sensor 148.

Figure 22:
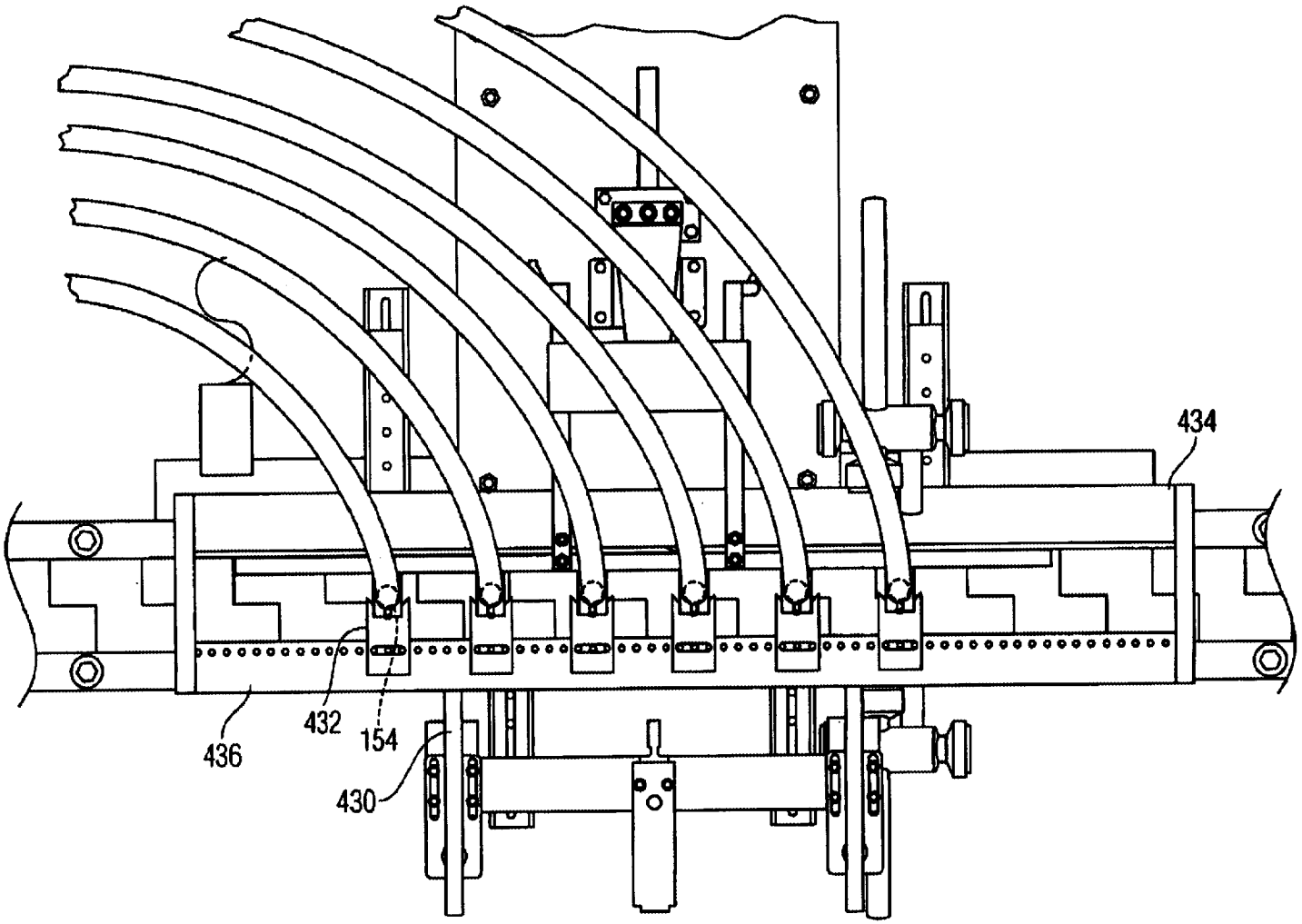
FIG. 22 is a top, close up view of the filling area of the liquid filling system 10*b* as in FIG. 16 showing the nozzle/container alignment mechanism 430.

As shown in FIG. 22's close up view of the filling area, a nozzle/container alignment mechanism 430, complete with a number of container locators 432 equal to the number of nozzles 154, is included. This alignment mechanism 430 locates the containers 100 and centers the nozzles 154 in their neck openings before the nozzles 154 attempt to enter the containers 100. As can be seen in FIG. 16, the alignment mechanism 430 includes a pneumatically actuated bar 436 on which are mounted, at center distances equal to those for the nozzles 154, a series of V-shaped container locators 432. This mechanism 430 also includes a drip tray assembly 434. The drip tray 434 is positioned between the nozzles 154 and the containers 100 during the indexing cycle to prevent any product from dripping on the outside of the moving containers 100. During the fill cycle, drip tray 434 moves aside so that the nozzles 154 can enter the containers 100.

In the embodiment illustrated in FIGS. 16 and 17, a number of variable speed, DC or servo motor-operated liquid metering device drive stations 180 are mounted on the nozzle support/metering device drive subsystem frame 482 (Configuration #1). Alternatively, the DC or servo motor-operated liquid metering device drive stations 180 can be mounted on COP trolley/metering device drive subsystem frame 470 (see Configuration #2 discussed below). When DC motors are utilized, 1-hp. units are generally provided. When servomotors are utilized, they generally possess a continuous power rating of 1.2 hp., 0.9 kW. Either drive assembly allows an operator to adjust the fill volume via the touchscreen located on the operator interface. This dramatically reduces the overall amount of time required to change from one fill volume to another across the multiple metering device drive stations 180.

In Configuration #1, the nozzle support/metering device drive subsystem 404 is a free standing unit consisting of a welded, stainless steel frame 482 with stainless steel panels where appropriate, and built-in jack screws 474 for leveling the assembly. An OSHA-compliant guard assembly 476 encloses the subsystem's moving components.

A number of liquid metering devices 150 typically equal to the number of metering device drive stations 180, and a product tank/manifold assembly (not shown in FIGS. 16 and 17) with a similar number of discharge ports may be mounted on the COP trolley frame 470 of Configuration #1. Each metering device 450 is preferably connected to a metering device drive station 480 via a belt drive arrangement 462. As an alternative to the belt drive arrangements, any method (e.g. gears, sprockets and chains) of translating the fluid displacement motion of the drive stations 180 to the metering devices 150 could be utilized. Each metering device 150 is equipped with a nozzle 154, intake tubing, and discharge tubing. All metal product contact parts are fabricated of type 316 stainless steel, type 316L stainless steel, or other suitable materials. The COP trolley subsystem 406 of Configuration #1 is a free-standing unit consisting of a welded, stainless steel frame 470 with stainless steel panels where appropriate, casters 472, and built-in jack screws 474 for raising the casters off of the floor. The frame 470 also includes means for supporting the nozzles 154 in a manner and orientation such that no product drips from them. An OSHA-compliant guard assembly 476 encloses the subsystem's moving components. The frame 470 may be a self-propelled assembly via powered (e.g. battery) drive wheels in place of the casters 472, or frame 470 may be hitched to a separate powered cart to move it about. Each COP trolley subsystem 406 possesses identification means allowing the control/utilities subsystem 408 to differentiate any specific subsystem 406 from all other COP trolley subsystems 406. The identification means may be a conventional bar-code scanner coupled to the control/utilities subsystem 408 to differentiate on the basis of printed bar codes.

Figure 18:
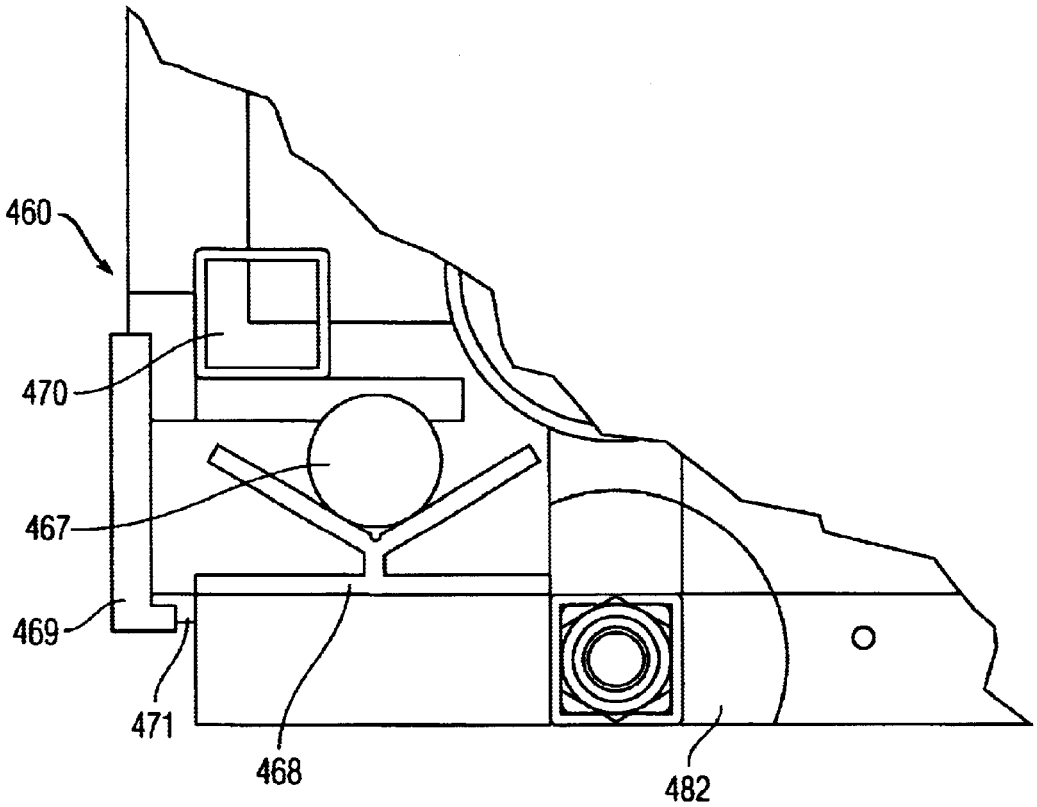
FIG. 18 is a top perspective view of the COP trolley docking and alignment mechanism 460 for Configuration #1 according to an alternative embodiment of the present invention.

In Configuration #1, the COP trolley subsystem 406 is designed for rapid coupling with (and de-coupling from) the nozzle support/metering device drive subsystem 404. The frames of the two subsystems possess a docking and alignment mechanism 460 designed to accommodate the belt drive connections 462 between the metering device drive stations 180 and the metering devices 150. As shown in FIG. 18's close up view of the docking and alignment mechanism 460, the cylindrical alignment rod 467 is mounted vertically on the COP trolley subsystem frame 470. The V-shaped alignment channel 468 is mounted vertically on the nozzle support/metering device drive subsystem frame 482. A latch action clamping device 469 (shown in the closed position) is mounted on the COP trolley subsystem frame 470 with the matching catch 471 attached to the base of the V-shaped alignment channel 468. The rapid coupling and horizontal alignment of the COP trolley subsystem 406 with the nozzle support/metering device drive subsystem 404, required for the connection of the metering device drive stations 180 to the metering devices 150, is accomplished when the alignment rod 467 is positioned at the bottom, or center, of the alignment channel 468 and the clamping device 469 is closed against the catch 471. Any vertical alignment that might be required between the frames of the two subsystems is accomplished by an adjustment of the jack screws 474.

In Configuration #2, the nozzle support subsystem 404 is a free-standing unit consisting of a welded, stainless steel frame 482 with stainless steel panels where appropriate, and built-in jack screws 474 for leveling the assembly. An OSHA-compliant guard assembly 476 encloses the subsystem's moving components.

A number of liquid metering devices 150 (e.g. lobe pumps, gear pumps, piston pumps, peristaltic pumps, flow meters, time/pressure filling heads), a product tank/manifold assembly with a similar number of discharge ports, and, where appropriate, an equal number of metering device drive stations 180 are mounted on the COP trolley/metering device drive frame 470 in Configuration #2. Where appropriate, each metering device 150 is preferably connected to a metering device drive station 180 via a belt drive arrangement 462. As an alternative to the belt drive arrangements, any method (e.g. gears, sprockets and chains, direct couplings) of translating the fluid displacement motion of the drive stations 180 to the metering devices 150 could be utilized. Each metering device 150 is equipped with a nozzle 154, intake tubing, and discharge tubing. All metal product contact parts are fabricated of type 316 stainless steel, type 316L stainless steel, or other suitable materials.

The COP trolley/metering device drive subsystem 406 of Configuration #2 is a free-standing unit consisting of a welded, stainless steel frame 470 with stainless steel panels where appropriate, casters 472, and built-in jack screws 474 for raising the casters off of the floor. The frame 470 also includes means for supporting the nozzles 154 in a manner and orientation such that no product drips from them. An OSHA-compliant guard assembly 476 encloses the subsystem's moving components. The frame 470 may be a self-propelled assembly via powered (e.g. battery) drive wheels in place of the casters 472, or a separate powered cart may be utilized to move it about. Each COP trolley subsystem 406 possesses identification means allowing the control/utilities subsystem 408 to differentiate any specific subsystem 406 from all other COP trolley subsystems 406.

In Configuration #2, the docking and alignment mechanism 460 is unnecessary because both the metering devices 150 and, where appropriate, the metering device drive stations 180 are mounted on the COP trolley/metering device drive frame 470. Also, unlike Configuration #1 where, due to their connection via docking/alignment mechanism 460, the nozzle support/metering device drive subsystem 404 and the COP trolley subsystem 406 must be located on the same side of the container handling subsystem 402 (as shown in FIG. 16), Configuration #2, if dictated by the requirements of the production environment, allows the nozzle support subsystem 404 and the COP trolley/metering device drive subsystem 406 to be located on opposite sides of the container handling subsystem 402.

The electrical control system is designed for operation on 220 volt, 60 hz., three-phase service. The pneumatic system requires clean, dry compressed air at 80 psi. The controls/utilities subsystem 408 (including the programmable logic control device 170, see FIG. 16) is typically housed in a remote, NEMA 12 stainless steel enclosure 171 connected to the balance of the overall filling system 10*b* via flexible conduit 172. The controls/utilities subsystem 408 includes, among others, the following components/features:

A programmable logic control device 170 and an operator interface 175 are generally provided to control the operation of the overall filling system. The programmable logic control device 170 is connected to the variable speed drive 118 in order to control the linear velocity of the dual-lane conveyor assembly 111. The programmable logic control device 170 is also connected to the stop mechanism 124 in order to control the operation of the container indexing mechanism 120. The programmable logic control device 170 is also connected to the pneumatically actuated bar 436 in order to control the operation of the nozzle/container alignment mechanism 430. The programmable logic control device 170 is also connected to the drive cylinder in order to control the operation of the nozzle motion/mounting devices (e.g. the bottom up fill mechanism 140). The programmable logic control device 170 is also connected to each of the drive stations 180 (or, when drive stations 180 are not required/included, directly to each of the metering devices 150) in order to control the operating speed and displacement of the metering devices 150. The programmable logic control device 170 is also connected to the remote cleaning system 450 in order to download the cleaning system 450 operating characteristics/parameters required by the COP trolley subsystem 406 that is to be subjected to the cleaning process. The interface 175 is programmed to step the operator through the filling system's set-up/changeover process and to assist with system fault condition diagnosis.

Referring back to FIG. 16, a no bottle/no fill sensor 190, a fallen container sensor 192, and an anti-back-up sensor 194 are included. Each are connected to the programmable logic control device 170 (see the detailed discussion of their operation above with respect to FIGS. 3–6).

Figure 19:
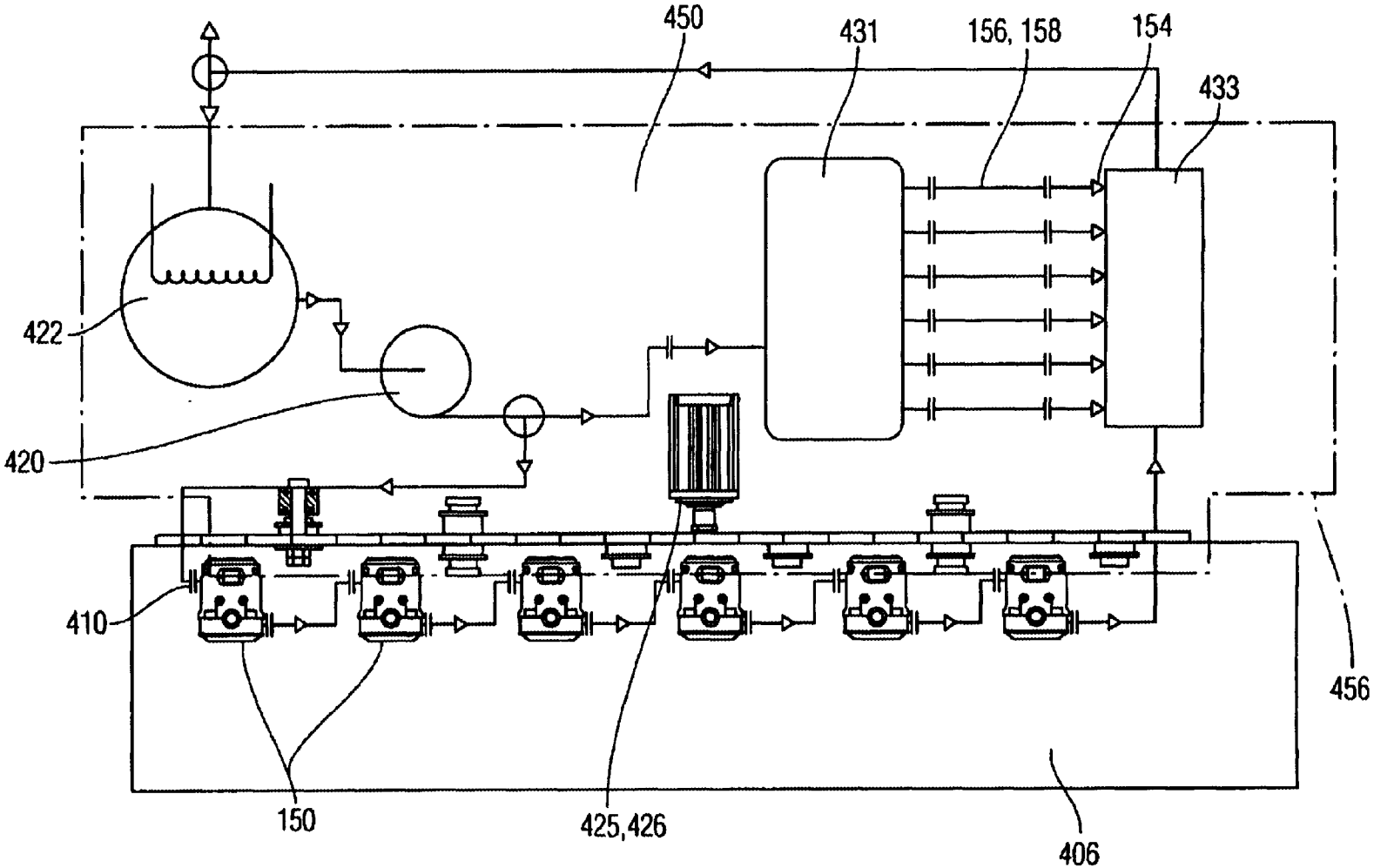
FIG. 19 is a top perspective view of the COP trolley subsystem 406 and the remote cleaning subsystem 450 for Configuration #1 according to an alternative embodiment of the present invention.
Figure 20:
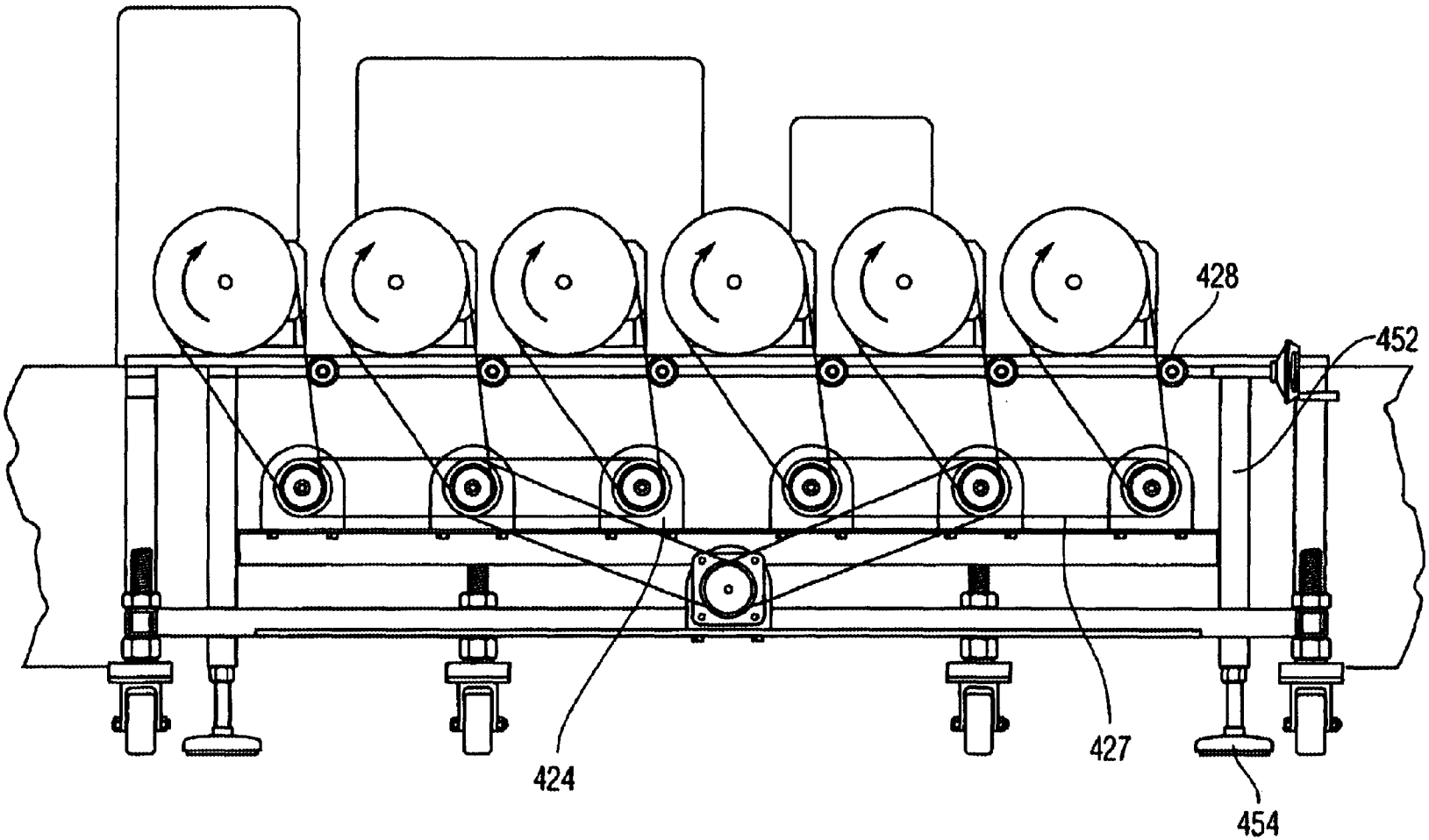
FIG. 20 is a front elevation view of the COP trolley subsystem 406 and the remote cleaning subsystem 450 for Configuration #1 as in FIG. 19.
Figure 21:
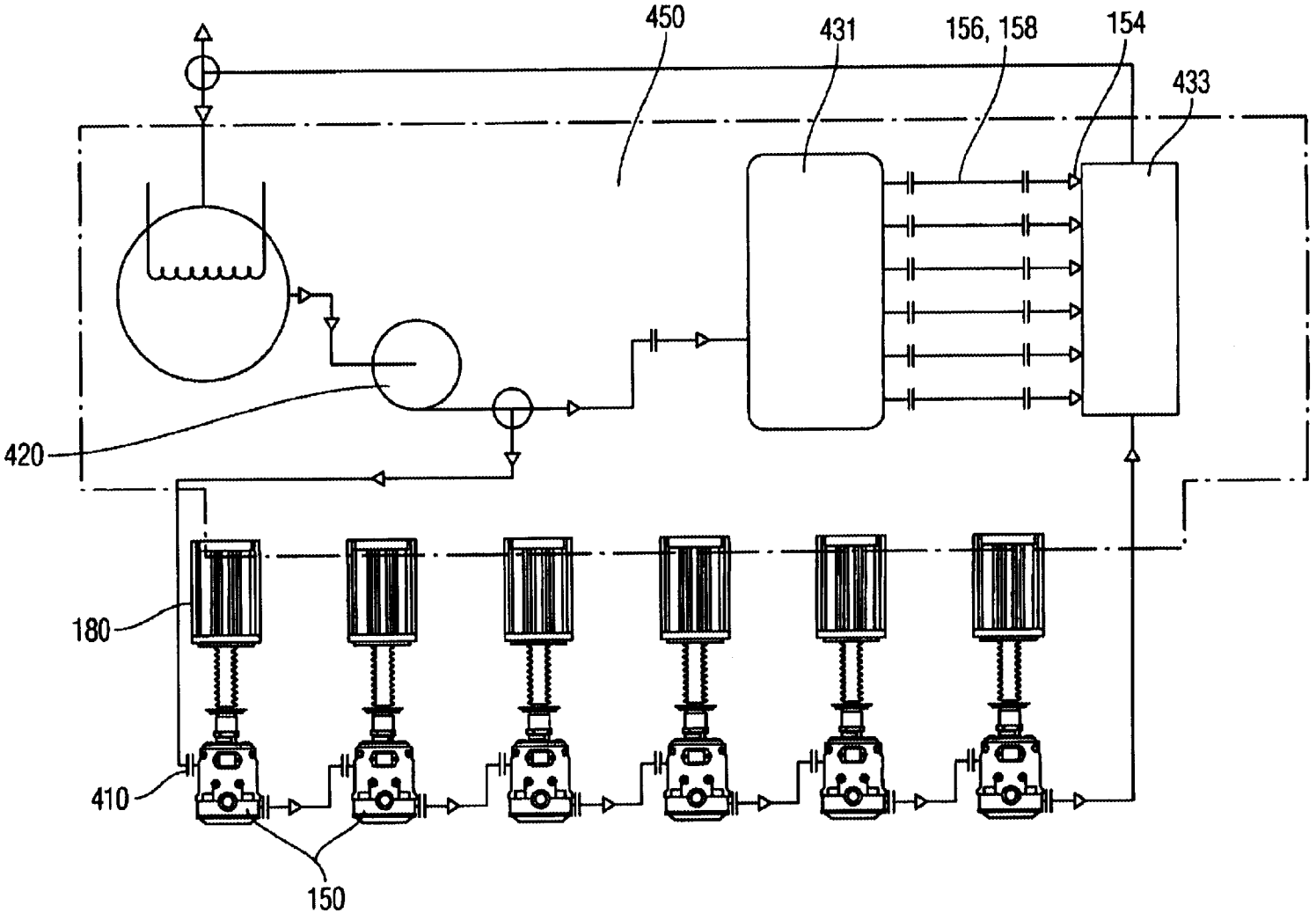
FIG. 21 is a top perspective view of the COP trolley/metering device drive subsystem 406 and the remote cleaning subsystem 450 for Configuration #2 according to an alternative embodiment of the present invention.

With reference to FIGS. 19–21, a clean-out-of-place changeover cycle involves a remote cleaning subsystem 450 and, typically, two COP trolley or COP trolley/metering device drive subsystems 406; one with "dirty" product contact parts (e.g. metering devices 150, a product tank/manifold assembly, nozzles 154, intake tubing 156, and discharge tubing 158) that have just been utilized to complete a production run, and one with "clean" product contact parts that will be used for the next production run (or, in other words, one set of contact parts that can be cleaned while the second is used in the production environment). An overall filling system 10*b* of this nature requires a quick changeover of product contact parts and this embodiment of the present invention satisfies this requirement with a maximum changeover time of fifteen (15) minutes or less.

A filling system 10*b* according to this alternative embodiment can be supplied with any number of COP trolley or COP trolley/metering device drive subsystems 406. A filling system 10*b* with a single COP trolley or COP trolley/metering device drive subsystem 406 may still utilize the benefits of the remote cleaning subsystem 450. Alternatively, multiple filling systems (i.e. parallel production lines) equipped with a total of three or more COP trolley or COP trolley/metering device drive subsystems 406, and located within the same production environment, can utilize a single remote cleaning subsystem 450 to meet their needs for periodic cleaning.

The remote cleaning subsystem 450 (designed for rapid coupling with, and de-coupling from, the COP trolley subsystem 406 of Configuration #1, or use with the COP trolley/metering device drive subsystem 406 of Configuration #2) includes a fluid reservoir 422 sized to meet the needs of the specific application, a pump assembly or pressure feed system 420 to circulate the cleaning fluid through the product contact parts, a cleaning fluid supply manifold 431, a cleaning fluid collection manifold 433, and, where appropriate, a multi-station liquid metering device drive assembly 424. When a multi-station liquid metering device drive assembly 424 is required, it is positioned within the remote cleaning subsystem frame 452. This drive assembly 424 preferably consists of a 2½ hp., fixed speed electric motor 425 (the horsepower specification for the motor is application specific) coupled to a gearbox 426 and a belt drive arrangement 427 to provide the required movement of the metering devices 150 during the cleaning cycle. As an alternative to the belt drive arrangement, any method (e.g. gears, sprockets and chains) of distributing the rotational motion of the motor 425 and gearbox 426 to the drive shafts of the metering device drive assembly 424 could be utilized. The remote cleaning subsystem 450 is a free-standing unit consisting of a welded, stainless steel frame 452 with stainless steel panels where appropriate, and built-in jack screws 454 for leveling the assembly. An OSHA-compliant guard assembly 456 encloses the subsystem's moving components.

To begin a COP changeover cycle in Configuration #1, the metering devices 150 are disconnected from the belt drives 462 (the pulleys 464 mounted on the metering device drive shafts remain with the metering devices 150). The belt tensioners 466 must be loosened to perform this function. This disconnection process can be accomplished in a manual or an automated fashion. After disengaging the COP trolley subsystem frame 470 from the nozzle support/metering device drive subsystem frame 482 at the docking and alignment mechanism 460, the trolley 406 with the "dirty" product contact parts is rolled to the area where the remote cleaning subsystem 450 is located and physically connected to that unit. The second trolley subsystem 406 (the one with the "clean" product contact parts) is then moved into position next to the nozzle support/metering device drive subsystem 404 and physically connected via the docking and alignment mechanism 460. Once the pulleys 464 attached to the "clean" metering devices 150 have been connected with the belt drives 462 and the belt tensioners 466 are adjusted (once again, either a manual or automated process), and the operating characteristics associated with the second trolley have been downloaded within the programmable logic control device 170, the overall filling system 10*b* is ready to begin the next production run.

While the second trolley subsystem 406 is being used in production, the first one is subjected to the "Clean-Out-of-Place" process.

FIG. 19 is a top perspective view and FIG. 20 is a front elevation view of the COP trolley and remote cleaning subsystems according to Configuration #1 of the present invention. The physical connection between the COP trolley subsystem 406 with the "dirty" product contact parts, and the remote cleaning subsystem 450 is a two-stage process.

First, the frames of the two subsystems are connected via a docking and alignment mechanism 460 designed to accommodate the belt drive connections 462 between the multi-station metering device drive assembly 424 and the metering devices 150. As shown in FIG. 18, the cylindrical alignment rod 467 is mounted vertically on the COP trolley subsystem frame 470. The V-shaped alignment channel 468 is mounted vertically on the remote cleaning subsystem frame 452. A latch action clamping device 469 (shown in the closed position) is mounted on the COP trolley subsystem frame 470 with the matching catch 471 attached to the base of the V-shaped alignment channel 468. The rapid coupling and horizontal alignment of the COP trolley subsystem 406 with the remote cleaning subsystem 450, required for the connection of the multi-station metering device drive assembly 424 to the metering devices 150, is accomplished when the alignment rod 467 is positioned at the bottom, or center, of the alignment channel 468 and the clamping device 469 is closed against the catch 471. Any vertical alignment that might be required between the frames of the two subsystems is accomplished by an adjustment of the jack screws 474. After the frames of the COP trolley and remote cleaning subsystems have been coupled and aligned, the metering devices 150 are attached to the multi-station drive assembly 424. This is accomplished by connecting the pulleys 464 mounted on the metering device drive shafts with the belt drives 427 on the multi-station drive assembly 424 and adjusting the belt tensioners 428. The connection steps outlined above can be performed in a manual or an automated fashion.

Once the metering devices 150 have been attached to the multi-station drive assembly 424, the second stage of the physical connection process, one that is performed in a manual fashion, can be completed. As indicated in FIG. 19, the inlet and outlet ports of the metering devices 150 are preferably connected in series via an appropriate type of connection 410 (e.g. Triclover® sanitary connections). The first metering device 150 in the series is connected to the remote cleaning subsystem's fluid circulating pump/pressure feed system 420. An alternative structure for connecting the metering devices 150 with the circulating pump/pressure feed system 420 is a parallel arrangement similar to that described below for the nozzles 154 and tubing 156, 158. A second cleaning loop is utilized for the nozzles 154, intake tubing 156, and discharge tubing 158. The circulating pump/pressure feed system 420 is connected in parallel to the nozzles 154, intake tubing 156, and discharge tubing 158 via a cleaning fluid supply manifold 431. The last metering device 150 in the series and each of the nozzles 154 are connected to the fluid collection manifold 433. Once all of the necessary connections have been made, the multi-station metering device drive assembly 424 is actuated to operate the metering devices 150 as the pump/pressure feed system 420 circulates the cleaning fluid through all of the "dirty" components. The used fluid is retained within the remote cleaning subsystem 450 for recycling or disposal. A number of the remote cleaning subsystem's operating parameters (e.g. fluid temperature/pressure/flow rate, time required for the cleaning cycle) can be adjusted to the specific requirements of each application. After the completion of the remote subsystem's cleaning cycle, the metering devices 150, nozzles 154, intake tubing 156, and discharge tubing 158 are disconnected from the circulating pump/pressure feed system 420, the cleaning fluid manifold 431, and the fluid collection manifold 433. The metering devices 150 are then disconnected from the multi-station metering device drive assembly 424 and the two frames are disengaged at the docking/alignment mechanism 460 (once again, either manual or automated processes). The first COP trolley subsystem 406 is now "clean" and ready to replace the second subsystem 406 at the start of a new production run.

In Configuration #2, a COP changeover cycle begins by manually disconnecting the COP trolley/metering device drive subsystem frame 470 from the nozzle support subsystem frame 482. The COP trolley/metering device drive subsystem 406 with the "dirty" product contact parts is rolled to the area where the remote cleaning subsystem 450 is located and physically connected to that unit. The second COP trolley/metering device drive subsystem 406 (the one with the "clean" product contact parts) is then moved into position next to the nozzle support subsystem 404 and physically connected in order to begin the next production run once the operating characteristics associated with the second trolley have been downloaded within the programmable logic control device 170.

While the second COP trolley/metering device drive subsystem 406 is being used in production, the first one is subjected to the "Clean-Out-of-Place" process. FIG. 21 is a top perspective view of the COP trolley/metering device drive and remote cleaning subsystems according to Configuration #2 of the present invention. The physical connection between the COP trolley/metering device drive subsystem 406 with the "dirty" product contact parts, and the remote cleaning subsystem 450 requires only one manual step.

As indicated in FIG. 21, the inlet and outlet ports of the metering devices 150 are preferably connected in series via an appropriate type of connection 410 (e.g. Triclover® sanitary connections). The first metering device 150 in the series is connected to the remote cleaning subsystem's fluid circulating pump/pressure feed system 420. An alternative structure for connecting the metering devices 150 with the circulating pump/pressure feed system 420 is a parallel arrangement similar to that described below for the nozzles and tubing. A second cleaning loop is utilized for the nozzles 154, intake tubing 156, and discharge tubing 158. The circulating pump/pressure feed system 420 is connected in parallel to the nozzles 154, intake tubing 156, and discharge tubing 158 via a cleaning fluid supply manifold 431. The last metering device 150 in the series and each of the nozzles 154 are connected to the fluid collection manifold 433. Where appropriate, once all of the necessary connections have been made, the metering device drive stations 180 are actuated to operate the metering devices 150 as the pump/pressure feed system 420 circulates the cleaning fluid through all of the "dirty" components (metering devices 150 that do not require drive stations 180 are cleaned solely by the fluid circulating process created by pump/pressure feed system 420). The used fluid is retained within the remote cleaning subsystem 450 for recycling or disposal. A number of the remote cleaning subsystem's operating parameters (e.g. fluid temperature/pressure/flow rate, time required for the cleaning cycle) can be adjusted to the specific requirements of each application. After the completion of the remote subsystem's cleaning cycle, the metering devices 150, nozzles 154, intake tubing 156, and discharge tubing 158 are disconnected from the circulating pump/pressure feed system 420, the cleaning fluid manifold 431, and the fluid collection manifold 433. The first COP trolley subsystem 406 is now "clean" and ready to replace the second subsystem 406 at the start of a new production run.

Figure 23:
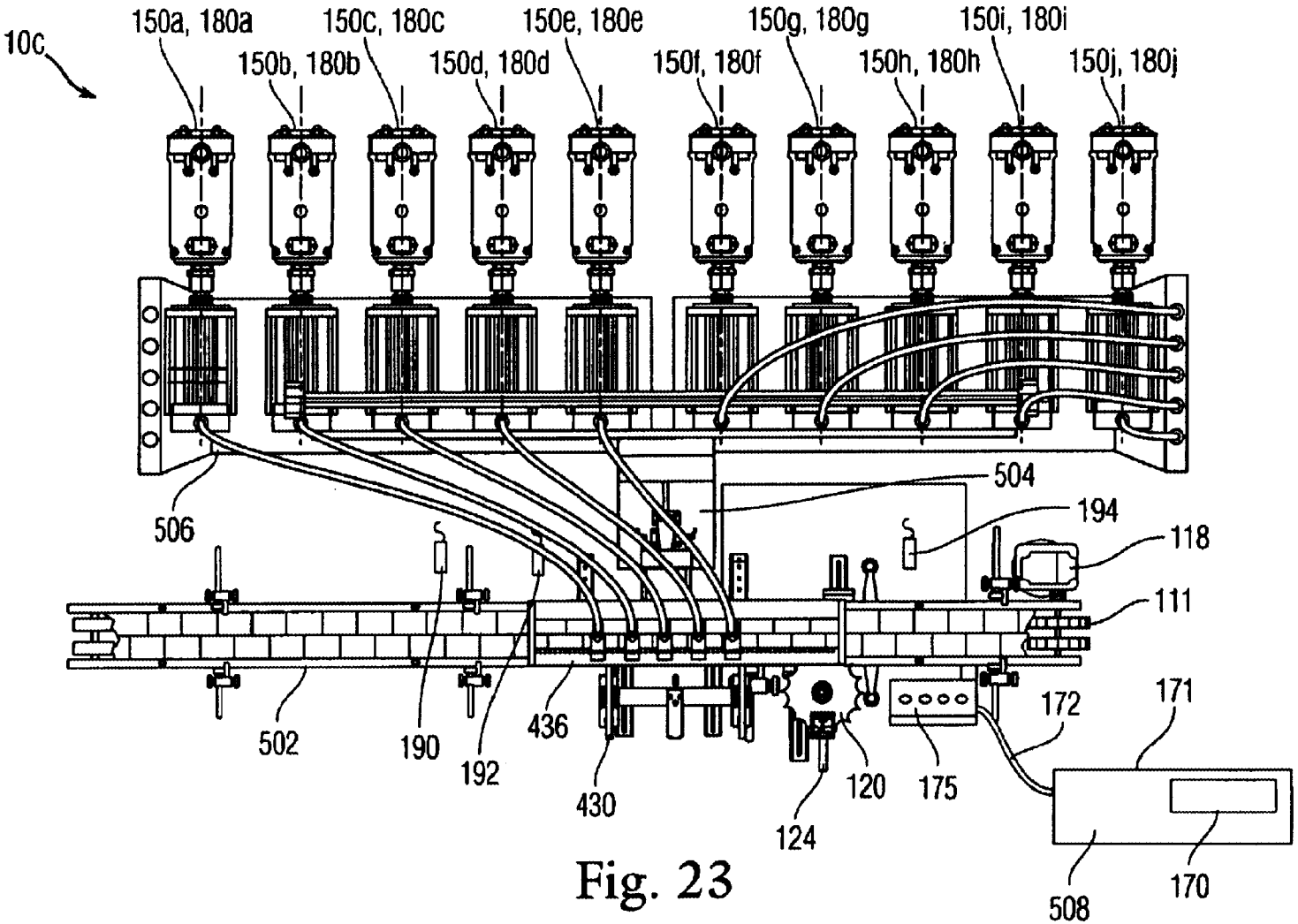
FIG. 23 is a top perspective view of the filling system 10*c* including a container handling subsystem 502, a nozzle support subsystem 504, a metering device/multi-station drive subsystem 506, and a controls/utilities subsystem 508 according to another alternative embodiment of the present invention.
Figure 24:
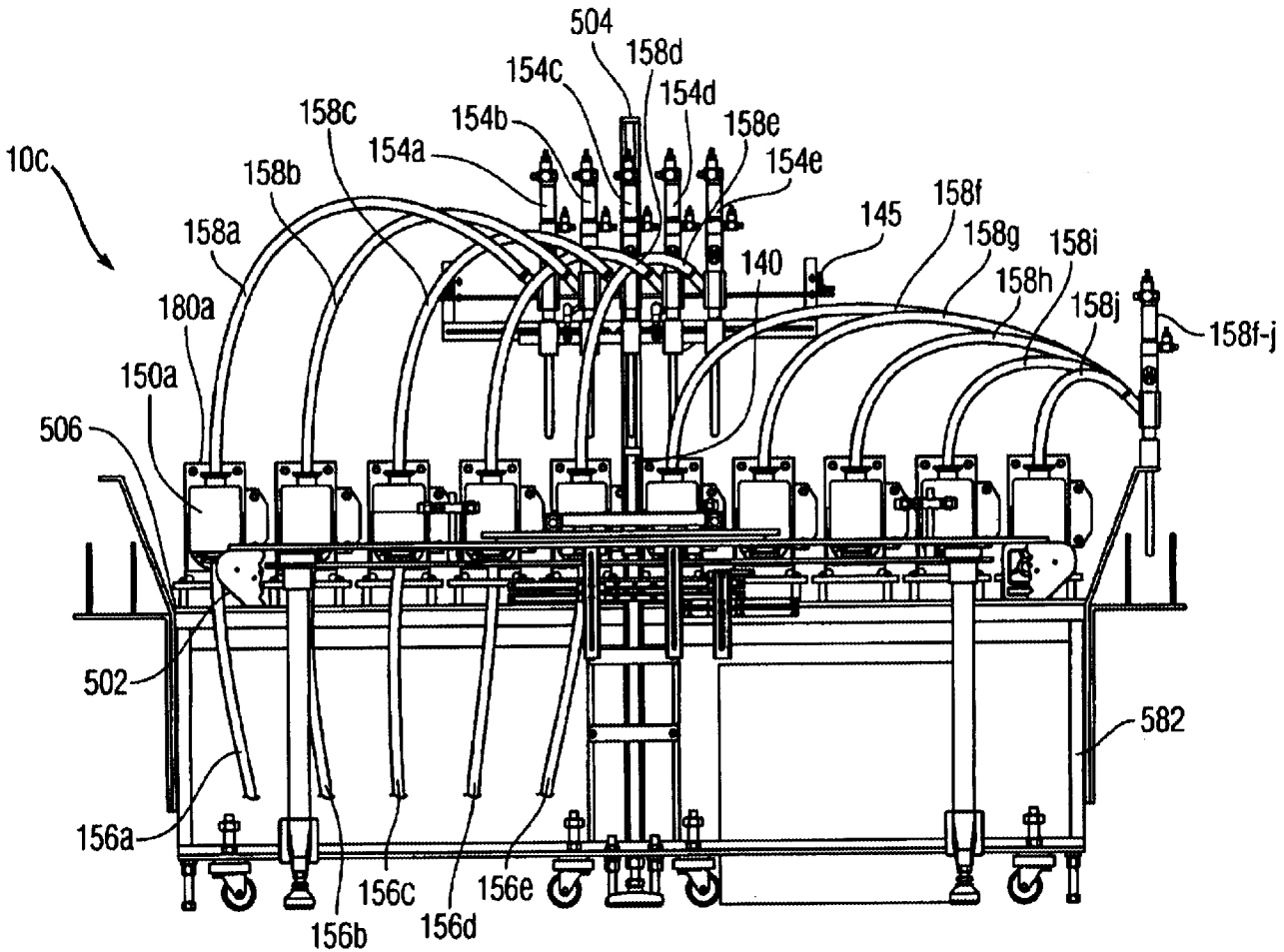
FIG. 24 is a front elevation view of the filling system 10*c* as in FIG. 23.
Figure 25:
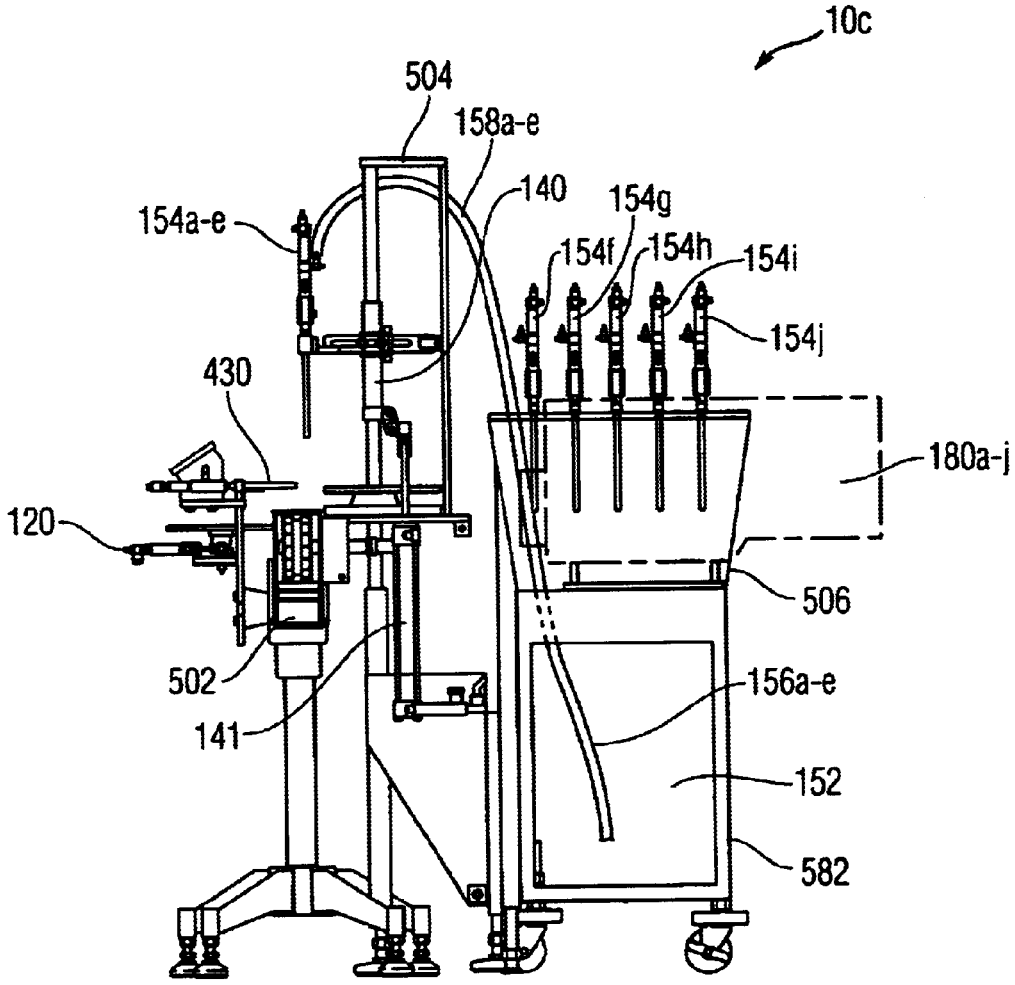
FIG. 25 is a side elevation view of the filling system 10*c* as in FIGS. 23 and 24.

FIGS. 23–25 are, respectively, top, front, and side perspective views of the overall liquid filling system 10*c* according to another embodiment of the present invention. This alternative embodiment adds clean-in-place (CIP) capability to the embodiment discussed with respect to FIGS. 3–6 to facilitate the cleaning of the product contact parts. This embodiment is a modular system that includes a container handling subsystem 502, a nozzle support subsystem 504, a metering device/multi-station drive subsystem 506, and a controls/utilities subsystem 508. The container handling subsystem 502 carries the containers 100 through the filling zone and positions them for the entry of the filling nozzles 154*a–e*. The nozzle support subsystem 504 moves the nozzles 154*a–e* up and down (or, into and out of the containers 100). The metering device/multi-station drive subsystem 506 contains the elements of the filling system 10*c* required to supply (e.g. holding tank 152), measure (e.g. metering devices 150*a–j*), and dispense (e.g. nozzles 154*a–j*) the liquid product. The controls/utilities subsystem 508 includes the electrical and pneumatic components (e.g. programmable logic control device 170, solenoid valves, motor starters) required to control the overall operation of the filling system 10*c*.

The single-lane conveyor assembly 111, the length and width of which may be varied to suit the needs of the application, preferably includes a stainless steel conveyor bed, low friction conveyor chain, adjustable container guide rails, and a variable speed, DC motor drive, all of which are readily available commercial parts.

Container indexing through the filling process is preferably accomplished using a star wheel indexing mechanism 120 that includes a freely rotating starwheel and a starwheel stop mechanism.

A bottom up fill mechanism 140 is generally utilized to position the nozzles 154*a–e* at the bottoms of the containers at the start of the fill cycle before slowly withdrawing them as the liquid fills the container. The bottom up fill mechanism 140 is equipped with a pneumatic/hydraulic drive cylinder, a vertical motion guide assembly, and a nozzle mounting bracket.

Typically, as shown in FIGS. 23–25, a single nozzle motion/mounting device (e.g. bottom up fill mechanism 140), positioned near the center (lengthwise) of the main frame 582 (which is also the center position relative to all of the metering devices 150*a–j* and drive stations 180*a–j*), is sufficient to achieve the goals of this CIP alternative embodiment.

A nozzle safety device 145 is used to prevent damage to the nozzles 154*a–e* by detecting any obstacles (e.g. a disfigured or undersized container neck opening, a cap that has been placed on the container) that might prevent the nozzles 154*a–e* from entering the containers in the normal fashion.

The device 145 includes nozzle holding blocks, a nozzle movement detection bar, and a proximity sensor.

A nozzle/container alignment mechanism 430, complete with a pneumatically actuated bar, a drip tray assembly, and a number of container locators equal to the number of nozzles 154*a–e*, is included. This alignment mechanism 430 locates the containers 100 and centers the nozzles 154*a–e* in their neck openings before the nozzles 154*a–e* attempt to enter the containers 100.

A number of liquid metering devices 150*a–j* (e.g. lobe pumps, gear pumps, piston pumps, peristaltic pumps, flow meters, time/pressure filling heads), a product tank/manifold assembly 152, and, where appropriate, a number of variable speed, DC or servo motor-operated liquid metering device drive stations 180*a–j* are mounted on the main frame 582. Where appropriate, each metering device 150*a–j* is preferably connected to a metering device drive station 180*a–j* via a direct drive coupling arrangement. As an alternative to the direct drive coupling arrangements, any method (e.g. gears, sprockets and chains, belt drives) of translating the fluid displacement motion of the drive stations 180*a–j* to the metering devices 150*a–j* could be utilized. Each metering device 150*a–j* is equipped with a nozzle 154*a–j*, intake tubing 156*a–j*, and discharge tubing 158*a–j*. All metal product contact parts are fabricated of type 316 stainless steel, type 316L stainless steel, or other suitable materials.

The electrical control system is designed for operation on 220 volt, 60 hz., three-phase service. The pneumatic system requires clean, dry compressed air at 80 psi. The controls/utilities subsystem 508 (including the programmable logic control device 170, see FIG. 23) is typically housed in a remote, NEMA 12 stainless steel enclosure 171 connected to the balance of the overall filling system 10*c* via flexible conduit 172. The controls/utilities subsystem 508 includes, among others, the following components/features:

As shown in FIG. 23, a programmable logic control device 170 and an operator interface 175 are generally provided to control the operation of the overall filling system. The programmable logic control device 170 is connected to the variable speed drive 118 in order to control the linear velocity of the dual-lane conveyor assembly 111. The programmable logic control device 170 is also connected to the stop mechanism 124 in order to control the operation of the container indexing mechanism 120. The programmable logic control device 170 is also connected to the pneumatically actuated bar 436 in order to control the operation of the nozzle/container alignment mechanism 430. The programmable logic control device 170 is also connected to the drive cylinder 141 (see FIG. 25) in order to control the operation of the nozzle motion/mounting devices (e.g. the bottom up fill mechanism 140). The programmable logic control device 170 is also connected to each of the drive stations 180*a–j* (or, when drive stations 180*a–j* are not required/included, directly to each of the metering devices 150*a–j*) in order to control the operating speed and displacement of the metering devices 150*a–j*. The interface 175 is programmed to step the operator through the filling system's set-up/changeover process and to assist with system fault condition diagnosis.

With reference to FIG. 23, a no bottle/no fill sensor 190, a fallen container sensor 192, and an anti-back-up sensor 194 are included. Each are connected to the programmable logic control device 170 (see the detailed discussion of their operation above with respect to FIGS. 3–6).

Figure 26:
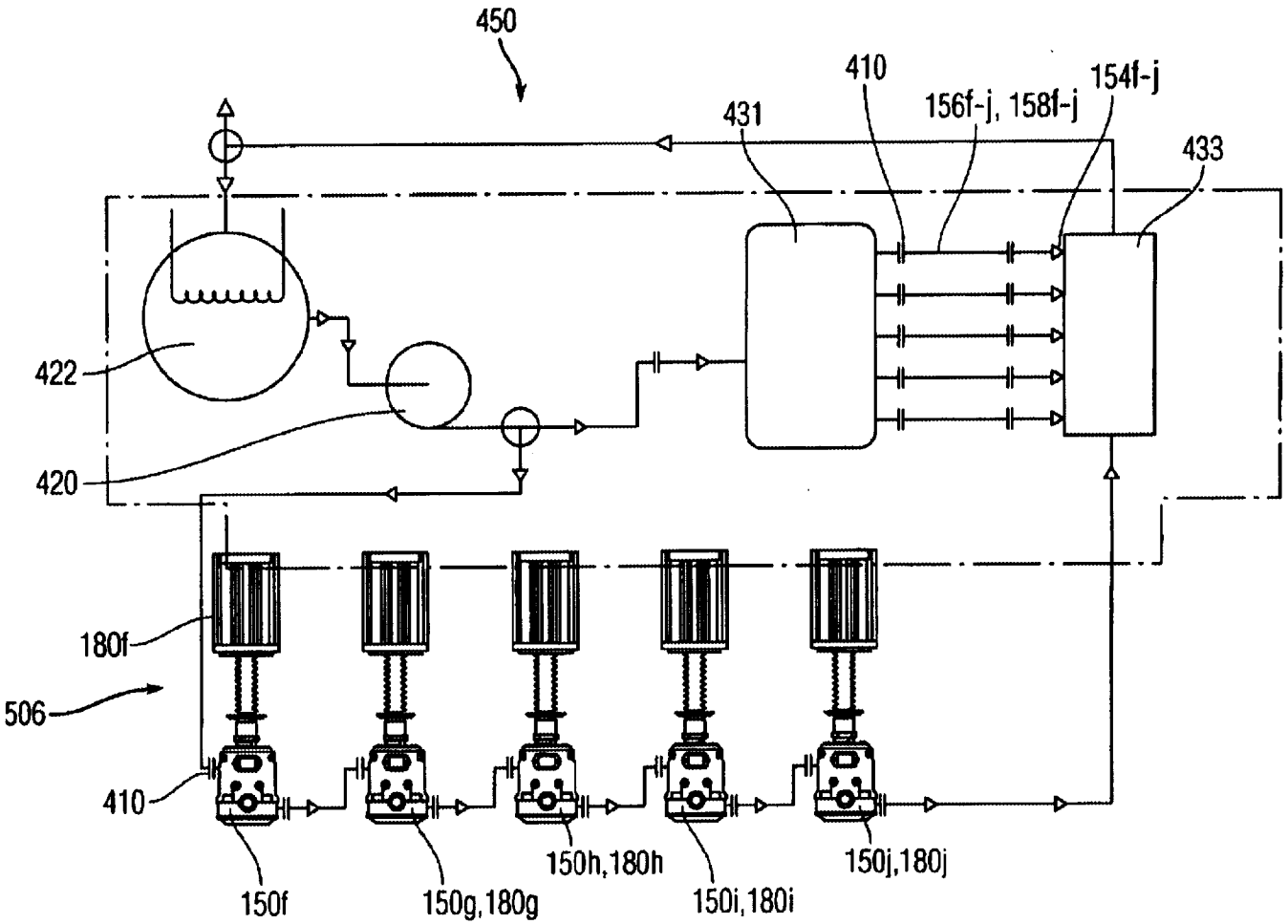
FIG. 26 is a diagramatic representation of the connections between the metering device/multi-station drive subsystem 506 and the cleaning subsystem 550, required to facilitate a cleaning cycle, according to an alternative embodiment of the present invention.

FIG. 26 is a diagramatic representation of the connections between the metering device/multi-station drive subsystem 506 and the cleaning subsystem 450, required to facilitate a cleaning cycle. A Clean-in-Place changeover cycle involves a cleaning subsystem 450 and a metering device/multi-station drive subsystem 506 with "dirty" product contact parts (e.g. metering devices 150*f–j*, a product tank/manifold assembly 152, nozzles 154*f–j*, intake tubing 156*f–j*, and discharge tubing 158*f–j* that have just been utilized to complete a production run). A second set of "clean" product contact parts (e.g. metering devices 150*a–e*, a product tank/manifold assembly 152, nozzles 154*a–e*, intake tubing 156*a–e*, and discharge tubing 158*a–e*) is required for use during the next production run (in other words, two sets of contact parts are needed so that one can be cleaned while the second is used in the production environment). An overall filling system 10*c* of this nature requires a quick changeover of product contact parts and this alternative embodiment of the present invention satisfies this requirement with a maximum changeover time of fifteen (15) minutes or less.

The cleaning subsystem 450 includes a fluid reservoir 422 sized to meet the needs of the specific application, a pump assembly or pressure feed system 420 to circulate the cleaning fluid through the product contact parts, a cleaning fluid supply manifold 431, and a cleaning fluid collection manifold 433. To begin a CIP changeover cycle in a first embodiment of the present invention (where the number of metering devices 150*a–j* is equal to the number of metering device drive stations 180*a–j*), the cleaning cycle requires the establishment of the necessary connections between the cleaning subsystem 450 and the "dirty" set of product contact parts.

While the cleaning process progresses, a second set of "clean" product contact parts is utilized for the next production run.

While the "clean" set of product contact parts is being used in production, the first set is subjected to the "Clean-in-Place" process. The physical connection between the "dirty" product contact parts, and the cleaning subsystem 450 is a manual process.

As indicated in FIG. 26, the inlet and outlet ports of the metering devices 150*f–j* are preferably connected in series via an appropriate type of connection 410 (e.g. Triclover® sanitary connections). The first metering device 150*f* in the series is connected to the cleaning subsystem's fluid circulating pump/pressure feed system 420. An alternative structure for connecting the metering devices 150*f–j* with the circulating pump/pressure feed system 420 is a parallel arrangement similar to that described below for the nozzles and tubing. A second cleaning loop is utilized for the nozzles 154*f–j*, intake tubing 156*f–j*, and discharge tubing 158*f–j*. The circulating pump/pressure feed system 420 is connected in parallel to the nozzles 154*f–j*, intake tubing 156*f–j*, and discharge tubing 158*f–j* via a cleaning fluid supply manifold 431. The last metering device 150*j* in the series and each of the nozzles 154*f–j* are connected to the fluid collection manifold 433.

Where appropriate, once all of the necessary connections have been made, the metering device drive stations 180*f–j* are actuated to operate the metering devices 150*f–j* as the pump/pressure feed system 420 circulates the cleaning fluid through all of the "dirty" components (metering device types that do not require drive station assemblies are cleaned solely by the fluid circulating process created by pump/pressure feed system 420). The used fluid is retained within the cleaning subsystem 450 for recycling or disposal. A number of the cleaning subsystem's operating parameters (e.g. fluid temperature/pressure/flow rate, time required for the cleaning cycle) can be adjusted to the specific requirements of each application. After the completion of the subsystem's cleaning cycle, the metering devices 150*f–j*, nozzles 154*f–j*, intake tubing 156*f–j*, and discharge tubing 158*f–j* are disconnected from the circulating pump/pressure feed system 420, the cleaning fluid manifold 431, and the fluid collection manifold 433. The formerly "dirty" set of product contact parts is now "clean" and ready to replace the second set at the start of a new production run.

Figure 27:
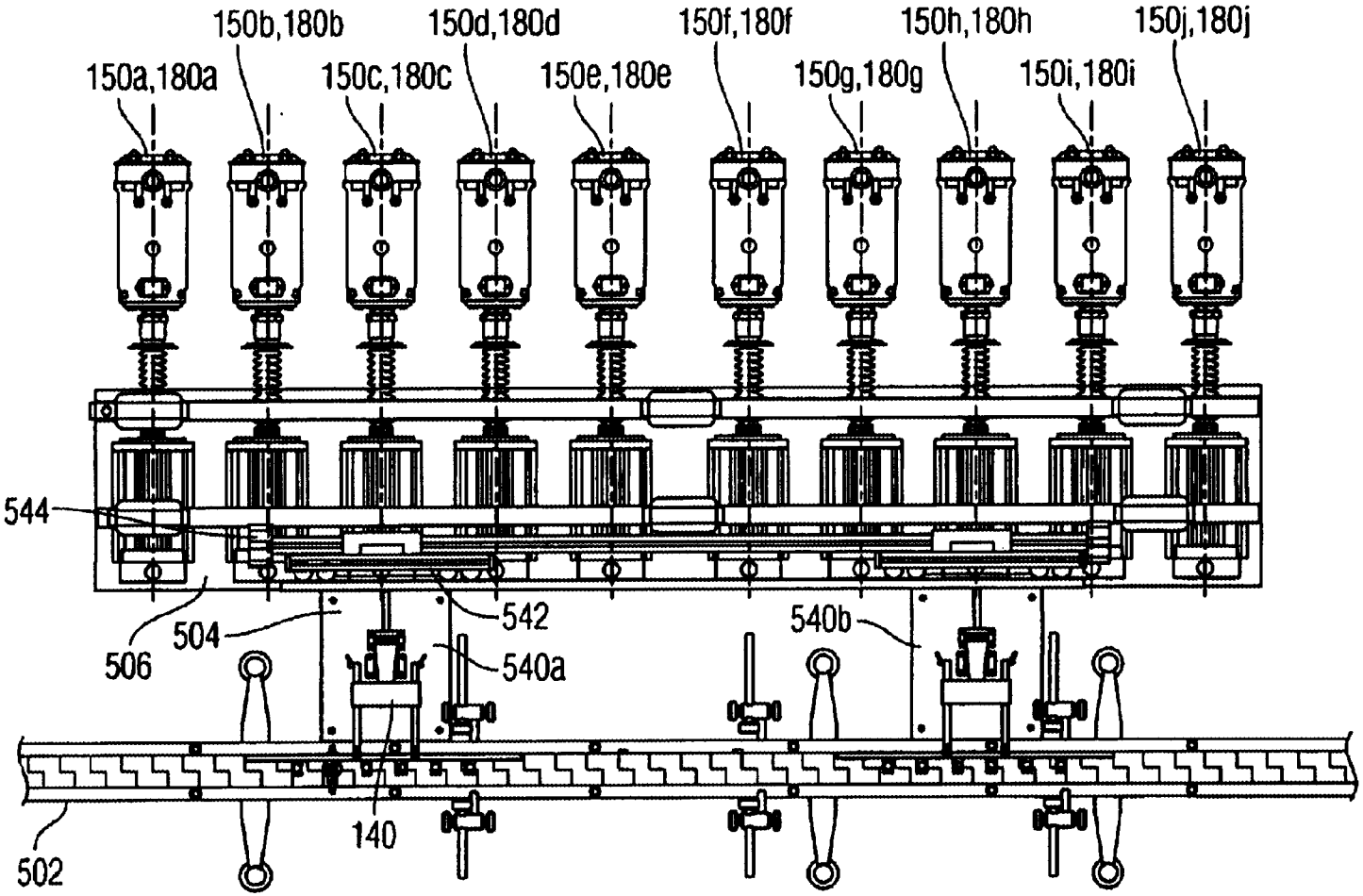
FIG. 27 is a top perspective view of the filling system 10*c* according to yet another alternative embodiment of the present invention.

In the alternative CIP embodiment shown in FIG. 27, a single nozzle motion/mounting device (e.g. bottom up fill mechanism 140) is slide-mounted on bearing 542 and shaft/support block assembly 544, in order to facilitate movement between two operational locations 540*a*, 540*b* (on the center lines of metering device 150*c*/drive station 180*c* and metering device 150*h*/drive station 180*h*). Alternatively, two, separate and complete, nozzle motion/mounting devices (not shown) may be rigidly mounted in the two aforementioned operational locations 540*a*, 540*b*. The use of two operational locations 540*a*, 540*b* for the nozzle motion/mounting device allows the length of the discharge tubing (not shown in FIG. 27) required for system use in a production environment to be optimized.

Figure 29:
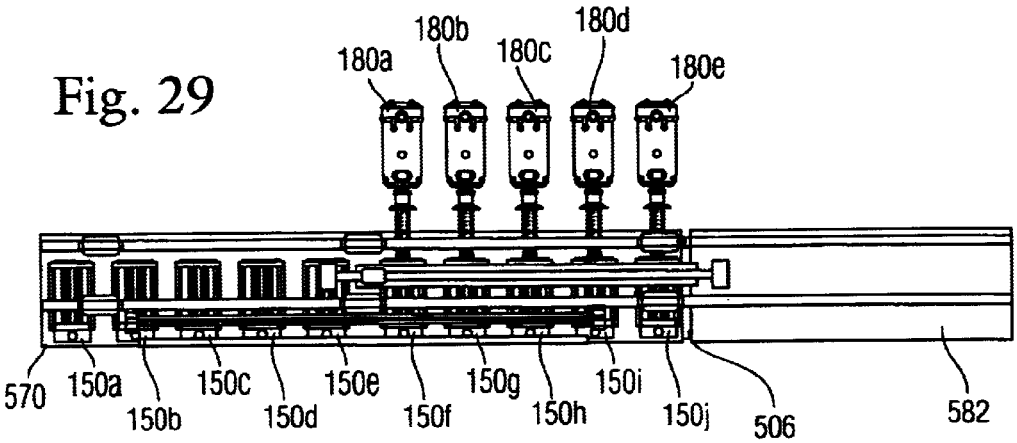
FIG. 29 is a top perspective view of the filling system 10*c* as in FIG. 28 showing the metering devices 150 and the metering device drive stations 180 in the second of two alternating positions.
Figure 28:
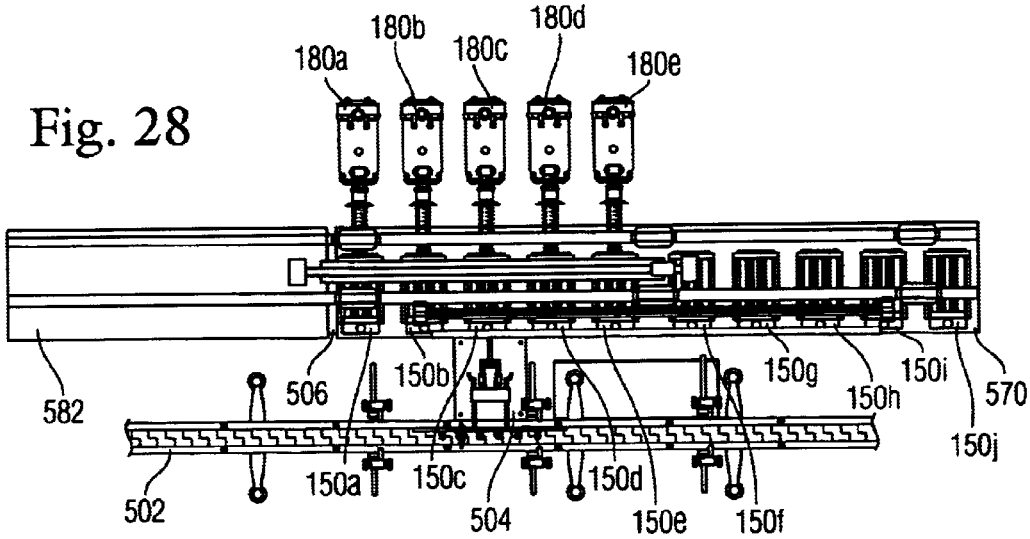
FIG. 28 is a top perspective view of the filling system 10*c*, according to still another alternative embodiment of the present invention, showing the metering devices 150 and the metering device drive stations 180 in the first of two alternating positions.

In yet another alternative CIP embodiment shown in FIGS. 28 and 29 (where the number of metering devices 150*a–j* is equal to twice the number of metering device drive stations 180*a–e*), the CIP changeover cycle begins (in FIG. 29) by disconnecting the "dirty" metering devices 150*f–j* from the drive stations 180*a–e*. This disconnection process can be accomplished in a manual or an automated fashion. After loosening the connection between the sub-frame 570 and the system's main frame 582, the "dirty" product contact parts are shifted from the center "filling" position to the "cleaning" position at either end of frame 582 (note the difference in the positions of the metering devices 150*a–j* with respect to the drive stations 180*a–e* shown in FIGS. 68 and 29). In shifting the position of the sub-frame 570 with respect to the main frame 582, the set of "clean" product contact parts is moved from one of the outer "cleaning" positions into the centrally-located "filling" position. Once the "clean" metering devices 150*a–e* have been connected with the drive stations 180*a–e* (once again, either a manual or automated process), the overall filling system is ready to begin the next production run. While the set of "clean" product contact parts is being used in production, the "dirty" one is subjected to the "Clean-in-Place" process (once again, the physical connection between the "dirty" product contact parts, and the cleaning subsystem 450 is a manual process).

After re-establishing the connection between the sub-frame 570 and the main frame 582, the inlet and outlet ports of the metering devices 150*f–j* are preferably connected, again as indicated in FIG. 26, in series via an appropriate type of connection 410 (e.g. Triclover® sanitary connections). The first metering device 150*f* in the series is connected to the cleaning subsystem's fluid circulating pump/pressure feed system 420. An alternative structure for connecting the metering devices 150*f–j* with the circulating pump/pressure feed system 420 is a parallel arrangement similar to that described below for the nozzles and tubing. A second cleaning loop is utilized for the nozzles 154*f–j*, intake tubing 156*f–j*, and discharge tubing 158*f–j*. The circulating pump/pressure feed system 420 is connected in parallel to the nozzles 154*f–j*, intake tubing 156*f–j*, and discharge tubing 158*f–j* via a cleaning fluid supply manifold 431. The last metering device 150*j* in the series and each of the nozzles 154*f–j* are connected to the fluid collection manifold 433. Once all of the necessary connections have been made, the pump/pressure feed system 420 circulates the cleaning fluid through all of the "dirty" components. The used fluid is retained within the cleaning subsystem 450 for recycling or disposal. A number of the cleaning subsystem's operating parameters (e.g. fluid temperature/pressure/flow rate, time required for the cleaning cycle) can be adjusted to the specific requirements of each application. After the completion of the subsystem's cleaning cycle, the metering devices 150*f–j*, nozzles 154*f–j*, intake tubing 156*f–j*, and discharge tubing 158*f–j* are disconnected from the circulating pump/pressure feed system 420, the cleaning fluid manifold 431, and the fluid collection manifold 433. The formerly "dirty" set of product contact parts is now "clean" and ready to replace the second set at the start of a new production run.

Figure 30:
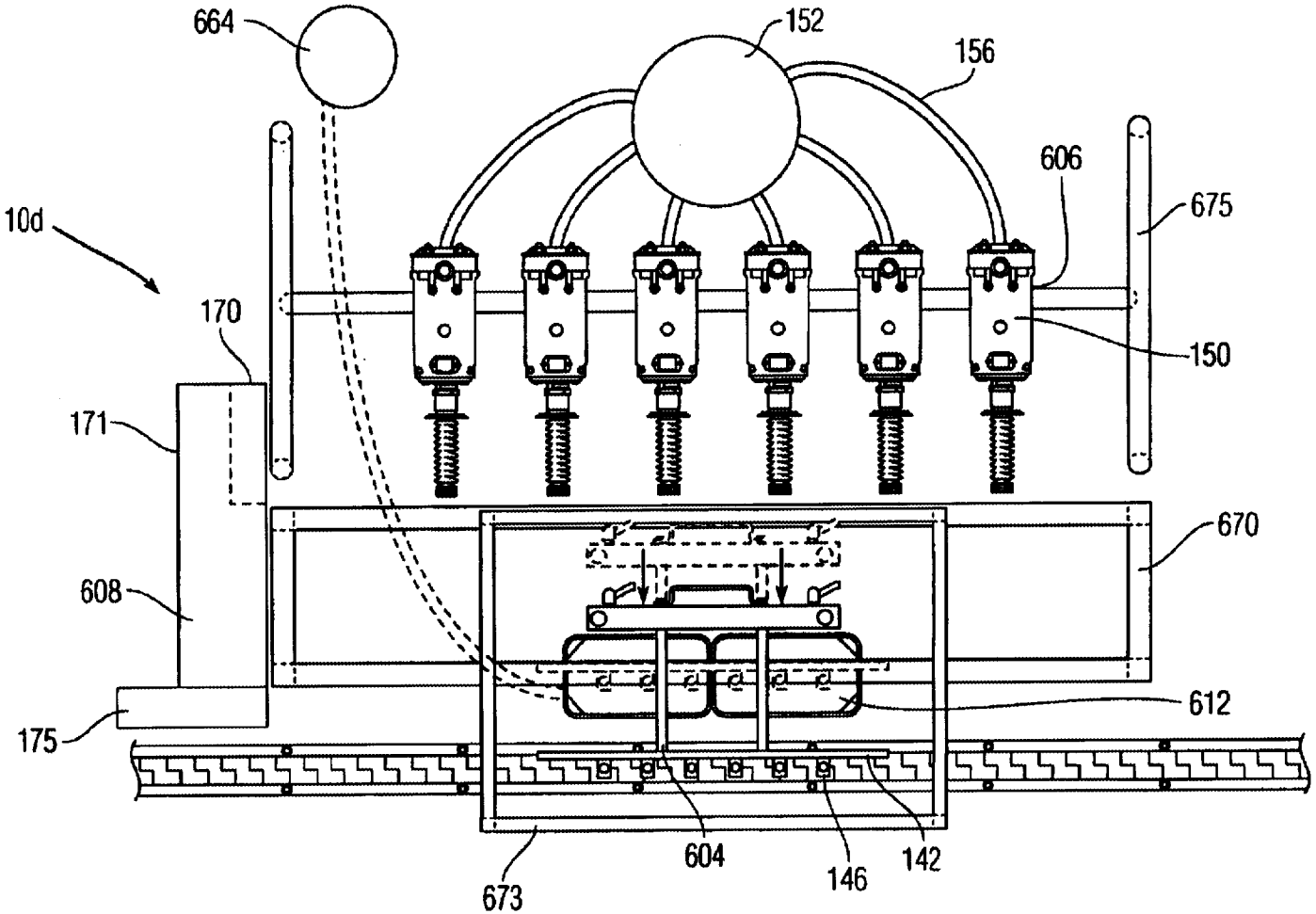
FIG. 30 is a top perspective view of a filling system 10*d* equipped with the automatic calibration and set-up system according to an alternative embodiment of the present invention, showing a product collection receptacle/load cell subsystem 612, a nozzle support subsystem 604, a metering device/multi-station drive subsystem 606, and a controls/utilities subsystem 608.
Figure 31:
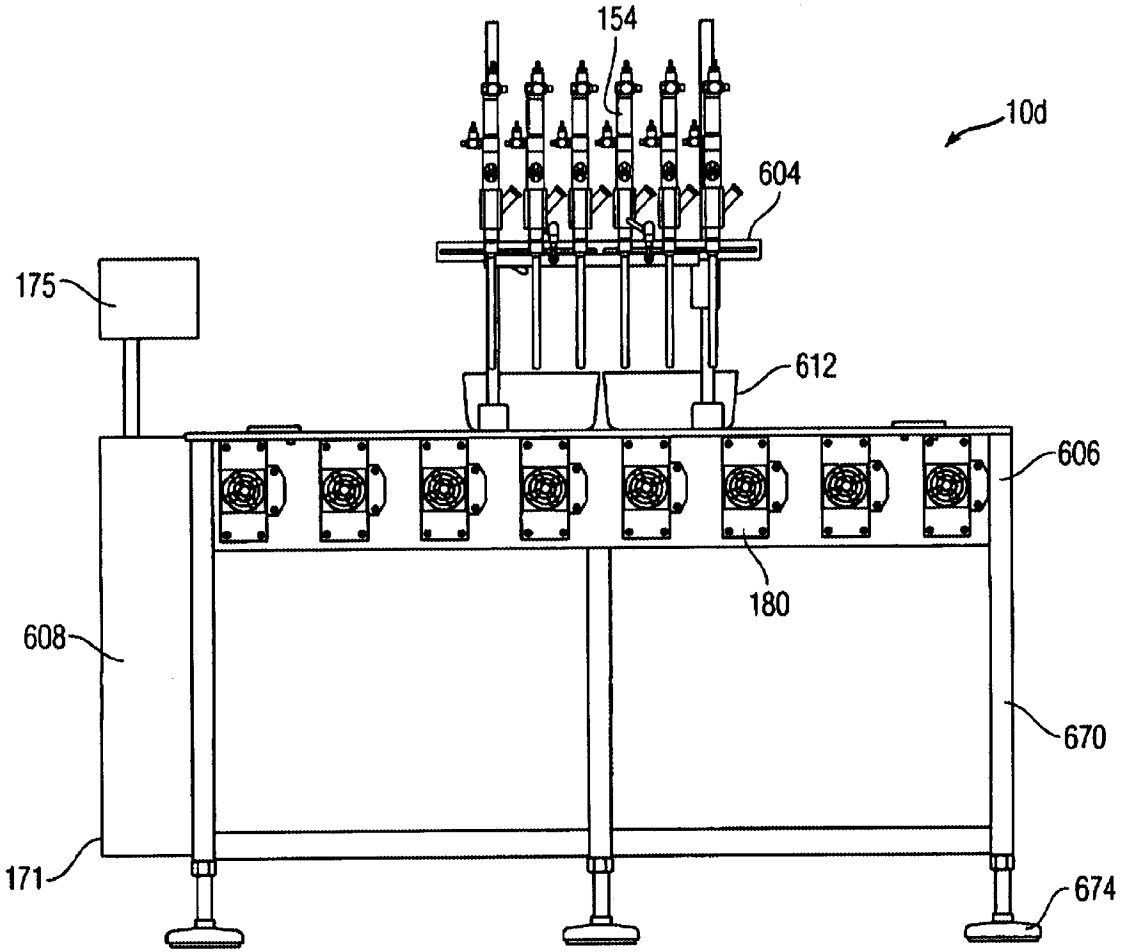
FIG. 31 is a front elevation view of the filling system 10*d* as in FIG. 30.
Figure 32:
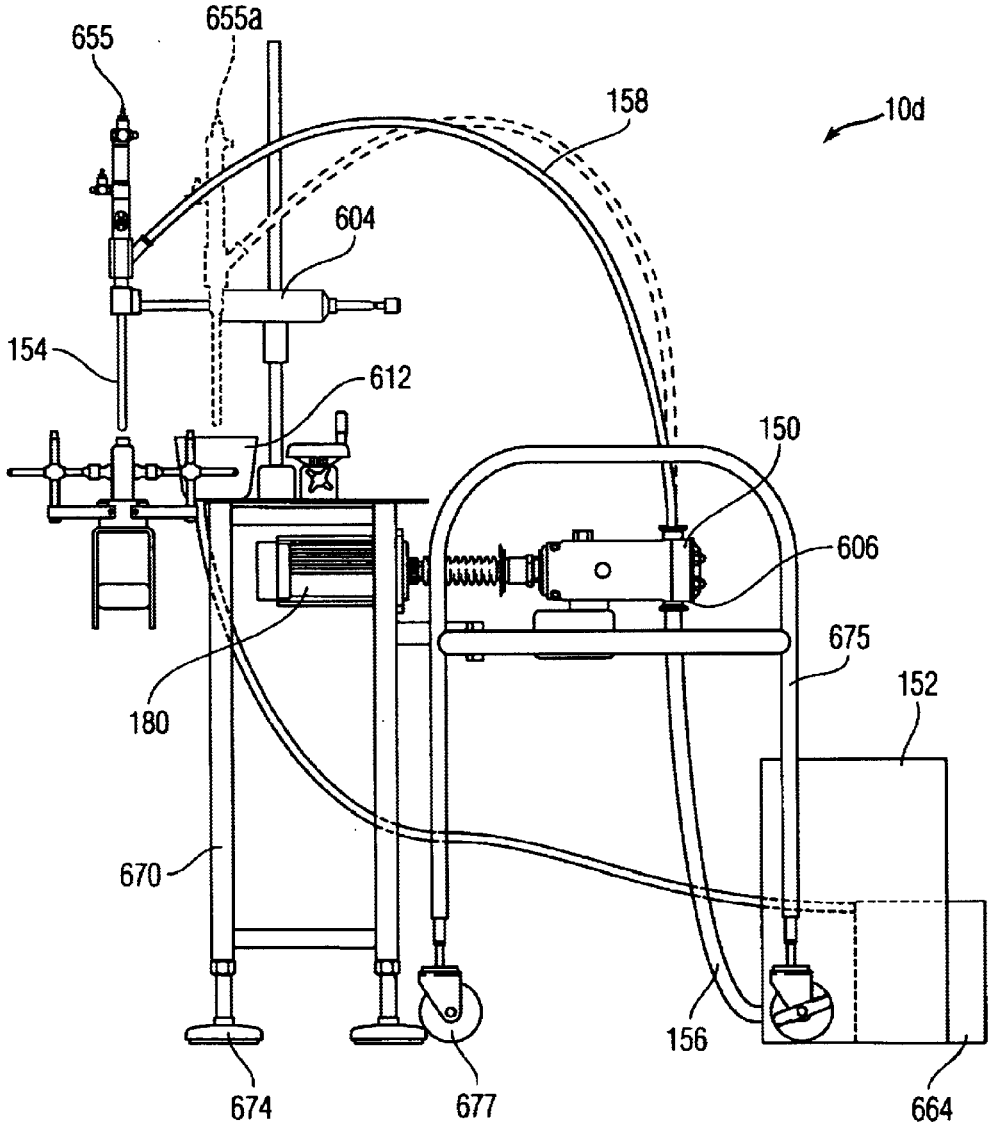
FIG. 32 is a side elevation view of the filling system 10 as in FIGS. 30 and 31.

FIGS. 30–32 are, respectively, top, front, and side perspective view of a filling system 10*d* equipped with an automatic calibration system according to an alternative embodiment of the present invention. Filling system 10*d* includes a product collection receptacle/load cell subsystem 612, a nozzle support subsystem 604, a metering device/multi-station drive subsystem 606, and a controls/utilities subsystem 608.

The product collection receptacle/load cell subsystem 612 receives and, where appropriate, weighs the product dispensed by the metering devices 150 during any one of the priming/air purging, fill volume calibration, and/or fill weight verification cycles.

The nozzle support subsystem 604 moves the nozzles 154 between their normal operating position 655 and the fill volume calibration position 655*a*.

The metering device/multi-station drive subsystem 606 contains the elements of the filling system 10*d* required to supply the liquid product (i.e. product holding tank 152), measure product (i.e. metering devices 150), and dispense product (i.e. nozzles 154).

The controls/utilities subsystem 608 includes the electrical and pneumatic components (e.g. the programmable logic control device 170 and solenoid valves) required to control the overall operation of the filling system 10*d* and the automatic calibration and set-up system of the present invention.

Figure 33:
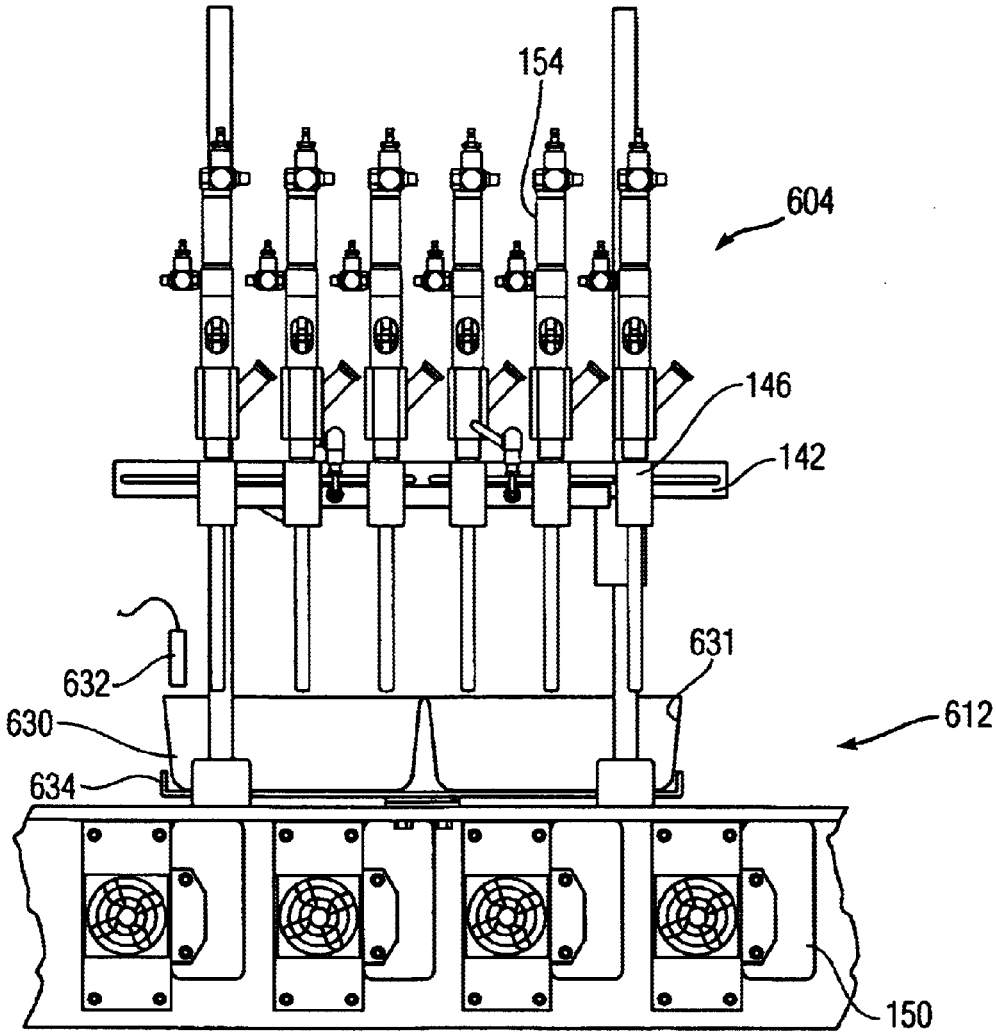
FIG. 33 is a close-up, front perspective view of the product collection receptacle/load cell subsystem 612 and the nozzle support subsystem 604 according to an alternative embodiment of the present invention.
Figure 34:
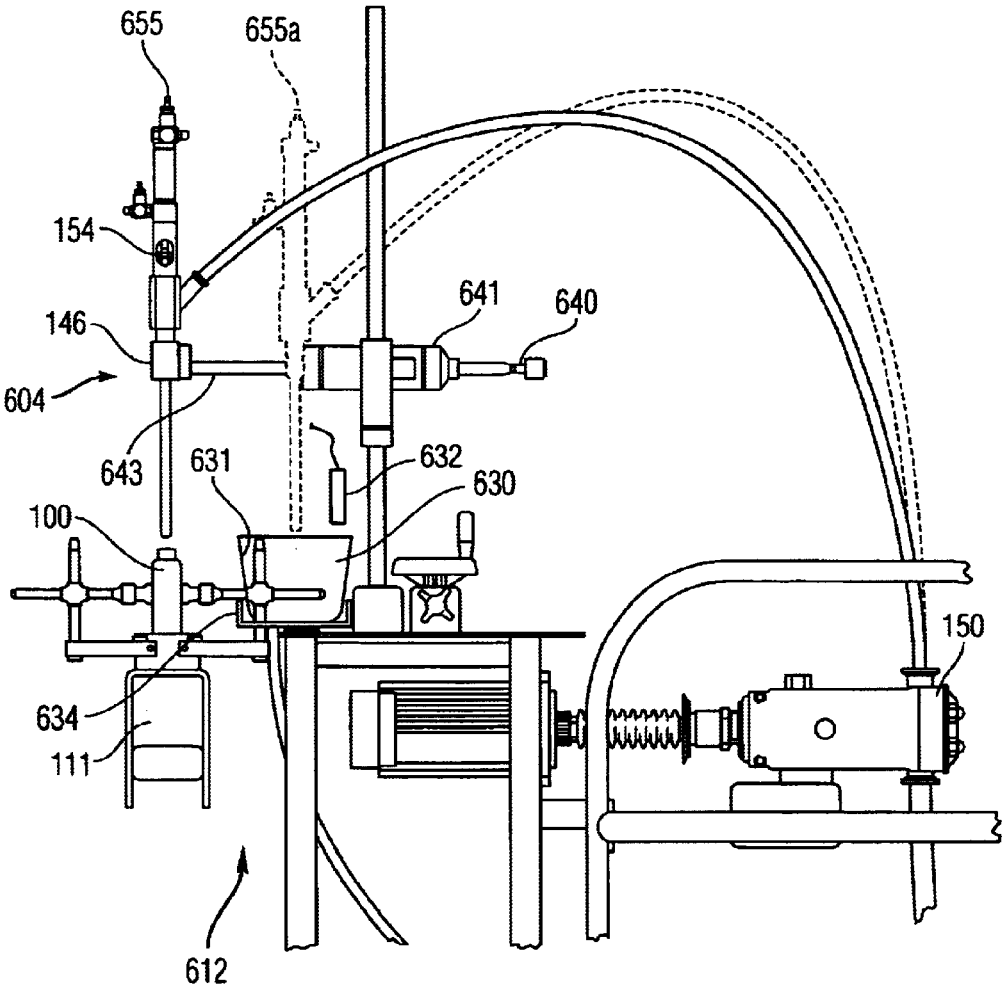
FIG. 34 is a close-up, side perspective view of the subsystems 612, 604 as in FIG. 33.

FIGS. 33 and 34 are close-up perspective views of the product collection receptacle/load cell subsystem 612 and the nozzle support subsystem 604.

The product collection receptacle/load cell subsystem 612 includes a collection receptacle 630 equipped with a level sensor 632, and a single load cell 634 to which the receptacle 630 is mounted. For ergonomic reasons, the collection receptacle 630 is preferably fabricated of a lightweight plastic material possessing excellent chemical resistance characteristics and a high strength-to-weight ratio. To facilitate a timely, manual emptying process, a disposable liner 631 is typically utilized within the receptacle 630 (physically picking the receptacle 630 up and dumping it out is another option). The size, or volume, of the collection receptacle 630 varies depending upon the nature of the application (e.g. the number of metering devices 150 on the overall liquid filling system 10*d*, the maximum container fill volume).

A commercially available level sensor 632 is mounted at the top of the collection receptacle 630. It is utilized to shut down the operation of the automatic calibration/set-up system if, for some reason, the receptacle 630 approaches an overflow condition (e.g. an operator has failed to empty it when necessary).

The load cell 634 is a commercially available unit from, for example, Mettler-Toledo, Incorporated of Hightstown, N.J. chosen to meet certain application-specific parameters (e.g. maximum total weight to be measured, load cell accuracy/resolution, load cell reset/response time). The underlying weight measurement technology incorporated within the load cell 634 may be strain gauge, linear displacement, etc. The collection receptacle 630 is mounted directly to, and supported by, the load cell 634 such that any change in the weight of the receptacle 630 and its contents is immediately registered by the load cell 634.

Figure 35:
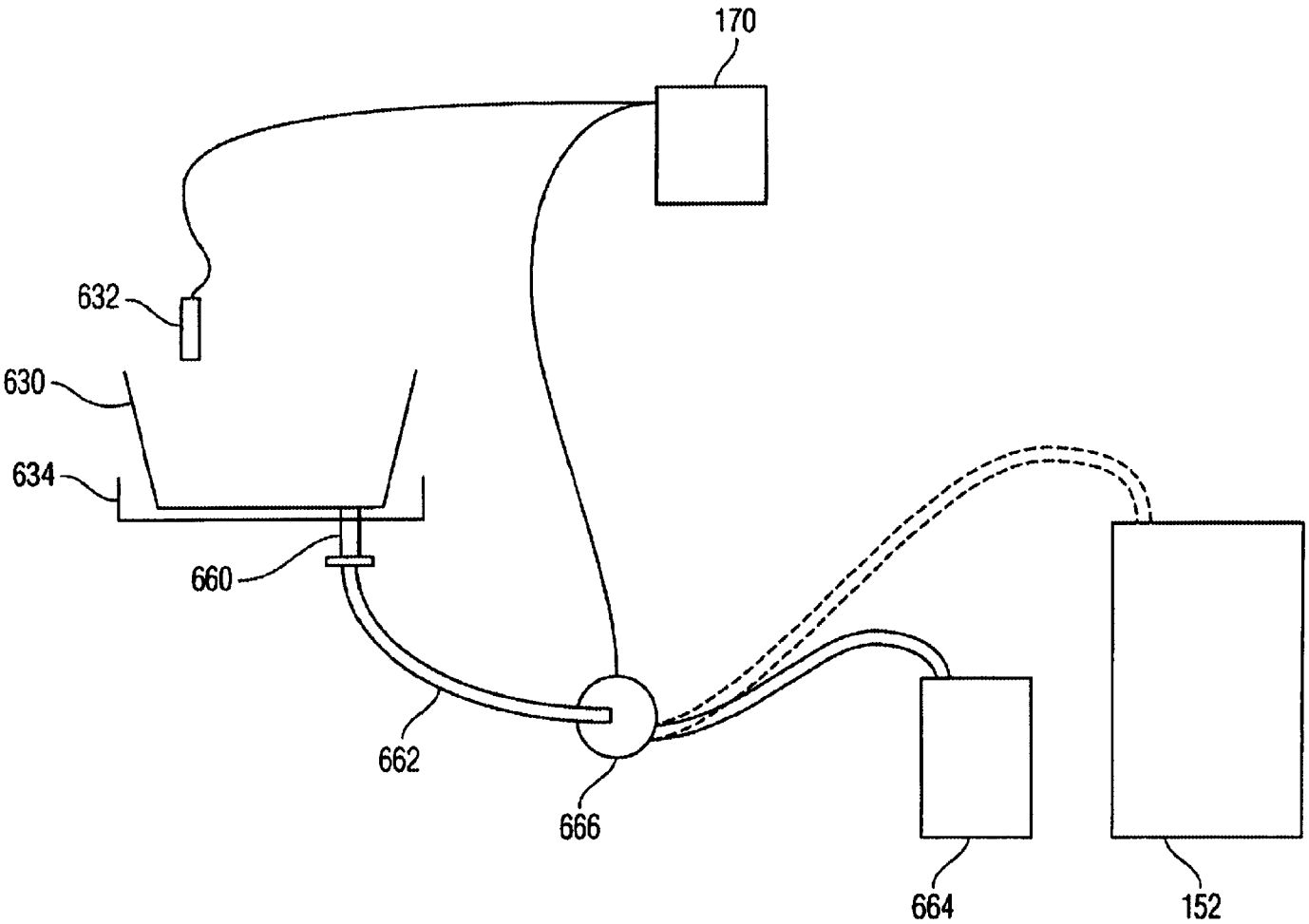
FIG. 35 is a diagramatic representation of an alternative method for draining the product collection receptacle 630.

Alternatively, there are at least two methods for emptying the collection receptacle 630 automatically. These include the use of a drain port 660 or a vacuum system 690. As shown in FIG. 35, if the former option is utilized, the receptacle 630 is equipped with a drain port 660 and drain line 662 running therefrom through a pump 666 to a secondary product holding tank 664 (e.g. a waste collection tank), or the main product supply tank 152. The drain port 660 (e.g. a Triclover® sanitary connection) is located in the bottom of the receptacle 630 to provide a means for its periodic emptying. The drain line 662 is typically a length of commercially available, chemically compatible, flexible tubing used to connect the receptacle's drain port 660 to one of the two tanks 152, 664. The pump 666 is utilized to forcibly transfer the contents of the receptacle 630 to one of the two tanks 152, 664.

The pump 666 is preferably a commercially available peristaltic unit possessing a maximum flow rate that allows it to empty the receptacle 630 in a reasonable amount of time (i.e. one to two minutes). A peristaltic pump is preferred because the pump 666 itself does not come into contact with the product, thereby minimizing the time/cost of cleaning the automatic calibration/set-up system. In addition, the peristaltic pump preferably includes a quick release mechanism for inserting/removing the tubing into/from the unit.

Figure 36:
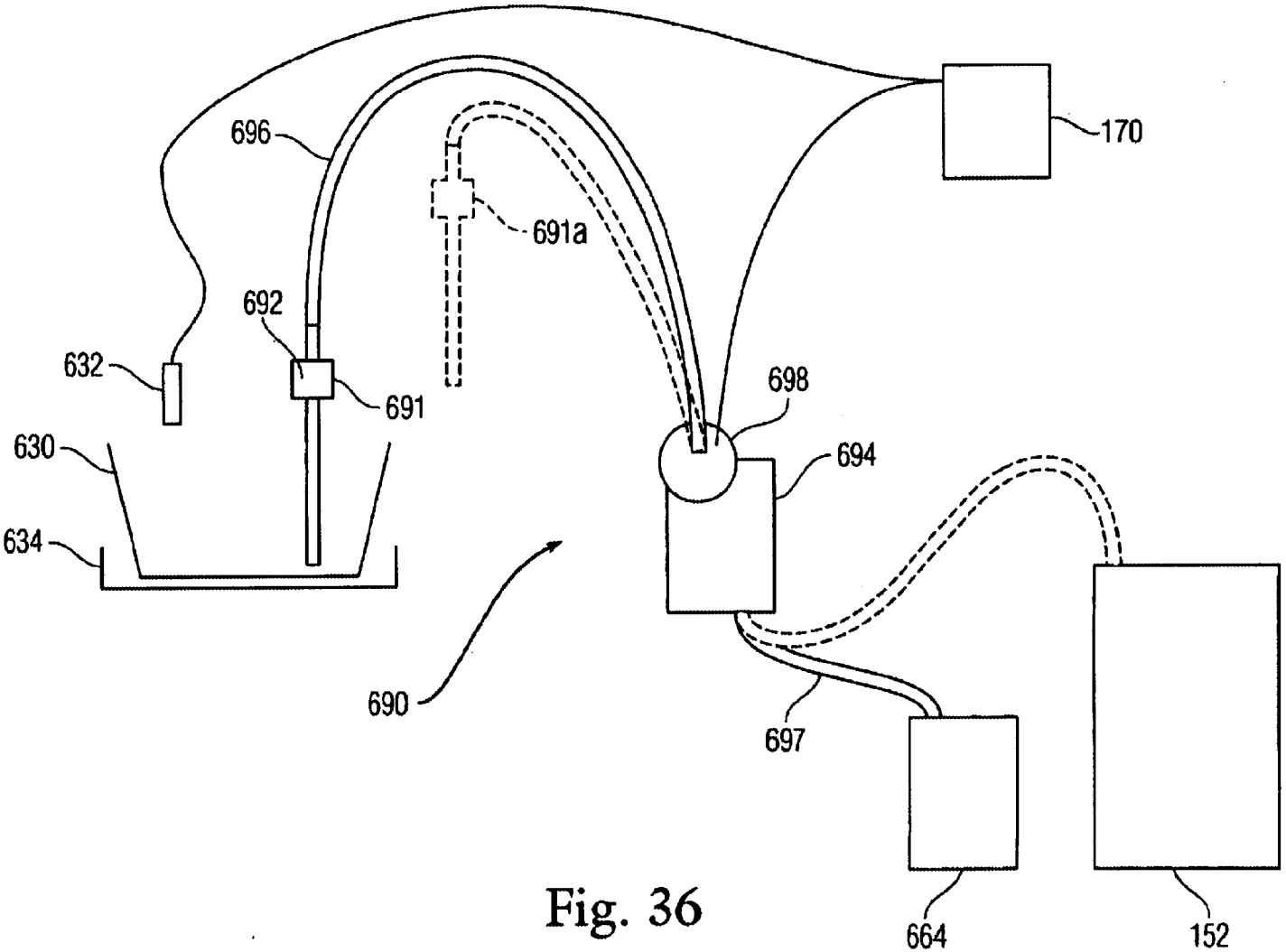
FIG. 36 is a diagramatic representation of another alternative method for draining the product collection receptacle 630.
Figure 37:
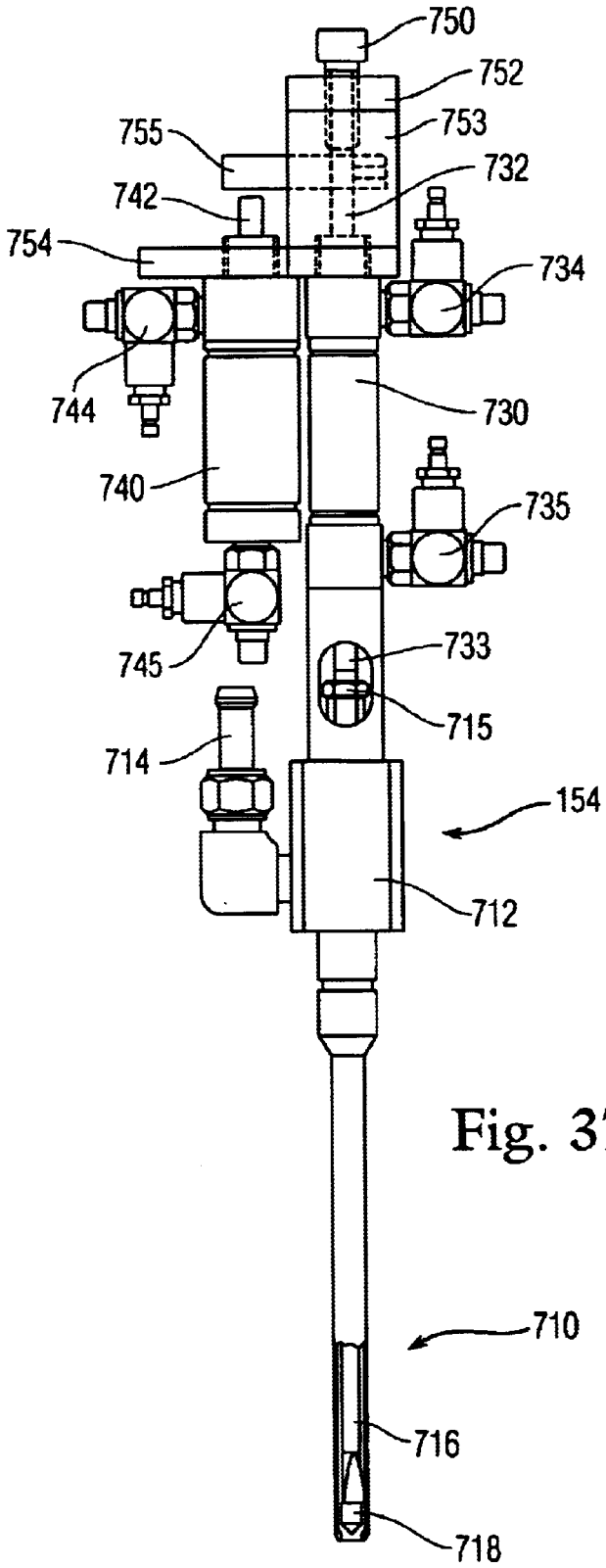
FIG. 37 is a side perspective view of an exemplary nozzle 154 shown in the fully open condition, including a cut-away view of the nozzle tip 710, according to the present invention.
Figure 38:
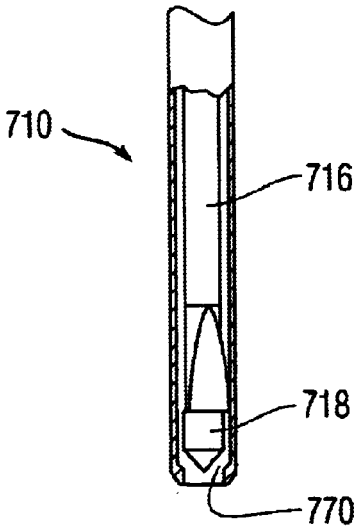
FIG. 38 is a close-up, cut-away view of the nozzle tip 710, shown in the fully open position, of the nozzle 154 as in FIG. 37.

The vacuum system 690 option, shown in FIG. 36, includes a vacuum nozzle 692, a vacuum tank 694, a vacuum line 696 running from the nozzle 692 to the tank 694, and a vacuum pump 698 to forcibly draw the contents of the receptacle 630 into the tank 694. The vacuum nozzle 692 and tank 694 may be fabricated of stainless steel or, if intended to be disposable in nature, an appropriate plastic material. The vacuum line 696 is typically a length of commercially available, chemically compatible, disposable flexible tubing. The vacuum pump 698 is preferably a commercially available unit capable of providing a sufficient amount of vacuum to allow it to empty the receptacle 630 in a reasonable amount of time (i.e. one to two minutes).

In this alternative embodiment, the vacuum nozzle 692 is positioned 691 over, or in, the receptacle 630 only during the emptying process. When not in use, the nozzle 692 is positioned 691*a* outside of the perimeter of the receptacle 630 to ensure that any product that might drip from the nozzle 692 falls outside of the receptacle 630 and, therefore, does not detrimentally affect the weighing process. Periodically, the contents of the vacuum tank 694 are transferred to a secondary product holding tank 664 (e.g. a waste collection tank), or the main product supply tank 152, via a length of commercially available, flexible tubing 697 and the introduction of compressed air (i.e. positive pressure) into the vacuum tank 694.

Additional alternative methods for emptying the collection receptacle 630 (not shown in the Figures) may include the use of a different type of pump 666 (e.g. a gear pump), or the installation of a two-way valve in the drain line 662 (i.e. a gravitational emptying of the receptacle 630 when the valve is manually or automatically opened). In addition to its functionality in the manual emptying scenario described above, in these alternative embodiments for automatically emptying the receptacle 630 the level sensor 632 also serves to actuate either the peristaltic pump 666 or the vacuum system 690 to forcibly empty the receptacle 630 when the collected product reaches a predetermined level.

Returning to FIGS. 33 and 34, the nozzle support subsystem 604 consists of a reciprocating nozzle mechanism 640 that provides the means for moving the nozzles 154 from their normal operating position 655 over the conveyor 111 and containers 100 to a position 655*a* above the product collection receptacle 630. The reciprocating nozzle mechanism 640 is equipped with a pneumatic drive cylinder 641 to provide the required horizontal motion, a horizontal motion guide assembly 643, and a nozzle mounting bracket 142 (see also FIG. 30). The nozzles 154 are held in blocks 146 (see also FIG. 30) that are fixedly attached to the mounting bracket 142. The mounting bracket 142 is fixedly attached to the guide assembly 643 which is, in turn, fixedly connected to the rod of drive cylinder 641. The reciprocating (i.e. back and forth) motion of the drive cylinder 641 is translated to the nozzles 154 through this series of connections. The guide assembly 643 maintains the proper alignment of the nozzles 154 and mounting bracket 142 with either the containers 100 located on the conveyor assembly 111 or the collection receptacle 630.

The metering devices 150 are fixedly attached to a second, portable frame assembly 675. The portable frame assembly 675 is a free-standing unit preferably fabricated of tubular stainless steel with built-in casters 677 to facilitate product contact part changeover. It is noteworthy that the portable frame 675 is similar to the COP trolley subsystem frame 470 discussed above with reference to FIGS. 16 and 17.

A novel advantage of this alternative embodiment of the present invention involves the guard assembly 673. In a typical automated filling system, the guard assembly 673 must be bypassed in order to complete the priming/air purging process and the calibration of each metering device drive station 180 (i.e. an operator has to directly interact with components located within the perimeter of the guard assembly 673 during the set-up/calibration procedure). The present invention eliminates the potentially hazardous presence of an operator within the guard assembly's perimeter by providing for either fully automated system set-up/calibration, or an operator-assisted process where the operator interacts with the filling system 10*d* via the interface 175.

The electrical control system is designed for operation on 220 volt, 60 hz., three-phase service. The pneumatic system requires clean, dry compressed air at 80 psi. The controls/utilities subsystem 608 (including the programmable logic control device 170, see FIG. 30) is typically housed in a NEMA 12 stainless steel enclosure 171 attached directly to the frame 670 of the overall filling system 10*d*. The controls/utilities subsystem 608 includes, among others, the following components/features:

A programmable logic control device 170 and an operator interface 175 are generally provided to control the operation of the overall filling system 10*d*. The programmable logic control device 170 is connected to the drive cylinder 641 in order to control the operation of the nozzle motion/mounting devices (e.g. the reciprocating nozzle mechanism 640). The programmable logic control device 170 is also connected to each of the drive stations 180 (or, when drive stations 180 are not required/included, directly to each of the metering devices 150) in order to control the operating speed and displacement of the metering devices 150. The programmable logic control device 170 is also connected to the load cell 634 in order to measure the gross weight of the receptacle 630 and its contents (i.e. such that all required net fill weights may be calculated). The programmable logic control device 170 is also connected to the level sensor 632 to shut down the operation of the calibration/set-up system before the product collection receptacle 630 overflows. The programmable logic control device 170 may utilize statistical process control (SPC) software in order to analyze the performance of the overall liquid filling system 10*d* during each production run. In addition, the programmable logic control device 170 may be connected to a printer in order to supply hard copy records of the accumulated data. The interface 175 is programmed to step the operator through the filling system's set-up/changeover process and to assist with system fault condition diagnosis. The interface 175 may be utilized to show statistical process information on its graphical display.

When a product collection receptacle 630 equipped with a drain port 660, or a vacuum system 690, is utilized (i.e. the alternative embodiments discussed above with respect to FIGS. 35 and 36), the programmable logic control device 170 is also connected to the peristaltic pump 666, or the vacuum pump 698, in order to empty the receptacle 630 when required (as indicated by the level sensor 632).

With reference to FIGS. 30–34, a complete description of the calibration/set-up system's typical production environment operation, once the overall automatic filling system 10*a* has been appropriately cleaned and, if necessary, reconfigured, is as follows.

The operation of the calibration/set-up system is actuated by an operator via the control system's interface 175. The priming/air purging process begins with the positioning 655*a* of the filling nozzles 154 over the product collection receptacle 630 by the nozzle support subsystem 604. Once the nozzles 154 are over the receptacle 630, the metering devices 150 are cycled at an appropriate operating speed in order to draw product from the main product supply tank 152 through the intake lines 156 before pushing it out through the discharge lines 158 and nozzles 154. The duration of this process may be (1) a user-defined period of time, (2) a pre-determined number of metering device 150 counts, cycles or pulses, (3) subject to automatic termination based on feedback from the load cell 634 or a series of sensors (not shown in the Figures) watching for product flow from each nozzle 154, or (4) subject to operator termination once a steady stream of product is observed to be flowing from each of the nozzles 154. It is worth noting that the purging functionality described above may be utilized to clear most of the product out of the metering devices 150, nozzles 154, and intake/discharge lines 156, 158, respectively, at the conclusion of a production run.

Once the priming/air purging process is complete, the calibration of the amount of product to be dispensed during each metering device fill cycle begins. The calibration process is either operator-actuated (e.g. at the control system interface 175, the operator inputs the target fill volume/weight before actuating the calibration cycle), or part of a fully automated process (e.g. beginning immediately after the priming/air purging cycle has timed out, with the target fill volume/weight having been previously entered at the interface 175 or downloaded from a supervisory level computer system). The target fill information provided via the interface 175 or supervisory computer is typically entered as a measure of volume or weight. A pre-programmed control system algorithm is used to convert the volume or weight information into parameters more readily utilized by the metering device 150 (e.g. a number of pump revolutions, the length of time to hold a valve open). The calibration process involves the adjustment of the output of each metering device 150 on a one-by-one basis.

With the nozzles 154 still positioned 655*a* over the receptacle 630, the first metering device 150 is actuated to dispense, into the receptacle 630, the programmed amount of product. The load cell 634 of product collection receptacle/load cell subsystem 612 is utilized to weigh the amount of product that is actually dispensed. The actual amount dispensed is compared to the target value. If the actual amount dispensed is found to be within the specified tolerance range, that metering device 150 is deemed to be properly calibrated and the process automatically moves on to the next metering device 150. Generally, however, that initial metering device trial dispense cycle falls outside of the specified tolerance range, requiring the initiation of the fine tuning cycle of the present invention. The fine tuning cycle utilizes a second pre-programmed control system algorithm to compare the target fill volume/weight to the actual output of the trial dispense cycle, and to automatically make an adjustment, either upward or downward, of the metering device's operating parameters (e.g. the number of revolutions of a rotary pump, the number of pulses in the output pulse train of a flow meter). Another trial dispense cycle is then completed and its output compared to the target fill volume/weight specified tolerance range. The fine tuning cycle is repeated until the amount dispensed by the metering device 150 falls within the specified tolerance range. Usually, only one fine tuning cycle is required to get a metering device's output within the specified tolerance range. The calibration process continues until the fill volume/weight dispensed by each of the metering devices 150 is properly adjusted.

The present invention's automated calibration/set-up process is recognized as being more efficient than a manual one due to a minimization of the time required to complete the process and the elimination of operator errors such as those discussed in the "Background of the Invention" section above (e.g. misread/miscalculated fill weights, incorrect or inappropriate fine tuning adjustments).

The fill weight verification cycle takes place at user-defined intervals (e.g. a specific amount of time or number of filling cycles) during a production run. At the specified interval, the normal operation of the overall filling system 10*d* is temporarily suspended so that the nozzles 154 can move from their normal operating position 655 over the conveyor 111 and containers 100 to a position 655*a* over the product collection receptacle 630. In turn, each metering device 150 goes through a multi-step process identical to the calibration process described above to check, and adjust if necessary, the amount of product that is being dispensed during each filling cycle. Once it has been verified that the amount dispensed by each metering device 150 falls within the specified tolerance range, the nozzles 154 return to their normal operating position 655 over the conveyor 111 and containers 100 and the automated operation of the filling system 10*d* resumes.

In addition to the completely automated (i.e. no operator intervention or notification whatsoever) fill volume verification process described in the previous paragraph, alternative methods for addressing out-of-specification fills are possible. These alternative methods include, but are not limited to, (1) the automatic adjustment of any out-of-specification metering device 150 with operator notification after the adjustment has been completed (e.g. to allow the operator to determine if the metering device 150 is in need of maintenance), (2) alerting the operator to the out-of-specification condition so that he/she may attend to it manually, and (3) alerting the operator to the out-of-specification condition and providing assistance with the manual adjustment process.

During each of the three processes discussed above, product is dispensed and collects in the receptacle 630. The amount of product present in the receptacle 630 at any given moment is monitored by a level sensor 632. If an operator fails to manually empty the product collection receptacle 630 when required, the programmable logic control device 170 due to feedback from the sensor 632 will suspend the operation of the automatic calibration and set-up system's priming/air purging, fill volume calibration, or fill weight verification cycles to prevent an overflow situation.

In the alternative embodiments discussed above (see FIGS. 35 and 36), when appropriate, a peristaltic pump 666 attached to the receptacle's discharge port, or a vacuum system 690, is actuated to transfer the product from the receptacle 630 back to the main product supply tank 152 (i.e. recycling) or to transfer it to a secondary holding tank 664 (e.g. for disposal). If, for any reason, the receptacle 630 becomes full and the pump 666, or vacuum system 690, cannot be actuated to empty it, the programmable logic control device 170 will prevent the operation of the automatic calibration and set-up system's priming/air purging, fill volume calibration, or fill weight verification cycles.

In addition to that discussed in the preceding paragraphs—the preferred embodiment utilized for priming/air purging, metering device calibration, and periodic fill weight verification, with manual emptying of the receptacle 630 (e.g. disposable liner 631)—there are at least eight alternative embodiments. These include (1) prime/air purge only with manual emptying of the receptacle 630 (e.g. disposable liner 631), (2) prime/air purge only with gravity draining (e.g. valve located in the drain line 662) of the receptacle 630 into a residual tank 664, (3) prime/air purge only with forced draining (e.g. peristaltic pump 666, or equivalent) of the receptacle 630 into a residual tank 664, (4) prime/air purge and metering device calibration with manual emptying of the receptacle 630, (5) prime/air purge and metering device calibration with gravity draining of the receptacle 630 into a residual tank 664, (6) prime/air purge and metering device calibration with forced draining of the receptacle 630 into a residual tank 664, (7) prime/air purge, metering device calibration, and periodic fill weight verification, with gravity draining of the receptacle 630 into a residual tank 664, and (8) prime/air purge, metering device calibration, and periodic fill weight verification, with forced draining of the receptacle 630 into a residual tank 664.

FIGS. 37–42 show an exemplary, two-stage, positive shut-off nozzle 154 and its three stages of operation: fully open, partially open, and closed. The nozzle 154 includes a nozzle body assembly 712, a product inlet connection 714, a rod connector 715, an internal connecting rod 716, an internal tip 718, a primary air cylinder 730, a primary air cylinder upper rod 732, a primary air cylinder lower rod 733, primary air cylinder flow control valves 734, 735, a secondary air cylinder 740, a secondary air cylinder rod 742, secondary air cylinder flow control valves 744, 745, a stroke length adjustment screw 750, an adjustment screw bracket 752, an adjustment screw support block 753, a secondary air cylinder mounting block 754, and a stop finger 755.

The nozzle body assembly 712, the product inlet connection 714, the rod connector 715, the internal connecting rod 716, the stroke length adjustment screw 750, the adjustment screw bracket 752, the adjustment screw support block 753, the secondary air cylinder mounting block 754, and the stop finger 755 are preferably fabricated of stainless steel. The internal tip 718 is preferably fabricated of a plastic material (e.g. Torlon®) determined to be compatible with the liquid products that will pass through the nozzle 154. The primary air cylinder 730 is a commercially-available, double-acting (i.e. pneumatically-operated in both directions), double-ended unit (i.e. the rod extends out of both ends of the cylinder 730 creating an upper rod 732 and a lower rod 733). The secondary air cylinder 740 is a commercially-available, double-acting, single-ended unit (i.e. the rod 742 extends out of only one end of the cylinder 740). The valves 734, 735, 744, 745 are commercially-available, needle-type, pneumatic flow control valves. The air cylinders 730, 740 and flow control valves 734, 735, 744, 745 are available from, for example, the Bimba Manufacturing Company of Monee, Ill.

The product inlet connection 714 is fixedly attached to the nozzle body assembly 712 and provides the point where the discharge tubing 158 (see FIG. 12) connects the nozzle with a metering device (e.g. a flow meter) 150 (see FIG. 12). The internal connecting rod 716 extends through the nozzle body assembly 712 and is fixedly attached at one end to the internal tip 718 and at the other end to the rod connector 715. The rod connector 715 is also fixedly attached to the primary air cylinder lower rod 733. The fixed connection between the internal connecting rod 716 and the lower rod 733 created by the presence of the rod connector 715 serves to transfer any motion of the lower rod 733 directly to the internal tip 718.

One end of the primary air cylinder 730 is fixedly attached to the upper end of the nozzle body 712 with the lower rod 733 extending into the body 712. A mounting block 754 is fixedly attached to the other end of the primary air cylinder 730 with the upper rod 732 extending through the block 754. The secondary air cylinder 740 is also fixedly attached to the mounting block 754 with its cylinder rod 742 extending through the block 754. Flow control valves 734, 735 are fixedly attached to the compressed air ports of the primary air cylinder 730. Flow control valves 744, 745 are fixedly attached to the compressed air ports of the secondary air cylinder 740.

A stroke length adjustment screw 750 rotatably protrudes through a threaded hole in the adjustment screw bracket 752. The bracket 752 is fixedly attached to the two support blocks 753, which are in turn fixedly attached to the mounting block 754. A stop finger 755 is threaded onto the end of the upper rod 732 and positioned between the two support blocks 753 such that the finger 755 cannot rotate out of alignment directly above the end of the secondary air cylinder rod 742.

The diameters of the air cylinders 730, 740 are not equivalent. The internal diameter of the secondary air cylinder 740 should be approximately 1.6 times that of the primary air cylinder 730. This is done so that when the cylinders 730, 740 are subjected to compressed air of equal pressure, the force exerted through the cylinder rod 742 is approximately 2.5 times that available through the upper rod 732. The reason for this will become evident in the discussion of the operation of the nozzle that follows.

The operation of the nozzle 154 is controlled by compressed air that is fed at equal pressure into the cylinders 730, 740 through lines (not shown in the Figures) removably attached to the flow control valves 734, 735, 744, 745. To open the tip 710 of the nozzle 154, compressed air is fed into the primary cylinder 730 through valve 735 causing the lower rod 733, the rod connector 715, the connecting rod 716, and the internal tip 718 to retract into the nozzle body assembly 712. As the internal tip 718 retracts, a gap, or opening, 770 is created at the tip 710 of the nozzle 154 which allows the liquid product entering the nozzle 154 from a metering device 150 (see FIG. 12) through inlet connection 714 to flow into a waiting container 100 (see FIG. 12). The flow of compressed air through valve 735 also causes upper rod 732 to move toward and eventually stop against the stroke length adjustment screw 750. The amount of gap 770 created by this movement is controlled by the position of the adjustment screw 750 and the degree to which it limits the travel of upper rod 732. This fully open condition is that shown in FIGS. 37 and 38. Simultaneous to the feeding of air into the primary cylinder 730 through valve 735, compressed air is fed into the secondary cylinder 740 through valve 745 causing the cylinder rod 742 to push against the stop finger 755. The actions of both cylinders 730, 740 ensure that the tip 710 of the nozzle 154 opens quickly and completely.

As the end of the filling cycle approaches (i.e. approximately 0.5 seconds before the container 100 is full, or the required fill volume has been reached), compressed air is fed into the primary cylinder 730 through valve 734 causing the upper rod 732, the lower rod 733, the rod connector 715, the connecting rod 716, and the internal tip 718 to close the gap 770 to the partially open state shown in FIGS. 39 and 40. This partially open state is reached when the stop finger 755 comes to rest against the end of the secondary air cylinder rod 742. Although, at this point, the upper and lower rods 732, 733, respectively, have not reached the limit of their travel due to the length of the primary air cylinder 730, they are restrained from further movement by the greater opposing force (i.e. 2.5 times greater) present in the secondary air cylinder rod 742. The smaller gap 770 resulting in the partially open condition reduces the flow rate of the liquid product out of the nozzle 154 into the container 100 (see FIG. 12).

At the end of the filling cycle, compressed air is fed into the secondary cylinder 740 through valve 744 causing the rod 742 to retract as shown in FIG. 41. When this occurs, the upper and lower rods 732, 733, respectively, are allowed to resume the movement that began approximately 0.5 seconds earlier. This causes the rod connector 715, the connecting rod 716, and the internal tip 718 to resume their movement to completely close the gap 770 to the state shown in FIGS. 41 and 42. The elimination of the gap 770 resulting in the closed condition stops the flow of the liquid product out of the nozzle 154.

There are a number of benefits in using the nozzle 154 disclosed above in conjunction with a flow meter (i.e. a metering device 150 such as that seen in FIG. 12). The fill accuracy of the filling system 10 is optimized due to the quick opening nature (i.e. simultaneous operation of both air cylinders 730, 740) of the design and its two-stage closing sequence. The fill accuracy while utilizing a flow meter is a function of the percentage of the fill cycle that takes place under steady state operation (i.e. the flow of liquid product through the flow meter at a constant rate and pressure). As this percentage approaches 100%, the accuracy of the flow meter filling process improves. The dual-cylinder, quick opening design reduces the amount of time needed to achieve steady state operation at the start of the fill cycle.

The fill accuracy of a flow meter is also directly proportional to the amount of liquid product (i.e. "uncontrolled") that flows out of a nozzle 154 in the fraction of a second between the issuance, by the programmable logic controller 170 (see FIG. 10), of the command for the nozzle 154 to close (i.e. the operation of a solenoid valve to direct compressed air into the cylinders 730, 740 through flow control valves 734, 744, respectively) and the moment when it actually closes (i.e. the gap 770 ceases to exist). If the amount of uncontrolled product that leaves the nozzle 154 during this period of time is reduced, any volume inaccuracy associated with it becomes a smaller percentage of the total fill volume dispensed during the fill cycle. Or, in other words, an improvement in the overall fill accuracy is achieved. The second stage of the closing sequence, between the partially open (FIGS. 39 and 40) and closed (FIGS. 41 and 42) conditions, serves to minimize the amount of uncontrolled product that leaves the nozzle 154.

The use of the positive shut-off nozzle 154 also assists in lengthening the useful life of the associated flow meter. Stopping the flow of the liquid product passing through a flow meter subjects the flow meter to pressure differentials. As the magnitude of the pressure differentials increases, the more significant the detrimental effect on the flow meter. If the stoppage (i.e. deceleration) of the product flow occurs gradually, the pressure differential, or shock, exerted on the flow meter is reduced. The two-stage closing sequence of the nozzle 154 disclosed above stops the flow of the product in a gradual manner.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A filling system for automatically filling containers with liquid product in a production cycle and for clean-in-place (CIP) cleaning of the product contact parts during said production cycle, comprising:

a container handling subsystem for carrying containers to and from a filling area, a container indexing assembly for indexing containers through said filling area;

a product contact subsystem for metering said liquid product into containers in said filling area, said product contact subsystem further including;

at least one filling nozzle and corresponding metering device for metering liquid through said filling nozzle into containers;

a cleaning subsystem including pressurized cleaning fluid feed system for circulating cleaning fluid through said at least one filling nozzle and corresponding metering device; and a controls/utilities subsystem for coordinating operation of the container indexing assembly with the product contact subsystem, said controls/utilities subsystem periodically initiating a cleaning cycle in which supply and metered dispensing of said liquid product is stopped and pressurized cleaning fluid is circulated through said at least one filling nozzle and corresponding metering device by said cleaning subsystem.

2. The filling system for automatically filling containers with liquid product in a production cycle and for clean-in-place (CIP) cleaning of the product contact parts according to claim 1, wherein said cleaning subsystem further comprises a fluid reservoir for containing cleaning fluid, a pump to circulate cleaning fluid out of said fluid reservoir, a cleaning fluid supply manifold connected on one side to said fluid reservoir via said pump and selectively connectable on the other side through said at least one filling nozzle and corresponding metering device, and a cleaning fluid collection manifold selectively connectable to said at least one filling nozzle for collecting cleaning fluid circulating there through.

3. The filling system for automatically filling containers with liquid product in a production cycle and for clean-in-place (CIP) cleaning of product contact parts according to claim 2, wherein said at least one filling nozzle and corresponding metering device are subjected to a "Clean-in-Place" process by manually connecting them to said cleaning fluid supply manifold.

4. The filling system for automatically filling containers with liquid product in a production cycle and for clean-in-place (CIP) cleaning of the product contact parts according to claim 2, wherein the used cleaning fluid is recirculated from said fluid collection manifold back to said fluid reservoir for recycling.

5. The filling system for automatically filling containers with liquid product in a production cycle and for clean-in-place (CIP) cleaning of the product contact parts according to claim 1, wherein said product contact subsystem articulates said filling nozzle under control of said controls/utilities subsystem by lowering said nozzle into the necks of containers and holding said nozzle stationery during filling.

6. The filling system for automatically filling containers with liquid product in a production cycle and for clean-in-place (CIP) cleaning of the product contact parts according to claim 5, wherein said product contact subsystem articulates said filling nozzle under control of said controls/utilities subsystem by lowering said nozzle into the necks of containers and raising said filling nozzle in accordance with the level of the liquid during the filling cycle.

7. A filling system for automatically filling containers with liquid product in a production cycle and for clean-in-place (CIP) cleaning of the product contact parts during said production cycle, comprising:

a container handling subsystem for carrying containers to and from a filling area, a container indexing assembly for indexing containers through said filling area;

a product contact subsystem for metering said liquid product into containers in said filling area, said product contact subsystem further including;

a first set of filling nozzles and corresponding metering devices for metering liquid through said filling nozzles into the containers, and a second set of filling nozzles and corresponding metering devices for metering liquid through said filling nozzles into the containers;

a cleaning subsystem for circulating cleaning fluid through a selectable one of said first or second sets of filling nozzles and corresponding metering devices; and a controls/utilities subsystem for coordinating operation of the container indexing assembly with the product contact subsystem, said controls/utilities subsystem periodically initiating a cleaning cycle in which supply and metering of liquid through one set of filling nozzles and metering devices is stopped for cleaning by said cleaning subsystem and pressurized cleaning fluid is circulated there through, while in-process metering of liquid is continued through the other set of filling nozzles and metering devices.

8. The filling system for automatically filling containers with liquid product in a production cycle and for clean-in-place (CIP) cleaning of the product contact parts according to claim 7, wherein said cleaning subsystem includes a fluid reservoir for containing cleaning fluid, a pump for circulating cleaning fluid out of said fluid reservoir, a cleaning fluid supply manifold connected on one side to said fluid reservoir via said pump and connectable on the other side through one of said first and second sets of filling nozzles and metering devices, and a cleaning fluid collection manifold connected to said one of the first and second sets of filling nozzles and metering devices for collecting cleaning fluid circulating there through.

9. The filling system for automatically filling containers with liquid product in a production cycle and for clean-in-place (CIP) cleaning of the product contact parts according to claim 8, wherein said one of the first and second sets of filling nozzles and metering devices are subjected to a "Clean-in-Place" process by manually connecting said cleaning fluid supply manifold.

10. The filling system for automatically filling containers with liquid product in a production cycle and for clean-in-place (CIP) cleaning of the product contact parts according to claim 8, wherein used cleaning fluid is recirculated from said fluid collection manifold back to said fluid reservoir for recycling.

11. A method for automatically filling containers with liquid product in a production cycle and for clean-in-place (CIP) cleaning of the product contact parts during said production cycle, comprising the steps of:

providing a product contact subsystem for metering said liquid product into containers via at least one set of filling nozzles and corresponding metering devices;

providing a cleaning subsystem for periodically circulating cleaning fluid through said at least one set of filling nozzles and metering devices;

alternately initiating either one of a production cycle during which containers are conveyed to and from a filling area and are filled by said at least one set of filling nozzles and corresponding metering devices, or a cleaning cycle by which said at least one set of filling nozzles and corresponding metering devices are cleaned by said cleaning subsystem.

12. The method for automatically filling containers with liquid product in a production cycle and for clean-in-place (CIP) cleaning of the product contact parts according to claim 11, wherein the step of alternately initiating said cleaning cycle further comprises manually connecting said cleaning subsystem to said at least one set of filling nozzles and corresponding metering devices.

13. The method for automatically filling containers with liquid product in a production cycle and for clean-in-place (CIP) cleaning of the product contact parts according to claim 12, wherein the step of alternately initiating said cleaning cycle further comprises recycling used cleaning fluid.

14. The method for automatically filling containers with liquid product in a production cycle and for clean-in-place (CIP) cleaning of the product contact parts according to claim 11, wherein said step of providing a product contact subsystem further comprises providing two sets of filling nozzles and corresponding metering devices; and said step of alternately initiating either one of a production cycle or a cleaning cycle further comprises initiating a changeover cycle for reconfiguring the filling system in which one set of filling nozzles and corresponding metering devices are removed from production and are replaced by the other cleaned set.

15. The method for automatically filling containers with liquid product in a production cycle and for clean-in-place (CIP) cleaning of the product contact parts according to claim 14, wherein said step of alternately initiating either one of a production cycle or a cleaning cycle further comprises initiating a cleaning cycle concurrent with said production cycle by which said removed set of filling nozzles and corresponding metering devices are cleaned by said cleaning subsystem.

16. A filling system for automatically filling containers with liquid product in a production cycle and for clean-out-of-place (COP) cleaning of product contact parts, comprising:

a container handling subsystem for carrying containers to and from a filling area, and a container indexing assembly for indexing containers into position in said filling area, said container handling subsystem and said container indexing assembly being mounted stationary on a frame;

a product contact subsystem for metering liquid product into containers in said filling area, said product contact subsystem further including at least one filling nozzle and corresponding metering device for metering liquid through said filling nozzle into the containers;

a COP trolley subsystem for movably supporting said at least one filling nozzle and corresponding metering device relative to said container handling and indexing assembly frame and for shuttling said at least one filling nozzle and metering device to a cleaning site for remote cleaning; and a controls/utilities subsystem for coordinating operation of the container handling subsystem and the container indexing assembly with the product contact subsystem.

17. The filling system for automatically filling containers with liquid product in a production cycle and for clean-out-of-place (COP) cleaning of product contact parts according to claim 16, wherein all product contact parts of said product contact subsystem are supported on said COP trolley subsystem.

18. The filling system for automatically filling containers with liquid product in a production cycle and for clean-out-of-place (COP) cleaning of product contact parts according to claim 17, wherein at least one metering device drive assembly is supported on said COP trolley subsystem.

19. The filling system for automatically filling containers with liquid product in a production cycle and for clean-out-of-place (COP) cleaning of product contact parts according to claim 16, wherein said COP trolley subsystem is self-propelled.

20. The filling system according to claim 16, wherein said COP trolley subsystem is removably connected to the container handling and indexing assembly frame via a docking and alignment mechanism.

21. The filling system according to claim 20, wherein said docking and alignment mechanism further comprises an alignment rod mounted vertically on the COP trolley subsystem, and an alignment channel mounted vertically on the container handling and indexing assembly frame for receiving said alignment rod and for urging it toward bottom center of the alignment channel.

22. The filling system according to claim 20, wherein said docking and alignment mechanism further comprises a clamping device for rapid coupling of the COP trolley subsystem to the container handling and indexing assembly frame.

23. The filling system according to claim 16, further comprising a remote cleaning subsystem at said remote cleaning site for circulating cleaning fluid through said product contact subsystem when said COP trolley subsystem is stationed at the remote cleaning site.

24. The filling system according to claim 23, wherein said remote cleaning subsystem further comprises a fluid reservoir, a pressure feed system to circulate cleaning fluid through the said product contact subsystem, a cleaning fluid supply manifold, and a cleaning fluid collection manifold.

25. The filling system according to claim 24, wherein said remote cleaning subsystem further comprises means to cycle said metering devices.

26. The filling system according to claim 25, wherein said means to cycle said metering devices further comprises a metering device drive assembly mounted on a frame supporting said remote cleaning subsystem's fluid reservoir, pressure feed system, cleaning fluid supply manifold, and cleaning fluid collection manifold.

27. The filling system according to claim 26, wherein said remote cleaning subsystem further comprises a controls/utilities system mounted on said frame for controlling operation of said remote cleaning subsystem.

28. The filling system according to claim 27, wherein said remote cleaning subsystem's controls/utilities system is separate and distinct from said controls/utilities subsystem for coordinating operation of the container indexing assembly with the product contact subsystem.

29. The filling system according to claim 16, where in said COP trolley subsystem is removably connected to the stationary frame via a docking and alignment mechanism capable of accommodating drive connections between a multi-station metering device drive assembly and said metering devices.

30. A filling system for automatically filling containers with liquid product in a production cycle and for clean-out-of-place (COP) cleaning of the product contact parts, comprising:

a container handling subsystem for carrying containers to and from a filling area, and a container indexing assembly for indexing containers into position in said filling area, said container handling subsystem and said container indexing assembly being mounted stationary on a frame;

a product contact subsystem for metering said liquid product into containers in said filling area, said product contact subsystem further including at least two sets of filling nozzles and corresponding metering devices for metering liquid through said filling nozzles into the containers;

a COP trolley subsystem for shuttling a selectable one of said sets of filling nozzles and metering devices to the remote cleaning site for cleaning, and for shuttling another set of filling nozzles and metering devices back to the filling area for use in said production cycle; and a controls/utilities subsystem for coordinating operation of the container handling subsystem and the container indexing assembly with the product contact subsystem.

31. The filling system according to claim 30, wherein said COP trolley subsystem further comprises at least two trolleys, said trolleys being used for shuttling a selectable one of said sets of filling nozzles and metering devices to the remote cleaning site for cleaning and for shuttling another selectable one of said sets of filling nozzles and metering devices back to the filling area for use in said production cycle.

32. The filling system according to claim 31, wherein said at least two COP trolleys are removably connected to the container handling and indexing assembly frame via docking and alignment mechanisms.

33. The filling system according to claim 32, wherein each of said docking and alignment mechanisms further comprises an alignment rod mounted vertically on the corresponding COP trolley subsystem, and an alignment channel mounted vertically on the container handling and indexing assembly frame for receiving said alignment rod and for urging it toward bottom center of the alignment channel.

34. The filling system according to claim 32, wherein each of said docking and alignment mechanisms further comprise a clamping device for rapid coupling of the corresponding COP trolley to the container handling and indexing assembly frame.

35. The filling system according to claim 31, wherein each of said at least two trolleys further comprises identification means, said identification means allowing said controls/utilities subsystem to differentiate among the at least two trolleys.

36. The filling system according to claim 31, further comprising a remote cleaning subsystem for circulating cleaning fluid through said product contact subsystem when a COP trolley is stationed at the remote cleaning site.

37. The filling system according to claim 36, wherein said remote cleaning subsystem further comprises a fluid reservoir, a pressure feed system to circulate cleaning fluid through the said product contact subsystem, a cleaning fluid supply manifold, and a cleaning fluid collection manifold.

38. The filling system according to claim 37, wherein said remote cleaning subsystem further comprises means to cycle said metering devices.

39. The filling system according to claim 38, wherein said means to cycle said metering devices further comprises a metering device drive assembly mounted on a frame supporting said remote cleaning subsystem's fluid reservoir, pressure feed system, cleaning fluid supply manifold, and cleaning fluid collection manifold.

40. The filling system according to claim 39, wherein said remote cleaning subsystem further comprises a controls/utilities system mounted on said frame for controlling operation of said remote cleaning subsystem.

41. The filling system according to claim 40, wherein said remote cleaning subsystem's controls/utilities system is separate and distinct from said controls/utilities subsystem for coordinating operation of the container indexing assembly with the product contact subsystem.

42. A method for automatically filling containers with liquid product in a production cycle and for clean-out-of-place (COP) cleaning of product contact parts during said production cycle, comprising the steps of:

providing a product contact subsystem for metering said liquid product into containers via at least one filling nozzle and corresponding metering device;

providing a remote cleaning subsystem including pressurized cleaning fluid feed system for circulating cleaning fluid through a reservoir;

providing a COP trolley subsystem for shuttling said at least one filling nozzle and corresponding metering device to the remote cleaning subsystem for cleaning;

alternately initiating either one of a production cycle during which containers are conveyed to and from a filling area and are filled by said at least one set of filling nozzles and corresponding metering devices, or a cleaning cycle by which said at least one set of filling nozzles and corresponding metering devices are shuttled by said COP trolley subsystem to said remote cleaning subsystem for cleaning out of place.

43. The method for automatically filling containers with liquid product in a production cycle and for clean-out-of-place (COP) cleaning of the product contact parts according to claim 42, wherein the step of alternately initiating said cleaning cycle further comprises manually connecting said remote cleaning subsystem to said at least one set of filling nozzles and corresponding metering devices.

44. The method for automatically filling containers with liquid product in a production cycle and for clean-out-of-place (COP) cleaning of the product contact parts according to claim 43, wherein the step of alternately initiating said cleaning cycle further comprises recycling used cleaning fluid.

45. A method for automatically filling containers with liquid product in a production cycle and for clean-out-of-place (COP) cleaning of product contact parts during said production cycle, comprising the steps of:

providing a product contact subsystem for metering said liquid product into containers via one of at least two sets of filling nozzles and corresponding metering devices;

providing a remote cleaning subsystem including pressurized cleaning fluid feed system for circulating cleaning fluid through a reservoir;

providing a COP trolley subsystem for shuffling a selectable one of said sets of filling nozzles and corresponding metering devices to the remote cleaning subsystem for cleaning, and for shuttling another set of filling nozzles and corresponding metering devices back to the filling area for use in said production cycle;

initiating a production cycle during which containers are conveyed to and from a filling area and are filled by one of said sets of filling nozzles and corresponding metering devices; and initiating a cleaning cycle during which another of said sets of filling nozzles and corresponding metering devices are shuttled by said COP trolley subsystem to said remote cleaning subsystem for cleaning out of place.

46. The method for automatically filling containers with liquid product in a production cycle and for clean-out-of-place (COP) cleaning according to claim 45, further comprising the step of recycling used cleaning fluid.

47. The method for automatically filling containers with liquid product in a production cycle and for clean-out-of-place (COP) cleaning according to claim 46, wherein the step of providing said COP trolley subsystem further comprises providing at least two trolleys, and said step of initiating a cleaning cycle further comprises initiating a changeover cycle for reconfiguring the filling system in which one of said COP trolleys shuttles a selectable one of said sets of filling nozzles and corresponding metering devices to the remote cleaning subsystem for cleaning while another COP trolley shuttles another set of filling nozzles and corresponding metering devices back to the filling area for use in said production cycle.

48. A filling system for automatically filling containers with liquid product in a production cycle and for clean-out-of-place (COP) cleaning of product contact parts, comprising:

a container handling subsystem for carrying containers to and from a filling area, and a container indexing assembly for indexing containers into position in said filling area, said container handling subsystem and said container indexing assembly being mounted stationary on a frame;

a product contact subsystem for metering liquid product into containers in said filling area, said product contact subsystem further including at least one filling nozzle, at least one flexible product delivery tube, and at least one corresponding metering device for metering liquid through said filling nozzle and said delivery tube into the containers;

a COP trolley subsystem for movably supporting said at least one filling nozzle and at least one flexible product delivery tube and for shuttling said at least one filling nozzle and product delivery tube between said container handling and indexing assembly frame and a cleaning site for remote cleaning; and a controls/utilities subsystem for coordinating operation of the container handling subsystem and the container indexing assembly with the product contact subsystem.

49. The filling system for automatically filling containers with liquid product in a production cycle and for clean-out-of-place (COP) cleaning of product contact parts according to claim 48, wherein said at least one filling nozzle and said at least one flexible product delivery tube of said product contact subsystem are supported on said COP trolley subsystem.

50. The filling system according to claim 49, further comprising a remote cleaning subsystem at said remote cleaning site for circulating cleaning fluid through said at least one filling nozzle and said at least one flexible product delivery tube when said COP trolley subsystem is stationed at the remote cleaning site.

51. The filling system according to claim 50, wherein said remote cleaning subsystem further comprises a fluid reservoir, a pressure feed system to circulate cleaning fluid through said at least one filling nozzle and said at least one flexible product delivery tube, a cleaning fluid supply manifold, and a cleaning fluid collection manifold.

52. A filling system for automatically filling containers with liquid product in a production cycle and for clean-out-of-place (COP) cleaning of the product contact parts, comprising:

a container handling subsystem for carrying containers to and from a filling area, and a container indexing assembly for indexing containers into position in said filling area, said container handling subsystem and said container indexing assembly being mounted stationary on a frame;

a product contact subsystem for metering said liquid product into containers in said filling area, said product contact subsystem further including, at least two sets of filling nozzles, at least two sets of flexible product delivery tubing and corresponding metering devices for metering liquid through said sets of filling nozzles and said sets of product delivery tubing into the containers, a COP trolley subsystem for shuttling a selectable one of said sets of filling nozzles and one of said sets of product delivery tubing to the remote cleaning site for cleaning, and for shuttling another set of filling nozzles and another set of product delivery tubing back to the filling area for use in said production cycle; and a controls/utilities subsystem for coordinating operation of the container handling subsystem and the container indexing assembly with the product contact subsystem.

53. The filling system according to claim 52, wherein said COP trolley subsystem further comprises at least two trolleys, said trolleys being used for shuttling a selectable one of said sets of filling nozzles and one of said sets of product delivery tubing to the remote cleaning site for cleaning and for shuttling another selectable one of said sets of filling nozzles and one of said sets of product delivery tubing back to the filling area for use in said production cycle.

54. The filling system according to claim 53, further comprising a remote cleaning subsystem for circulating cleaning fluid through said one of said sets of filling nozzles and said one of said sets of product delivery tubing when a COP trolley is stationed at the remote cleaning site.

55. The filling system according to claim 54, wherein said remote cleaning subsystem further comprises a fluid reservoir, a pressure feed system to circulate cleaning fluid through said one of said sets of filling nozzles and said one of said sets of product delivery tubing, a cleaning fluid supply manifold, and a cleaning fluid collection manifold.

56. A filling system for semi-automatically filling containers with liquid product, comprising:

a container handling subsystem in which an operator places said containers for filling, said container handling subsystem being mounted on a stationary frame and further comprising a container body/nozzle alignment assembly;

a nozzle support subsystem for supporting at least one nozzle during a filling process;

a product contact subsystem for metering said liquid product into said containers in said alignment assembly, said product contact subsystem further comprising one or more articulated filling nozzles, one or more flexible product delivery tubes, and one or more metering devices for metering liquid to said one or more filling nozzles;

a COP trolley subsystem for movably supporting one or more articulated filling nozzles and one or more flexible product delivery tubes relative to said container handling subsystem frame and for shuttling said one or more filling nozzles and said one or more delivery tubes to a cleaning site for remote cleaning; and a controls/utilities subsystem for coordinating operation of said container handling subsystem and said nozzle support subsystem with said product contact subsystem.

57. The filling system for semi-automatically filling containers according to claim 56, wherein said COP trolley subsystem further comprises one or more trolleys, each trolley being used to shuttle one or more articulated filling nozzles and one or more flexible product delivery tubes to said remote cleaning site for cleaning, and to shuttle one or more articulated filling nozzles and one or more flexible product delivery tubes from said remote cleaning site back to a filling area for use in a production cycle.

58. The filling system for semi-automatically filling containers according to claim 57, further comprising a remote cleaning subsystem at said remote cleaning site for circulating cleaning fluid through said one or more filling nozzles and said one or more flexible product delivery tubes when one of said one or more trolleys is stationed at said remote cleaning site.

59. The filling system for semi-automatically filling containers according to claim 58, wherein said remote cleaning system further comprises a fluid reservoir, a pressure feed system to circulate cleaning fluid through said one or more filling nozzles and said one or more flexible product delivery tubes, a cleaning fluid supply manifold, and a cleaning fluid collection manifold.

60. A filling system for semi-automatically filling containers with liquid product, comprising:

a container handling subsystem in which an operator places said containers for filling, said container handling subsystem being mounted on a stationary frame and further comprising a container body/nozzle alignment assembly;

a nozzle support subsystem for supporting at least one nozzle during a filling process;

a product contact subsystem for metering said liquid product into said containers in said alignment assembly, said product contact subsystem further comprising one or more articulated filling nozzles and one or more metering devices for metering liquid to said one or more filling nozzles;

a COP trolley subsystem for movably supporting one or more articulated filling nozzles and one or more metering devices relative to said container handling subsystem frame and for shuttling said one or more filling nozzles and said one or more metering devices to a cleaning site for remote cleaning; and a controls/utilities subsystem for coordinating operation of said container handling subsystem and said nozzle support subsystem with said product contact subsystem.

61. The filling system for semi-automatically filling containers according to claim 60, wherein said COP trolley subsystem further comprises one or more trolleys, each trolley being used to shuttle one or more articulated filling nozzles and one or more metering devices to said remote cleaning site for cleaning, and to shuttle one or more articulated filling nozzles and one or more metering devices from said remote cleaning site back to a filling area for use in a production cycle.

62. The filling system for semi-automatically filling containers according to claim 61, further comprising a remote cleaning subsystem at said remote cleaning site for circulating cleaning fluid through said one or more filling nozzles and said one or more metering devices when one of said one or more trolleys is stationed at said remote cleaning site.

63. The filling system for semi-automatically filling containers according to claim 62, wherein said remote cleaning system further comprises a fluid reservoir, a pressure feed system to circulate cleaning fluid through said one or more filling nozzles and said one or more metering devices, a cleaning fluid supply manifold, and a cleaning fluid collection manifold.

64. A method for automatically filling containers, comprising the steps of:

feeding two lanes of containers through a filling system;

indexing said containers beneath at least two filling nozzles each positioned over a respective lane;

metering a single supply of liquid to product diversion means for dividing and directing said liquid to said at least two filling nozzles; and filling both lanes of containers with a predetermined amount of liquid in an alternating fashion, the step of filling said containers in said two lanes in an alternating fashion further comprising filling at least one container in one lane while removing at least one filled corresponding container in the other lane, repetitively, until a production run has been completed;

whereby the number of containers filled per minute is increased.

65. The method for automatically filling containers according to claim 64 wherein said step of filling said containers in said two lanes in an alternating fashion further comprises the steps of filling at least one container located in one lane with a predetermined amount of liquid while simultaneously indexing at least one container in a second lane into position beneath at least one filling nozzle positioned in said second lane.

66. A method for automatically filling containers, comprising the steps of:

feeding a single lane of empty containers into a filling system;

dividing said single incoming lane of containers into two filling areas;

indexing said containers beneath at least two filling nozzles each positioned over a respective filling area;

metering a single supply of liquid to product diversion means for directing said liquid to one of said at least two filling nozzles;

filling both areas of containers with a predetermined amount of liquid in an alternating fashion, said alternating fashion further comprising the steps of filling at least one container located in one area with said predetermined amount of liquid while simultaneously at least one container in a second area is indexed into position beneath at least one filling nozzle positioned in said second area, and said at least one filling nozzle in said second area is positioned to begin filling said at least one container in said second area; and combining the two areas of containers and discharging them from the filling system in a single lane;

whereby the number of containers filled per minute is increased.

67. A method for semi-automatically filling containers, comprising the steps of:

placing empty containers into two filling areas of a filling system;

centering said containers beneath at least two filling nozzles each positioned over a respective filling area;

metering a single supply of liquid to product diversion means for directing said liquid to one of said at least two filling nozzles; and filling both areas of containers with a predetermined amount of liquid in an alternating fashion, said alternating fashion further comprising the steps of filling at least one container located in one area with said predetermined amount of liquid while simultaneously at least one container is placed in position in a second area beneath at least one filling nozzle positioned in said second area, and said at least one filling nozzle in said second area is positioned to begin filling said at least one container in said second area;

whereby the number of containers filled per minute is increased.

68. A filling system for semi-automatically filling containers with liquid product, comprising:

a container handling subsystem in which an operator places said containers for filling, said container handling subsystem further comprising a dual-area container body/nozzle alignment assembly;

at least two nozzle support subsystems for supporting at least two nozzles during the filling process;

a product contact subsystem for metering said liquid product into said containers in said dual-area alignment assembly, said product contact subsystem further comprising at least two articulated filling nozzles, at least one metering device for metering liquid, and a diverter valve assembly for directing the metered liquid output from said at least one metering device to said at least two filling nozzles; and a controls/utilities subsystem for coordinating operation of said container handling subsystem and said at least two nozzle support subsystems with said product contact subsystem.

69. The filling system for semi-automatically filling containers according to claim 68, wherein said diverter valve assembly alternately directs liquids to one of two filling nozzles.

70. A filling system for automatically filling containers with liquid product, comprising:

a container handling subsystem for carrying a plurality of containers to and from a filling area, said container handling subsystem further comprising:

a lane dividing mechanism for directing a single lane of incoming containers into one of two lanes for passage through the filling area;

a dual-lane conveyor assembly for transporting the containers through the filling area; and a lane combining assembly at the termination of the dual-lane conveyor assembly for combining two lanes of filled containers into a single lane;

a container indexing assembly for indexing containers through said filling area;

a product contact subsystem for metering said liquid product into containers in said filling area, said product contact subsystem further including;

a plurality of filling nozzles;

a nozzle support subsystem for supporting said nozzles during the filling process;

at least one metering device capable of continuously metering liquid; and product diversion means for directing the metered liquid output from the metering device into one of said filling nozzles; and a controls/utilities subsystem connected to the container handling subsystem and the container indexing assembly for coordinating operation with the product contact subsystem.

71. The filling system for automatically filling containers according to claim 70, wherein said lane dividing mechanism is a pivoting gate assembly.

72. The filling system for automatically filling containers according to claim 70, wherein said lane combining assembly further comprises a set of angled guide rails.

73. A filling system for automatically filling containers with liquid product, comprising:

a container handling subsystem for carrying a plurality of containers to and from a filling area;

a container indexing assembly for indexing containers through said filling area;

a product contact subsystem for metering said liquid product into containers in said filling area, said product contact subsystem further including;

a plurality of filling nozzles;

a nozzle support subsystem for supporting said nozzles during the filling process;

at least one metering device capable of continuously metering liquid, said metering device is any one from among the group comprising a rotary gear pump, a rotary lobe pump, a peristaltic pump, a diaphragm pump, a double-ended piston pump, a flow meter, and a time/pressure filling head; and product diversion means for directing the metered liquid output from the metering device into one of said filling nozzles; and a controls/utilities subsystem connected to the container handling subsystem and the container indexing assembly for coordinating operation with the product contact subsystem.

74. A filling system for automatically filling containers with liquid product, comprising:

a container handling subsystem for carrying a plurality of containers to and from a filling area;

a container indexing assembly for indexing containers through said filling area;

a product contact subsystem for metering said liquid product into containers in said filling area, said product contact subsystem further including;

a plurality of filling nozzles;

a nozzle support subsystem for supporting said nozzles during the filling process;

at least one metering device capable of continuously metering liquid; and product diversion means for alternately directing the metered liquid output from the metering device into one of said filling nozzles, said product diversion means is a diverter valve assembly; and a controls/utilities subsystem connected to the container handling subsystem and the container indexing assembly for coordinating operation with the product contact subsystem.

75. The filling system for automatically filling containers according to claim 74, wherein said diverter valve assembly further comprises a general purpose, three-way solenoid valve.

76. The filling system for automatically filling containers according to claim 74, wherein said diverter valve assembly further comprises one of a Y- or T-shaped connector and general purpose, two-way solenoid valve integral to said filling nozzles.

77. The filling system for automatically filling containers according to claim 74, wherein said diverter valve assembly further comprises one of a Y- or T-shaped connector and a pinch clamp integral to said filling nozzles.

78. A filling system for automatically filling containers with liquid product, comprising:

a container handling subsystem for carrying a plurality of containers to and from a filling area, said container handling subsystem further comprising two conveyor lanes;

a container indexing assembly for indexing containers through said filling area;

a product contact subsystem for metering said liquid product into containers in said filling area, said product contact subsystem further including;

a plurality of filling nozzles;

a nozzle support subsystem for supporting said nozzles during the filling process, said nozzle support subsystem including a walking beam assembly for maintaining a proper relative position between said plurality of filling nozzles and said plurality of containers in said two conveyor lanes during a filling cycle, said walking beam assembly further comprises a walking beam, a horizontal motion drive mechanism for articulating said filling nozzles along a horizontal axis of motion, and a vertical motion drive mechanism for articulating said filling nozzles along a vertical axis of motion;

at least two metering devices for metering liquid; and a controls/utilities subsystem connected to the container handling subsystem and the container indexing assembly for coordinating operation with the product contact subsystem.

79. The system for automatically filling containers according to claim 78, wherein each of said horizontal motion drive mechanism and vertical motion drive mechanism further comprises a servo motor.

80. The system for automatically filling containers according to claim 79, wherein the horizontal motion servo motor provides encoder feedback data to the control subsystem for tracking the horizontal velocity and position of the nozzles along the walking beam to the containers carried beneath on the indexing mechanism.

81. The system for automatically filling containers according to claim 78, wherein horizontal motion generated by the horizontal motion servo motor is translated to the nozzles by linear bearings.

* * * * *